US005722103A

United States Patent [19]

Walega

[11] Patent Number: 5,722,103

[45] Date of Patent: Mar. 3, 1998

[54] TOE AND SIDE AND HEEL LASTING MACHINE AND METHOD OF LASTING

[75] Inventor: William Walega, Hollis, N.H.

[73] Assignee: International Shoe Machine Corporation, Nashua, N.H.

[21] Appl. No.: 595,554

[22] Filed: Feb. 1, 1996

[51] Int. Cl.[6] ..... A43D 21/16; A43D 21/08

[52] U.S. Cl. ..... 12/7; 12/8.3; 12/8.5; 12/10

[58] Field of Search ..... 12/7, 8.2, 8.3, 12/8.4, 8.5, 9, 10.1, 10.4, 12, 14.5

[56] References Cited

U.S. PATENT DOCUMENTS

| | | | |
|---|---|---|---|
| 387,366 | 8/1888 | Paine et al. | 12/8.4 |
| 2,607,936 | 8/1952 | Kamborian | 12/8.3 |
| 2,693,606 | 11/1954 | Quinn | 12/8.3 |
| 2,887,696 | 5/1959 | Finn | 12/8.5 |
| 4,688,288 | 8/1987 | Giebel et al. | 12/14.5 |
| 4,920,594 | 5/1990 | Flanders et al. | 12/7 |

*Primary Examiner*—Paul T. Sewell
*Assistant Examiner*—Anthony Stashick
*Attorney, Agent, or Firm*—Lowe, Price, LeBlanc & Becker

[57] ABSTRACT

A machine for lasting the toe and side and heel of an upper to an insole mounted to a last includes a toe and ball wiper assembly and a heel and shank wiper assembly in combination with a pincer assembly mechanism for stretching the upper tightly about the last and a toe clamping mechanism for clamping the stretched upper against the last. Following stretching and clamping, the toe wipers are actuated to press the upper margins against the insole bottom against the counter force of an overhead toe hold-down acting against the top of the upper. A brake mechanism fixes the overhead hold-down to maintain the toe wiping plane in a constant position. The heel wiper assembly is elevated within the machine to locate the heel wiper plane at a proper height relative to the insole bottom, the proper height being determined with a sensor mounted for movement with the heel wiper assembly. A heel clamping pad assembly connected to the heel wiper assembly then clamps the heel prior to stretching of the upper. After toe wiping, the heel and shank portions are then progressively wiped before the assemblies are retracted to remove the fully lasted footwear. The heel wiper plane may be adjusted by rotating the heel wiper about a rotational axis passing through the toe wiper plane beneath the insole bottom. A method of toe and side and heel lasting with the aforementioned machine is also disclosed.

12 Claims, 48 Drawing Sheets

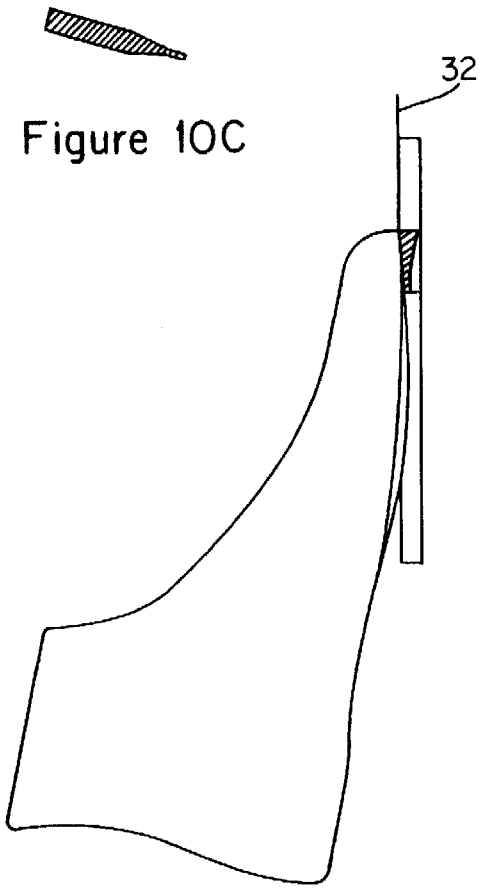
Figure 10C
Figure 10D
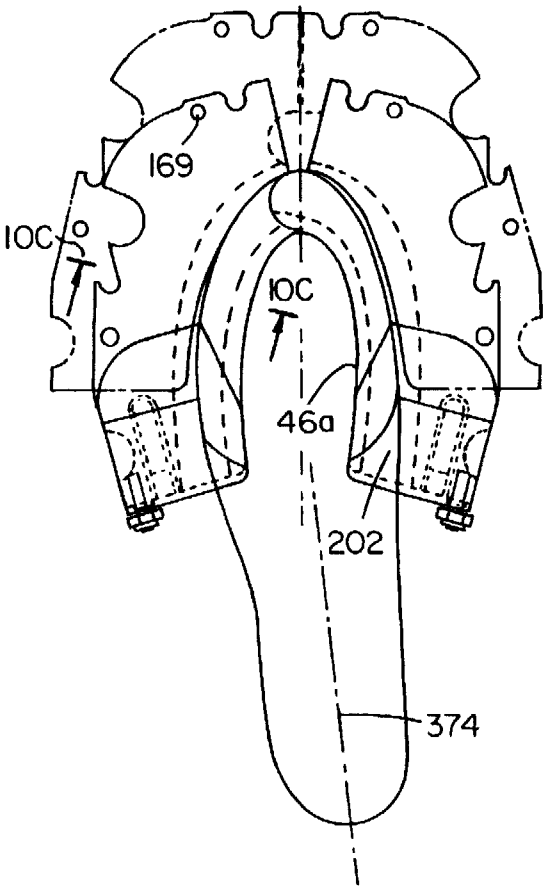
Figure 10B
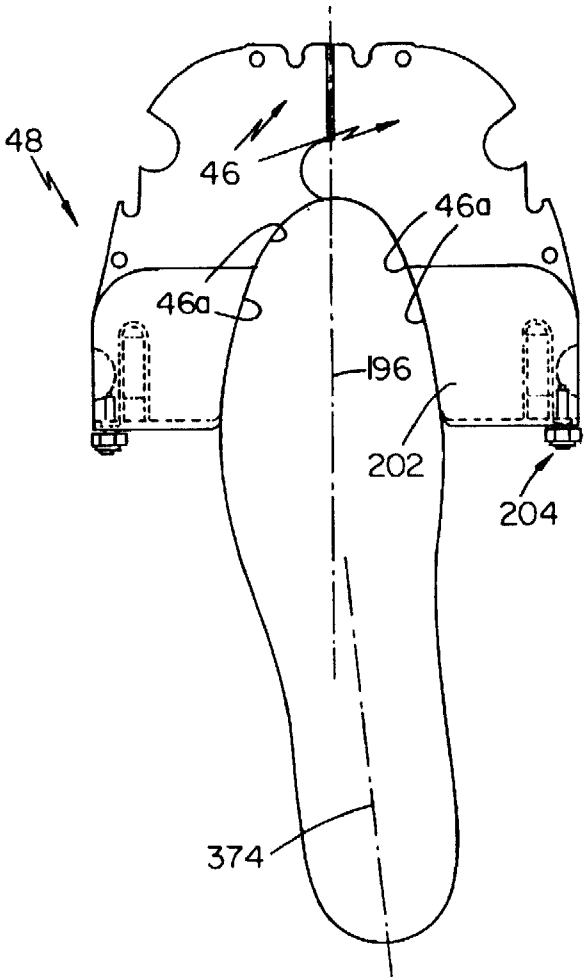
Figure 10A

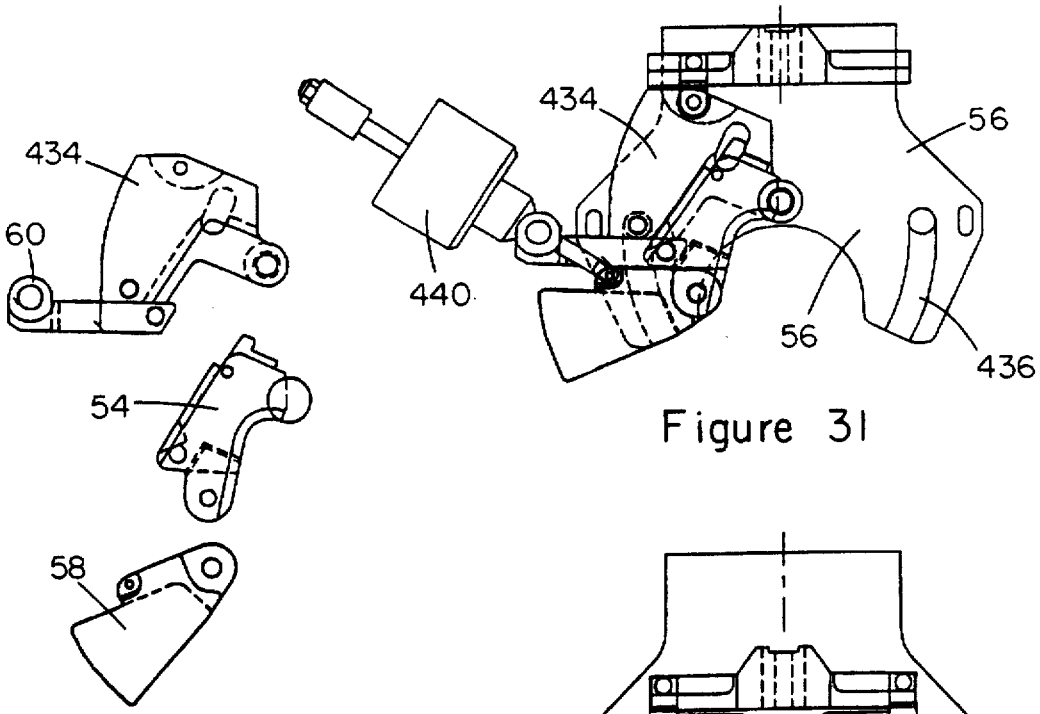
Figure 31
Figure 31A
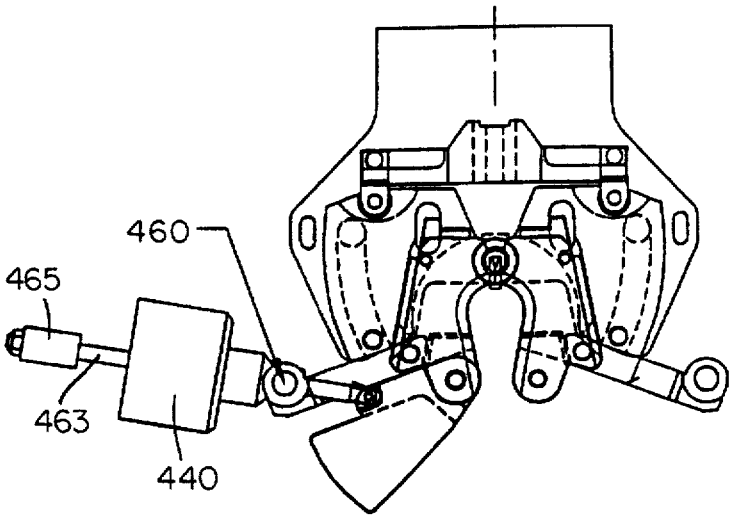
Figure 32
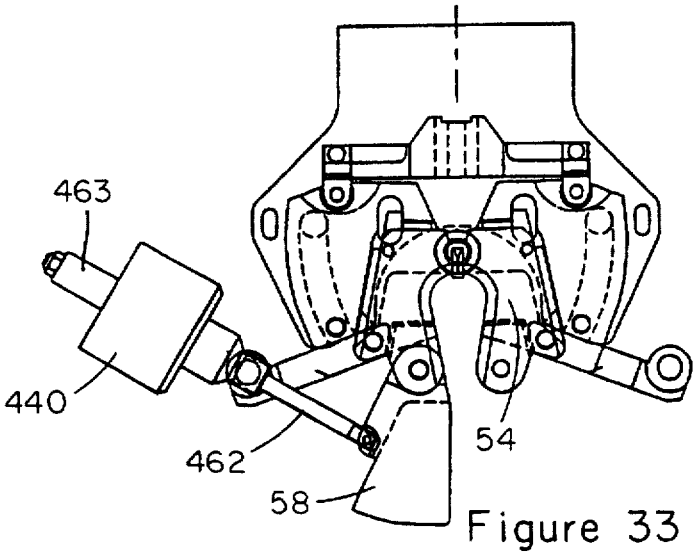
Figure 33

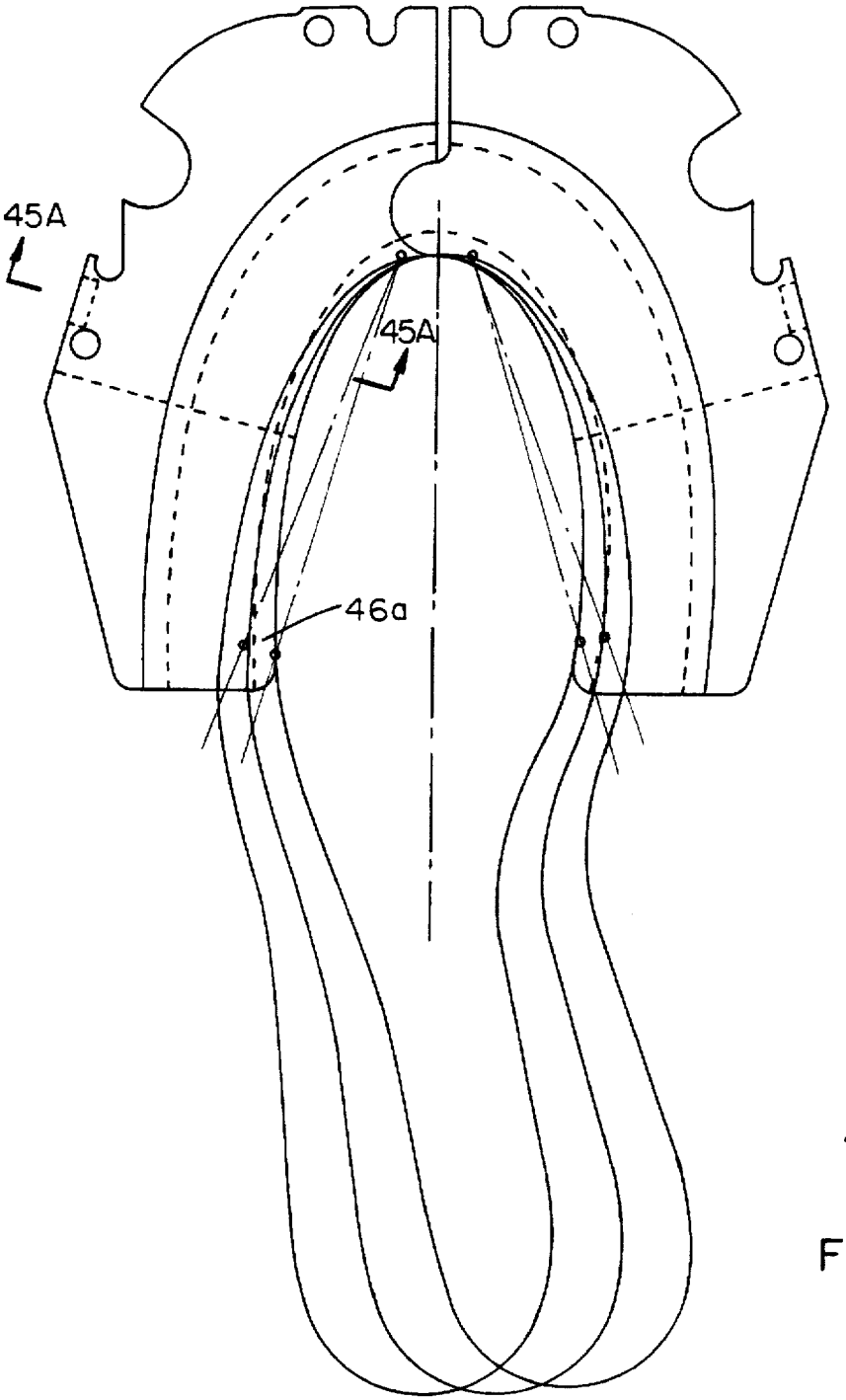
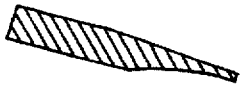
Figure 45A
Figure 45

TOE AND SIDE AND HEEL LASTING MACHINE AND METHOD OF LASTING

TECHNICAL FIELD

The present invention relates to machines for lasting a shoe upper to a shoe insole and, more particularly, to machines for lasting the toe and sides and heel of the upper in a footwear lasting assembly.

BACKGROUND ART

In one type of shoe fabrication process, a footwear upper assembly, formed of a last having an insole located on its bottom and an upper mounted thereon, is first toe lasted, then heel lasted, and finally side lasted with two or three different machines respectively requiring separate operators. The training protocol for each machine is different. Consequently, extensive and time consuming operator training is required and the individual lasting steps result in an extremely labor intensive process.

It is accordingly an object of the present invention to last the toe, side and heel of a footwear assembly in one machine.

Another object is to toe, side and heel last a footwear assembly with one operator undergoing training for operating a toe and side and heel lasting machine.

In addition to the requirement of extensive operator training, the known machines of which I am aware are extremely labor intensive in operation and require the operator to manipulate the shoe footwear assembly during each of the individual lasting processes. Such physical manipulation necessitates extensive wrist movement and has been known to result in the development of carpal tunnel syndrome, disadvantageously resulting in a loss of production and a greater number of injuries and workmen's compensation filings by the lasting shoe machine operators.

Yet a further object of the invention is to minimize injuries to the operator by requiring less physical manipulation of the shoe by the operator during lasting.

To be commercially viable, a lasting machine for lasting the toe and side and heel of a shoe footwear assembly must have the capability of being easily adjusted to accommodate footwear assembly of different size. Apart from varying the distance between toe and heel lasting instrumentalities, such a lasting machine should preferably have facility for adjusting the heel wiper assembly to enable heel wipers to closely approximate the heel portion of the shoe insole to ensure a good wipe. Such a lasting machine should also minimize operator involvement for improved safety and less likelihood of injury while being further able to easily impose toe and side and heel lasting forces against the footwear assembly without adversely affecting the wiping precision required of each of the lasting instrumentalities.

Still another object is to permit easy and precision adjustments of the lasting instrumentalities to accommodate different shoe sizes and shapes by enabling the wipers to closely approximate the inclination of the toe and heel portions of the shoe insole.

DISCLOSURE OF THE INVENTION

The toe and heel lasting machine of the present invention typically includes a footwear assembly support, mounted to a machine frame, to support the footwear assembly, in combination with a toe wiper assembly and a heel wiper assembly for performing the lasting operations. The toe wiper assembly includes a plurality of toe wipers mounted to the machine frame for movement in a toe wiping plane to press a toe portion of the upper margin against the insole bottom. The heel wiper assembly includes a plurality of heel wipers mounted to the machine frame for movement in a heel wiping plane to press a heel portion of the upper margin against the insole bottom.

The machine of the present invention incorporates a number of unique features that are preferably used in combination with each other in order to attain all of the advantages offered by the present invention. However, it will be understood that the unique features identified and described hereinbelow may be generally incorporated within the shoe lasting machine independent of the other unique assemblies described hereinbelow or as will otherwise occur to one of ordinary skill in the art upon a review of this specification.

One of the unique features of the present invention relates to means for adjusting the heel wiping plane by moving the heel wiper assembly in relation to an arcuate path having an axis of rotation extending through the toe wiping plane. Such heel wiping plane adjustment means, in accordance with the preferred embodiment, utilizes a toe post carriage having cam followers mounted to opposite ends thereof which are respectively received in a plurality of front and rear cam tracks formed in a pair of machine side frames. Each cam track is respectively defined by a front and rear pair of said arcuate paths. The carriage supports a heel post on which is mounted the heel wiper assembly and the front and rear arcuate paths respectively lie on separate arc portions of concentric circles having said axis of rotation as their center.

By moving the heel carriage preferably under the action of a screw driven drive nut, the heel wiping plane defined by wiping movement of the heel wiper assembly tends to be adjusted to more closely approximate the plane in which the heel portion of the insole bottom tend to resides, irrespective of the size of the last, since the point of rotational or pivotal adjustment is with reference to the toe wiping plane and preferably that portion of the toe wiping plane intersecting the plane of the insole heel bottom.

The heel post is preferably slidably supported for raising and lowering movement within a heel post housing slidably mounted to the heel carriage for movement in forward and rearward directions. The heel post housing is preferably screw driven to vary the distance between the heel wiper assembly and the toe wiper assembly to accommodate footwear of different size. Once the location of the heel post housing is adjusted along the heel carriage for shoe size, the heel carriage is then moved along the cam tracks in heel wiping plane adjusting movement. In the alternative, the heel wiping plane may be adjusted before adjustment of the heel post housing for shoe size.

Preferably, the heel post housing includes a lower housing movably mounted to the carriage and an upper housing supporting the heel post. The upper and lower housings are pivotally connected to each other. In accordance with another feature of the invention, means is provided for pivoting the upper housing relative to the lower housing to tilt the longitudinal axis of the heel post and thereby the heel wiper plane in further adjusting movement.

A brake member may be mounted to the lower heel post housing and actuated by the weight of the upper heel post housing to generate a braking force that fixes the lower housing at one location along the heel carriage. This braking movement advantageously resists the tendency of the heel post housing to slide relative to the heel carriage under the reaction forces generated during heel wiping. To ensure movement of the lower heel post housing along the carriage during periods between heel wiping, a brake release is provided to normally exert a slight lifting force against the upper heel post housing to remove the braking pressure otherwise exerted by the brake.

In accordance with another unique feature of this invention, a heel clamping pad assembly is connected to the heel wiper assembly and includes at least one clamping pad engageable with a heel portion of the upper to maintain the footwear assembly in a substantially fixed position relative to the heel wiping plane during lasting. The heel clamping pad assembly includes a center pad and a pair of side pads pivotally connected to the center pad for movement between clamped and unclamped positions. The feature of a three part pivotal clamping pad arrangement, which may be used independent or in combination with the aforementioned heel wiping plane adjusting means, improves the operator's visual and physical access to the heel wiping station without requiring substantial retracting movement otherwise necessary in a single clamping pad heel assembly customary to the art.

The heel clamping pad assembly preferably comprises a center mounting arm to which the center pad is mounted and a pair of side pivot arms pivotally connected to the center mounting arm. The side pads are respectively attached to the side pivot arms. In the preferred embodiment, each side pad is attached to one of the side pivot arms through a lug slidably mounted to the arm. Means is mounted to the side arm for respectively normally resiliently biasing the side pads toward the center pad. In this manner, the inward facing clamping surfaces of the side and center pads are advantageously forced together to present a substantially continuous clamping surface that minimizes pinching or marring of the upper.

Preferably, the inward facing clamping surfaces of at least the side pads are of a compliant nature to conform to the shape of the last.

Both the heel clamping pad assembly as well as the heel wiper assembly of the invention are preferably mounted atop the heel post through a floating arrangement, preferably achieved by springs, enabling the heel clamping assembly to achieve a self leveling action upon clamping engagement with the sides of the footwear assembly so as to adjust to the actual orientation of the footwear as a result of toe clamping forces previously generated thereagainst. Therefore, this self leveling action occurs generally along the heel axis and is transmitted to the heel wiper assembly so that the heel wiping plane also self adjusts to the actual plane of the insole heel portion.

In accordance with a further feature of the invention, both the heel wiper assembly and heel clamping pad assembly are also mounted to pivot about an axis, located forwardly of the heel wiper assembly and extending perpendicular and below the heel axis so that the footwear assembly is able to rock under bedding pressure exerted on the footwear assembly and the toe wipers by an overhead toe hold-down means. This enables good heel clamping contact with the footwear assembly.

The toe overhead hold-down assembly, in addition to generating an overhead clamping force during toe wiping and allowing bedding to occur, is also uniquely formed with a brake that serves to lock the overhead hold-down in fixed position against the top of the upper. This feature advantageously fixes the location of the toe wiping plane during both toe and heel lasting which more precisely maintains the footwear assembly in a fixed location to ensure good wiping.

It is an important feature of this invention to fix the toe wiping plane such as with the overhead hold-down assembly since the insole support providing lower support to the footwear assembly is raised and lowered during both toe and heel wiping to accommodate toe and heel wiping movement in the unique manner described below. Since the insole support is not always in lower supporting contact with the insole bottom, the overhead hold-down support ensures that the insole support is always raised to the same toe wiping plane to properly support the footwear.

In accordance with another unique feature of the invention, there is further provided means for raising and lowering the heel wiper assembly relative to the machine frame, and sensing means, mounted for movement with the heel wiper assembly, for sensing the position of the heel portion of the insole bottom. The sensing means is associated with a brake connected to the heel wiper assembly for halting further lifting movement of the heel wiper assembly in response to a signal generated as a result of detection by the sensing means of the heel portion. In this manner, the heel wiper plane is elevated to the correct height in relation to the actual position of the insole.

In accordance with another feature of the preferred embodiment, an array of pincer assemblies is positioned around the toe and ball portions of the footwear assembly for use in grasping the toe region of the upper margin to stretch the upper in cooperation with the insole support. Each pincer assembly includes a pair of jaws adapted to receive part of the toe or ball portion of the upper margin, and means for lowering the clamped pincer assemblies relative to the toe wiping plane to stretch the upper around the last. The lowering means includes a pair of upper and lower links connected at first ends thereof to an associated one of the pincer assemblies and is pivotally connected at intermediate portions thereof to a fixed support bracket. Means connected to the opposite ends of the upper and lower links is provided to raise and lower the opposite ends to achieve the aforesaid raising and lowering movement of the pincer assemblies through the pivoting action of the upper and lower links.

The upper and lower links preferably extend parallel to each other and are relatively dimensioned between their said first ends and the associated pivot so as to cause the clamped pincer jaws to travel downwardly from the toe wiping plane in a plane extending through the insole bottom edge perpendicular to the insole bottom. This tends to maximize the stretching force. However, with this double link feature and appropriate dimensioning thereof, it will be understood that the downward travel path of the clamped pincer jaws may be adjusted to achieve other types of movement, such as inward movement beneath the shoe or outward movement away from the shoe. In some applications, it may be desirable to vary the dimensions of the upper and lower links of certain pincer assemblies during machine set-up so as to obtain different types of movements based upon the point of application to the upper margin. For example, it may be desirable to cause the pincer assemblies grasping ball portions of the upper margin to travel inwardly beneath the shoe bottom to achieve a closer fit with the insole bottom edge in this region.

In accordance with yet another unique feature of the preferred embodiment, there may be provided a plurality of shank wipers, respectively movably attached to the heel wipers, for movement in the heel wiping plane to press shank portions or sides of the upper margin against the insole bottom. Preferably, these shank wipers are pivotally mounted to the heel wipers, respectively. A plurality of actuators are respectively connected to the shank wipers to pivot same into an extended position into wiping contact with the shank portions of the upper after heel wiping has occurred.

Quick disconnect means is preferably provided for respectively connecting and disconnecting the shank wipers to the heel wipers without need to remove any screw type fasteners. The quick disconnect means is structured to enable disconnect to occur when the shank wiper is rotated into a predetermined angular orientation relative to the associated heel wiper.

The lasting machine of the invention may also be provided with overhead heel hold-down support means for exerting a downward clamping force against a top surface of the footwear assembly proximate the heel portion.

The machine of this invention may also include an auxiliary insole support engageable with the insole bottom in the toe portion thereof. The purpose of the auxiliary insole support is to prevent separation of the insole bottom in the toe region from the last during lowering of the pincer assemblies and stretching of the upper. This auxiliary insole support is lowered to avoid collision with the toe wipers prior to toe wiping contact.

In accordance with still another unique feature of the preferred embodiment, there is disclosed an improvement wherein the pincer assemblies are mounted in two groups to a respective one of a pincer mounting support plate which is pivotally movable in the X-Y plane to enable the pincers to move inwardly of the insole margin and thereby initiate a tighter wrap of the upper around the last, particularly in the ball area of the shoe. In the preferred embodiment, each pincer plate is pivotally supported on the toe post assembly for movement about a pivot axis extending in the Z-direction. The resulting pivot axes are preferably coincident with corner portions of the toe pincer, respectively, so that the inward pivoting movement occurs with respect to the corners of the toe pincer.

The aforesaid pivot movement of each pincer plate is controlled by a piston and cylinder actuator wherein one end of each actuator is connected to a manual adjustment mechanism and the other extensible end is connected to an associated one of the pivot plates. In operation, the manual adjustment mechanism can be controlled to adjust the position of the associated actuator in the X-Y plane which pivotally moves the associated pincer plate for adjusting the pincer banks during machine setup to accommodate a particular shoe size. During lasting, prior to wiping, the actuators are extendable to pivot the plates and thereby the associated pincer bank in the manner described above.

Stop means is provided to limit the extent of inward rotation of each set of pincers.

As mentioned above, the aforementioned unique mechanisms of this invention may be used in combination with each other or in sub-combination in a manner that will readily occur to one of ordinary skill in the art upon review of this specification.

A method of lasting a footwear assembly including a last having an insole located at its bottom and an upper mounted thereon with an upper margin extending around the insole is also disclosed. The method comprises the steps of supporting the footwear assembly with the insole directed downwards and pressing toe portions of the upper portion against the insole bottom (to which an adhesive has been preferably and previously applied along the entire peripheral margin of the insole bottom) with a series of toe wipers advancing into toe wiping contact along a toe wiping plane. Heel portions of the upper margin are then pressed against the insole bottom with a series of heel wipers advancing into heel wiping contact along a heel wiping plane.

According to one aspect of the method of the invention, the orientation of the heel wiping plane can be adjusted during machine set-up by rotating the heel wipers about a rotational axis extending through the toe wiping plane at a point underlying the insole bottom.

According to another aspect of the method of operation, toe portions of the upper are preferably stretched by clamping same with pincer jaws and lowering the jaws so that the upper margin remains in a plane substantially perpendicular to the insole bottom. This lowering movement is preferably achieved with a double linkage mechanism in which the size of the links control the travel path of the pincer jaws relative to and including the perpendicular plane.

In accordance with another aspect of the method of the invention, prior to heel wiping, heel portions of the upper are clamped by pivoting side heel clamping pads into clamping contact with the upper. The feature of pivoting side heel clamping pads allows for improved visual observation of the heel station by the operator without the need for retracting the heel clamping pad in substantial forward movement.

Another feature of the method of the invention relates to fixing the position of the toe wiping plane before heel wiping occurs by applying an overhead hold-down member against the top of the upper and then braking the hold-down member at a fixed position.

After the toe wiping plane is fixed, the heel wipers are then elevated towards the insole bottom with sensing of the location of the heel portion and locking of the heel wipers in a fixed elevational location occurring as aforesaid.

A method of lasting a footwear assembly including a last having an insole located at its bottom and an upper mounted thereon with an upper portion extending around the insole is also disclosed. The method comprises the steps of feeding toe and ball portions of the upper margin zone into an array of open pincer jaws and then clamping the jaws shut. An insole support is then raised into contact with the insole bottom at or above the toe wiping plane. A downward clamping force is exerted against the top of the upper with an overhead hold-down. The heel wiper assembly is then raised while sensing the location of the heel portion of the insole. The heel wiper assembly is then locked to locate the heel wiper plane at a proper height relative to the insole. The heel is clamped. The upper is stretched by lowering the clamped pincer jaws. The stretched upper is then clamped and the jaws are released. The toe portion is now wiped followed by wiping of the heel portion and retracting of the assemblies to remove the lasted footwear.

The method also features the further step of raising an auxiliary support into contact with toe portions of the insole bottom prior to lowering the pincer jaws to prevent the insole bottom from separating from the last. The auxiliary support is lowered prior to toe wiping.

The insole support is lowered prior to toe wiping and then raised after toe wiping. The insole support returns to the same toe wiping plane which has been advantageously set by locking the overhead hold-down against the top of the upper.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

FIG. 10A is a top plan view of the toe and ball wiper assemblies in the profile position;

FIG. 10B is a top plan view of the toe and ball wiper assemblies in the contour or fully wiped position;

FIG. 10C is a sectional view taken along the line 10C—10C of FIG. 10B;

FIG. 10D is an elevational, partly sectional view depicting toe wiping movement;

FIG. 31 is similar to FIG. 30 with the heel and shank wipers mounted to the wiping mechanism;

FIG. 31A is an exploded top plan view, partly in section, of the heel and shank wipers and the mounting retainer therefor;

FIG. 32 is similar to FIG. 31 with the heel wipers in fully extended heel wiping position with the shank wipers in the retracted position;

FIG. 33 is a view similar to FIG. 32 with the heel and shank wipers both in fully wiped positions;

FIG. 45 is a top plan view, partly in schematic form, to depict an alternative embodiment of a toe wiper having an enlarged ball wiping region for use in connection with the improvement of the invention.

BEST MODE FOR CARRYING OUT THE INVENTION

Figure 1:
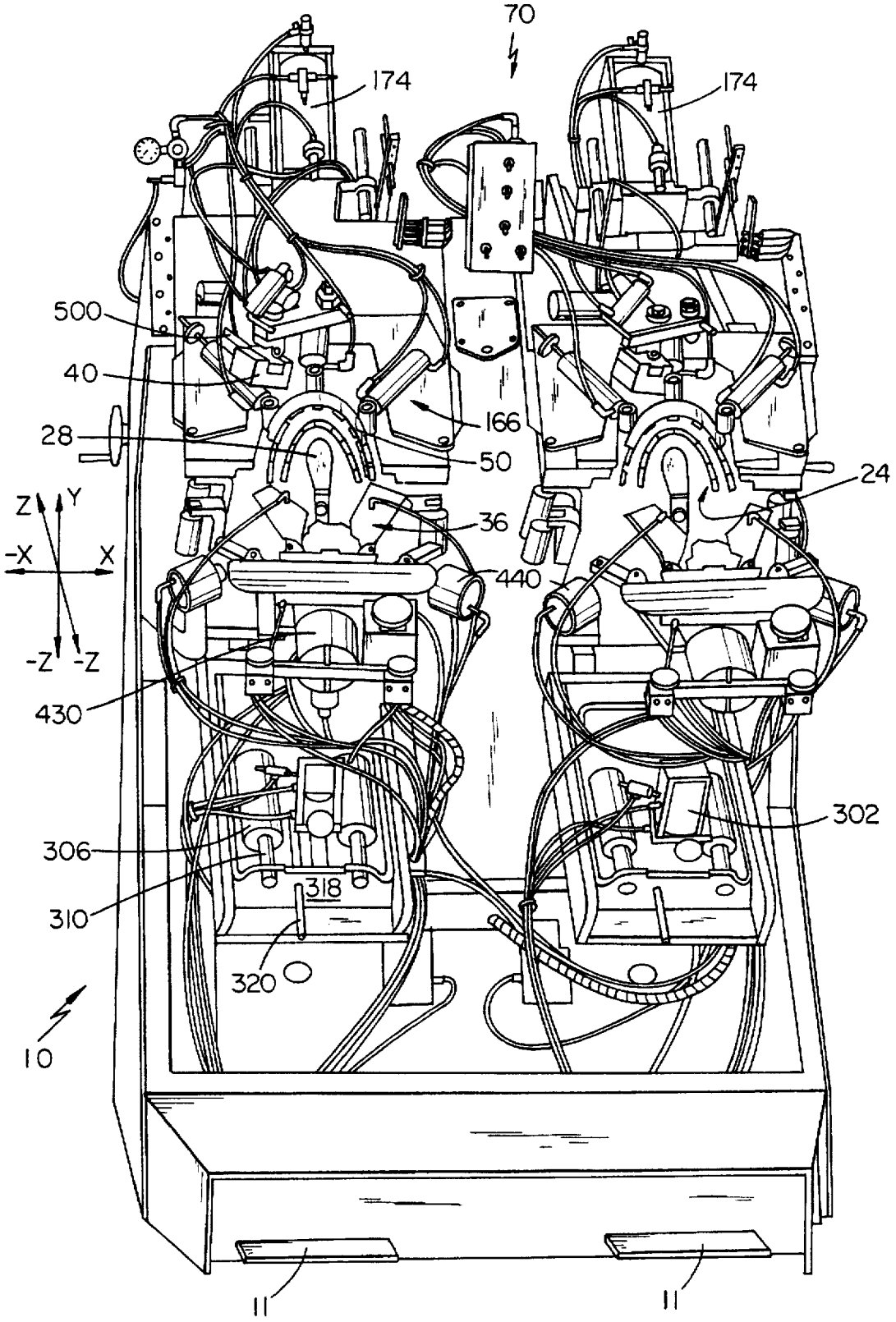
FIG. 1 is a perspective view of a toe and side and heel lasting machine constructed in accordance with a preferred embodiment of the present invention.

FIG. 1 is a perspective view of a two-station shank and heel and toe lasting machine, generally designated with reference numeral 10, for use on a footwear assembly 12 (see, e.g., FIG. 4) that includes a last 14 having an insole 16 located at its bottom and an upper 18 mounted thereon. A margin portion 20 of the upper 18, projecting from the insole 16 around the entire periphery thereof, will be pressed down within machine 10 onto a margin zone 22 (see, e.g., FIG. 11B) of the insole 16 to which adhesive material has been previously applied. This pressing action, known as wiping, is achieved through a variety of wiper assemblies that are sequentially operated and adjustable to accommodate different shoe sizes in the unique manner described more fully below.

The operator is intended to stand in front of the machine 10 in FIG. 1 looking in the plus 'y' direction. Directions extending toward the operator (i.e., minus 'y' direction), will be designated as "forward" and directions extending away from the operator will be designated as "rearward". The front of the machine where foot pedals 11 (the operation of which is discussed, infra) are located is closest to the operator and the back of the machine is furthermost from the operator. Directions extending in the plus 'z' direction will be designated as "upward" or "upper" and surfaces facing upward will be referred to as "top surfaces" or "upper surfaces." Conversely, directions extending in the minus 'z' direction will be designated as "downward" or "lower" and surfaces facing downward will be referred to as "bottom surfaces" or "lower surfaces." Directions extending in the minus 'x' direction will be designated "left" and directions extending in the plus 'x' direction will be designated "right".

OVERVIEW OF ONE STEP LASTING MACHINE

As a general overview, the machine 10 comprises a pincer array, generally designated with reference numeral 24, wherein a series of uniquely designed toe and ball pincer assemblies 26 (FIG. 5) are arranged, open jaws **100*a* and 100*b* facing up, to receive toe and ball portions of the upper margin zone 20, the insole bottom 16 facing down. The pincer jaws 100*a*,100*b* are clamped shut in a controlled sequence described below, and an insole support 28, positioned atop a toe post assembly 30 (FIG. 4), is raised to contact the insole bottom 16 and elevate the same slightly upwardly at or above (e.g., 4 mm) the toe wiping plane 32, thereby stretching the upper 18. An overhead hold-down assembly 40 (FIGS. 11A and 11B) is then cylinder actuated to exert a downward clamping force against a top surface of the upper 18. At this point, the heel clamping pad assembly 36 moves to its presentation position described below. A heel position sensor 33 (see, e.g., FIG. 16) is then raised, together with a heel and shank wiper assembly 34 (FIGS. 24–33) and the unique three part heel clamping pad assembly 36 (FIGS. 20–23), in order to contact the insole bottom 16 in the vicinity of the heel area. This establishes the heel wiping plane 38. The three-part heel clamping pad 36 is then cylinder actuated to move rearwardly into tight clamping contact (FIG. 23) with heel portions of the upper 18. The correctly positioned pad 36 enables the bottom surfaces 37 of each clamping pad element 36*a*, 36*b* and 36*c*** to be wrapped tightly along the instep line, level therewith, to give a nice sharp edge for good heel wiping.

Once the heel is locked into place with the pad assembly 36, the pincer assemblies 26 are lowered (FIGS. 6A and 6B) to fully stretch the upper 18. An auxiliary insole support 39 (FIG. 4), attached to toe post assembly 30, is raised with the insole support 28 into contact with the insole bottom 16 between the insole support 28 and the forwardmost toe portion of the insole, just prior to the aforesaid lowering movement of pincer assemblies 26. This auxiliary support prevents the tip **16*a* of the insole 16 from dropping below the wiper plane 32 tending to be caused by the upper 18 dragging of the insole tip downwardly below the wiper plane as the upper 18 is being pulled and stretched by the pincers 26**.

Figure 2:
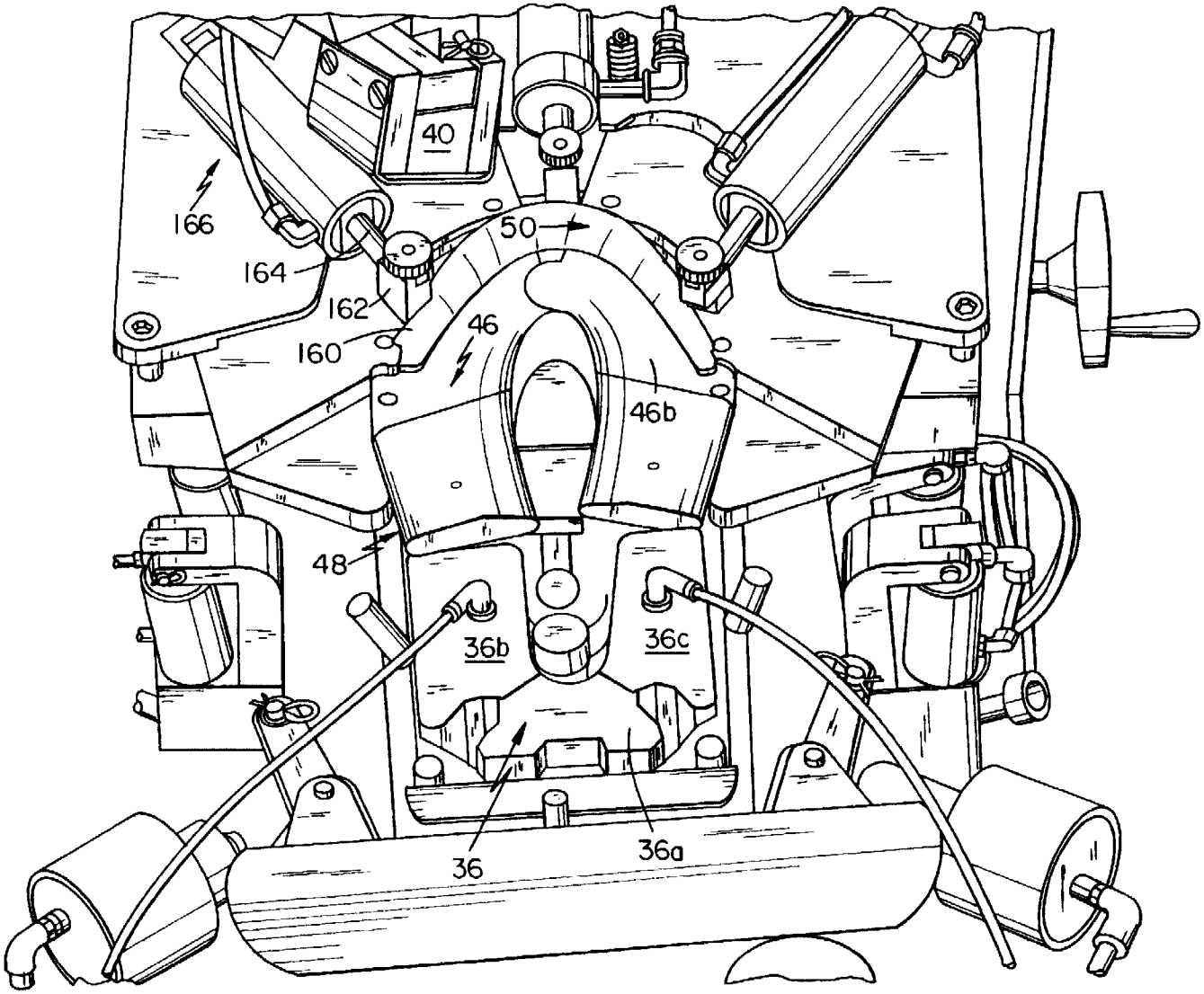
FIG. 2 is an enlarged perspective view depicting the toe and ball wiper assembly in a fully extended toe and ball wiping position.

At this point, a series of cam controlled toe and ball wiping elements 46 (FIG. 2) of a toe and ball wiper assembly 48 are cylinder actuated to move forwardly into a profile position (FIG. 10A), whereby the wiping edges **46*a* come up to the periphery of the insole bottom 16 and stop. A cylinder actuated band 50 of known construction now moves forwardly to wrap around the toe portions 18*a* of the upper 18. Band 50 exerts sufficient clamping force to maintain the upper 18 in stretched condition over the last 14 when the pincers 26 are released from the upper margin portions 20. Once released, the toe wipers 46 (i.e., the top surfaces 46*b* thereof) travel along toe wiping plane 32 as the insole support 28 and auxiliary insole support 39 drop. The toe wipers 46 continue to travel inward in an unobstructed manner toward their fully wiped positions 52 (FIGS. 7 and 10B) to ensure that the toe and ball areas of upper margin 20 are firmly pressed against corresponding adhesive margin areas of insole margin zone 22. After a sufficient bedding time, a unique braking mechanism 42 is actuated to lock the hold-down 40 in position to ensure that the insole bottom 16 is always correctly leveled in relation to the toe wiping plane 32**.

As the wipers 46 retract, the toe post 30 is again raised to restore insole support 28 into supporting contact against the insole bottom 16. With the feature of hold-down 40 in a fixed, braked location, it will be appreciated that insole support 28 is returned to its original raised position within wiping plane 32.

With the toe and ball regions now fully wiped, the heel wiper assembly 34 is cylinder actuated to advance a pair of heel wipers 54 along a cam track plate 56 so that the heel portions of upper 18 are wiped first onto the insole heel bottom 16. A pair of shank wipers 58, respectively pivotally secured to the heel wipers 54, are then cylinder actuated to wipe the shank portions of upper 18 with the insole support 28 dropping just before the shank wipers can come into contact therewith. Since the hold-down 40 is in its braked, hold-down position at all times during toe and ball, and shank and heel wiping, positive lasting pressure is maintained against the wiping pressures to ensure a good wipe.

Once the shank and heel portions of upper 18 have been wiped, the various assemblies described hereinabove are sequentially retracted in reverse order.

As will be discussed more fully below, an important and highly preferred feature of this invention relates to the adjustment of the heel and shank wiper assembly 34 to accommodate lasting of shoes of different sizes. In the preferred embodiment, the heel wiper plane of movement 38 of the heel and shank wiper assembly 34 is rotationally adjusted, whenever a shoe of a different size is to be lasted, via movement along a set of concentric cam tracks 60,62 (see, e.g., FIG. 19) which enables the heel wiper assembly to rotate about a rotational axis 64 located at the intersection of the toe wiping plane 32 with the heel wiping plane 38, i.e., proximate the ball region of the shoe to be lasted, and extending perpendicular to the heel axis 66. By locating the aforementioned axis 64 approximately or at the intersection of the toe and heel wiping planes 32,38, the heel and shank wipers 54,58 can be adjusted to define and travel within the heel wiping plane 38, which closely approximates the location of the heel bottom, irrespective of shoe size, to ensure a good wipe.

Figure 34A:
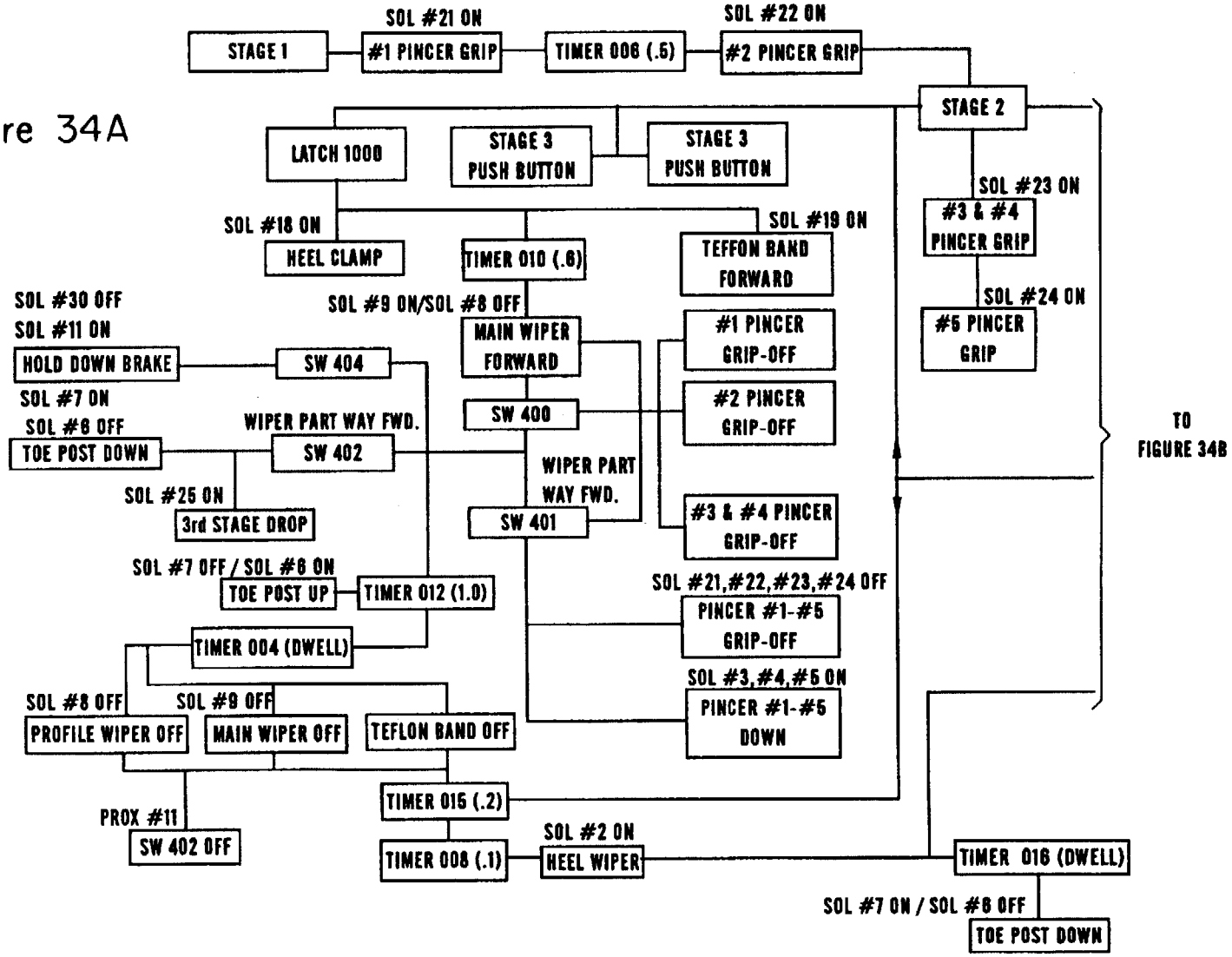
FIG. 34 is a cycle chart depicting the process control steps for operation of the machine of the preferred embodiment.
Figure 34B:
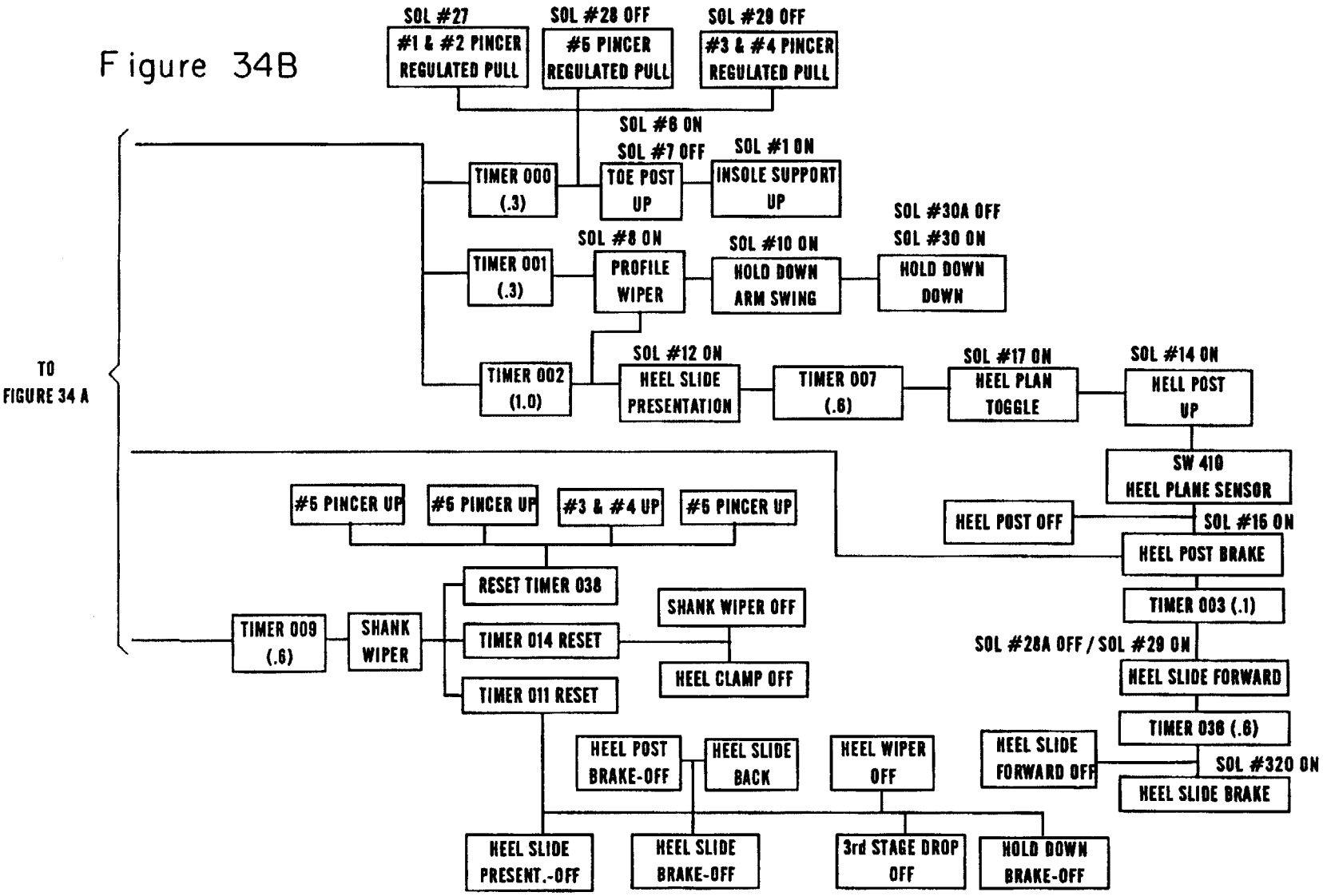

The aforementioned loading of the upper draped last 14 into the machine 10 is preferably controlled by the two-stage operator foot pedal 11. Preferably, for safety reasons, the operator must first press the two palm buttons (not shown in detail) in the control panel 70 of FIG. 1 to initiate the automatic cycle. The operator control panel 70 allows the operator to select various set-up configurations described, infra. The automatic cycle is operated by a programmable controller 72 that sequences the machine 10 under program control in accordance with the cycle or program control chart set forth in FIG. 34.

Figure 35A:
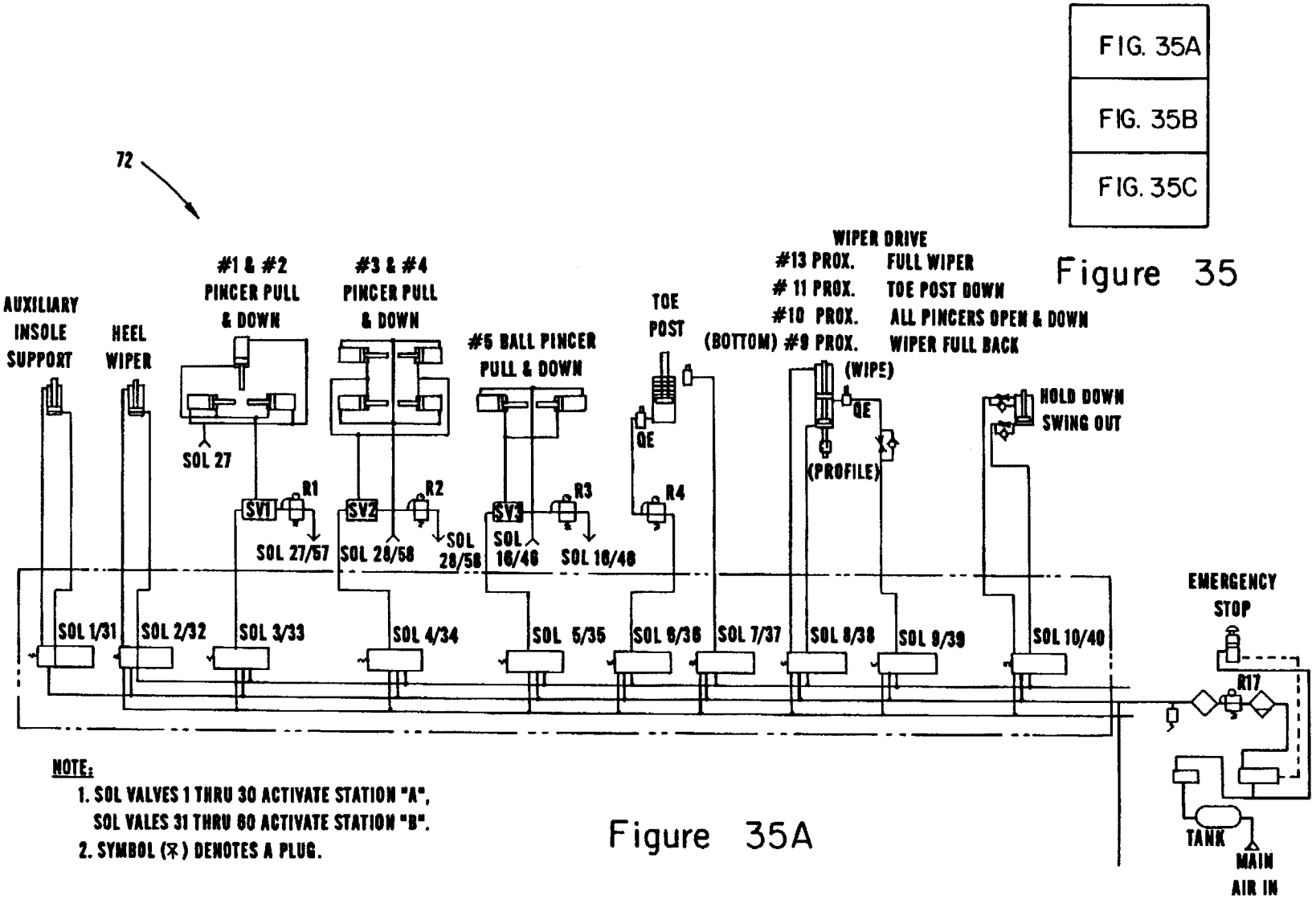
FIG. 35 is an air diagram depicting the relative connections between the mechanisms of the machine and their associated solenoids and programmable controller therefor.
Figure 35B:
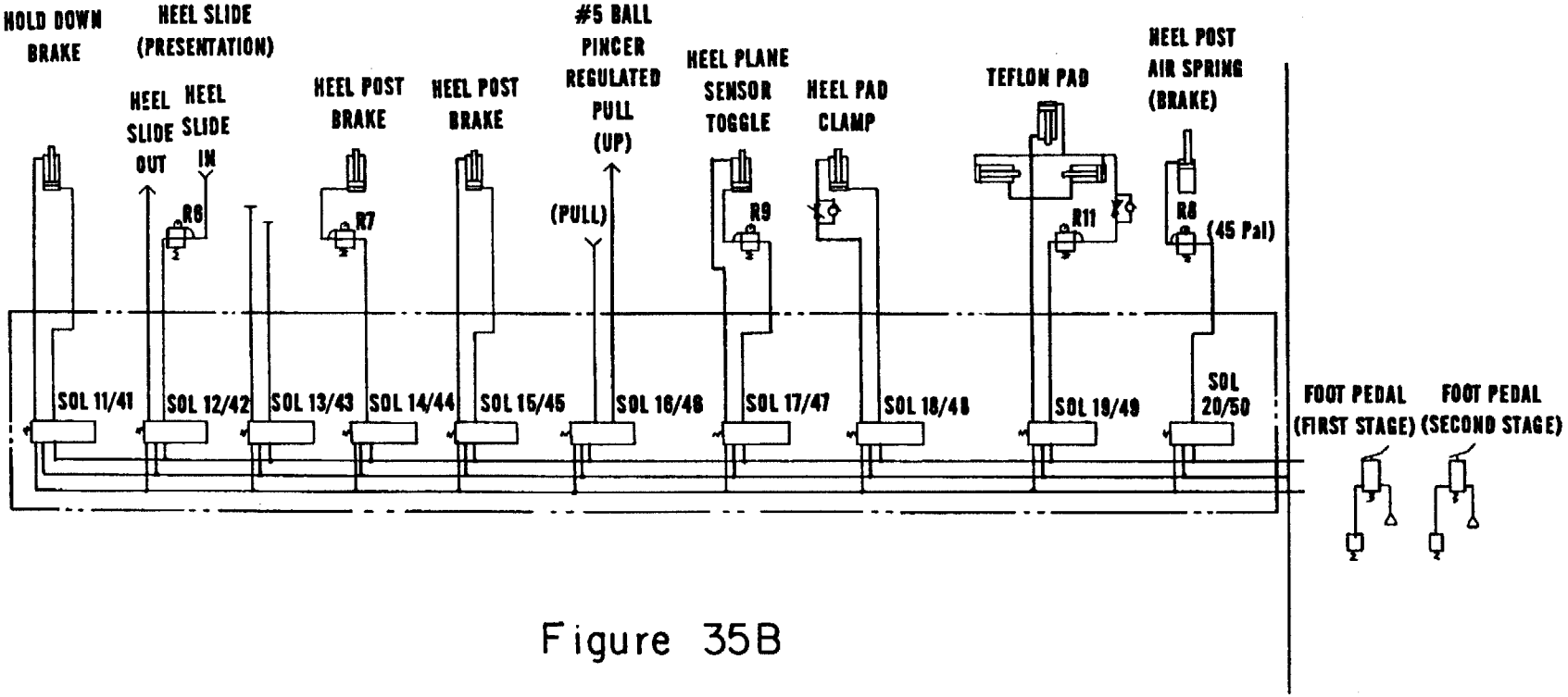
Figure 35C:
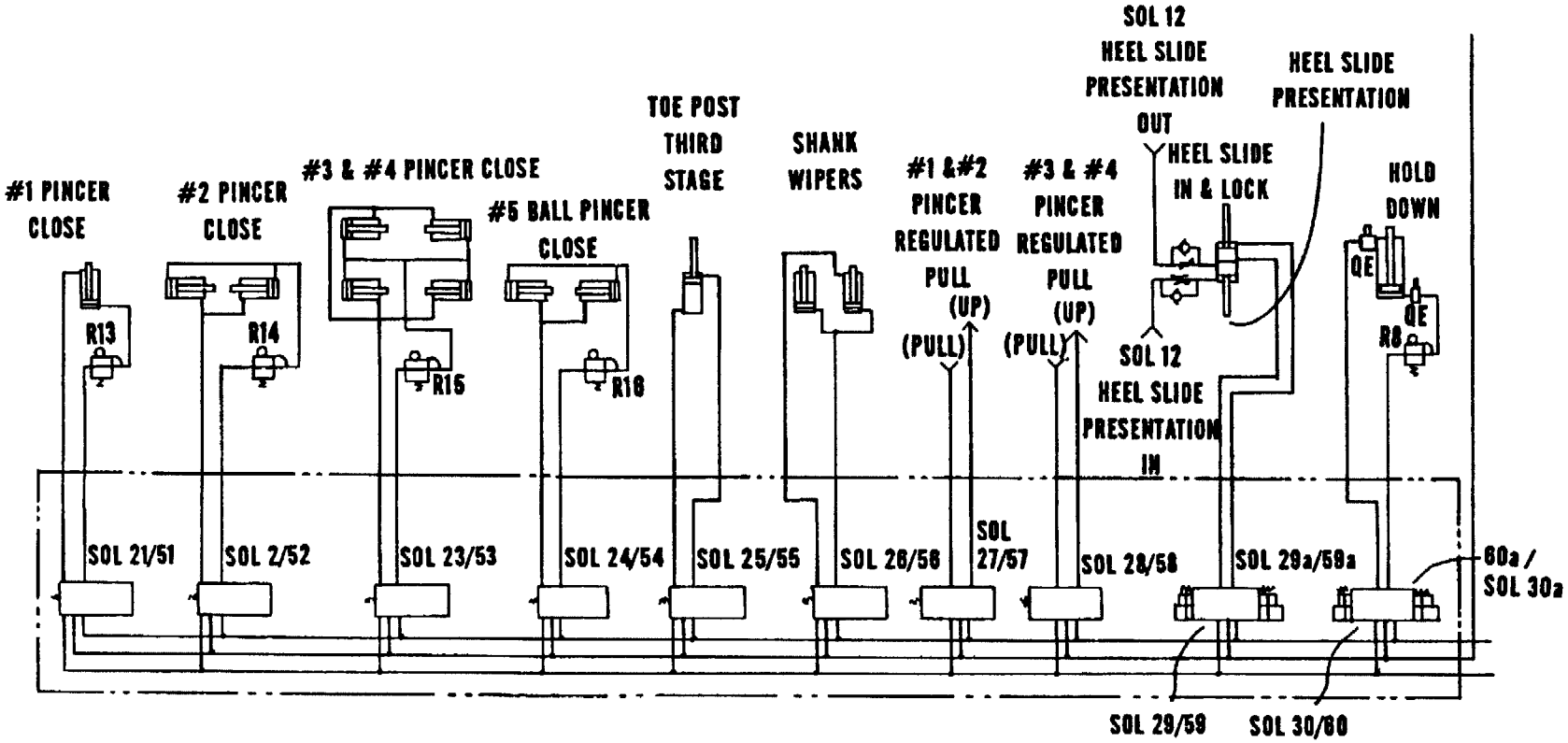

Proximity sensors and switches are used to provide inputs to the programmable controller 72 and the outputs consist of control relays and solenoid valves operated to control pressurized air flow to the cylinders described in detail below which in turn actuate the mechanisms of the machine 10. FIG. 35 is a detailed air circuit diagram depicting the manner in which the respective solenoid valves are connected to actuate the individual machine mechanisms through the cylinders. In the preferred embodiment, there are approximately thirty solenoid valves for each of the two stations of machine 10. The stations may be configured to respectively last left and right shoes, or may be configured with identical assemblies to last either left or right shoes at both stations.

Unique features of this invention will be more fully appreciated through a detailed description of each aforementioned assembly and its interaction thereof with the other assemblies.

TOE AND BALL PINCER ASSEMBLY

Figure 3:
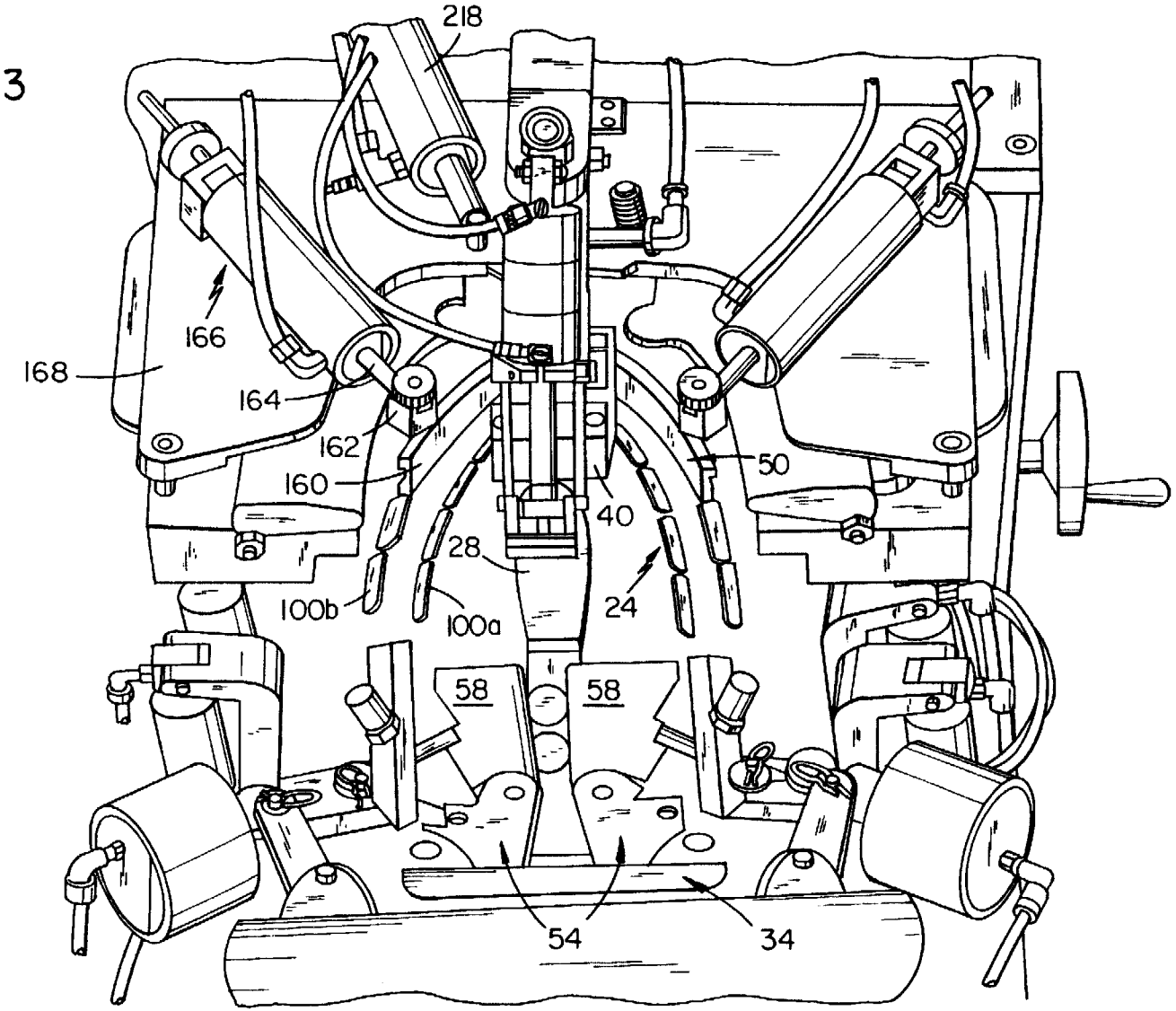
FIG. 3 is an enlarged perspective view depicting the overhead toe hold-down in operating position and the heel and shank wipers in fully extended heel and shank wiping positions.
Figure 5:
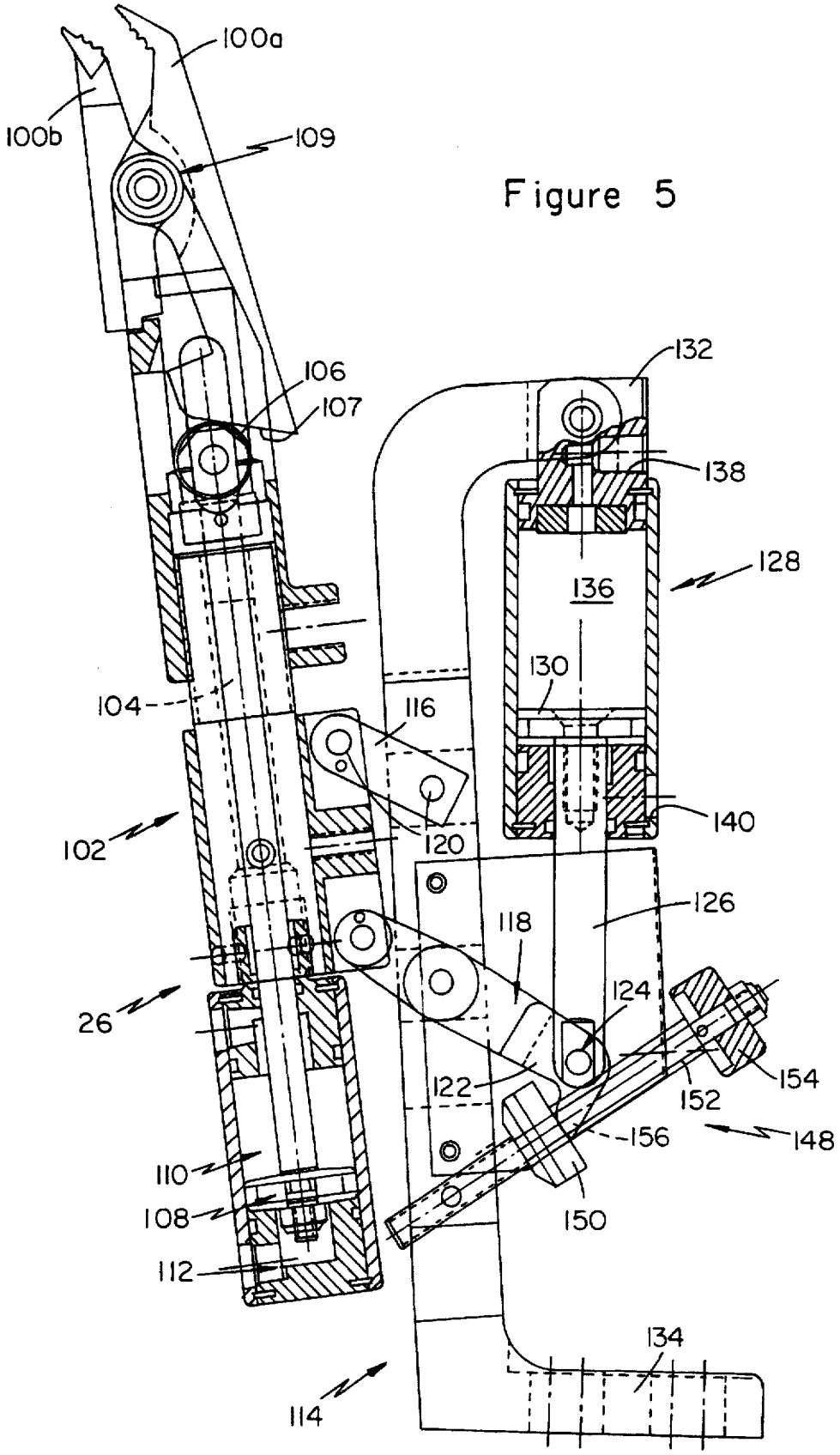
FIG. 5 is a scaled sectional view of a pincer assembly in accordance with the preferred embodiment.

The pincer assemblies 26, arranged in the peripheral array 24 (FIGS. 1 and 3) around the toe and ball regions of the upper 18, are each comprised of fixed clamping jaw 100*a* and movable clamping jaw 100*b* mounted to the upper end of an elongate tubular body 102 as best depicted in FIG. 5. A piston rod 104 extends through body 102 and has a cam roller 106 and a piston 108 respectively mounted to upper and lower ends thereof. Cam roller 106 is in contact with a cam follower surface 107 formed at the lower end of movable clamping jaw 100*b* and below a pivot 109 securing the movable jaw to the fixed jaw. Piston 106 is disposed with a chamber 110 formed in the lower end of body 102 and is driven upwardly under the action of pressurized air entering the lower working end of the chamber through an inlet 112. Upward lifting movement of the piston 108 raises cam roller 106 through piston rod 104 to pivot movable clamping jaw 100*b* into closed clamping contact with fixed jaw 100*a* (see FIGS. 6A and 6B).

In the preferred embodiment, up to eleven pincer assemblies 26 (only nine shown in FIG. 1) are preferably mounted to receive toe and ball portions of upper margin 20. The operator slides the upper 18 stock into the open jaws 100*a*,100*b* of one to three of the center pincers and then presses on the foot pedal 11 to close the jaws of these pincers. The operator then feeds the stock into the remaining pincers and steps down to cause foot pedal 11 to travel to its second stage whereupon all the pincers are now closed.

Still reference to FIG. 5, each pincer body 102 is interconnected to a stationary support bracket 114 through a pair of upper and lower links 116 and 118 which may be air cylinder driven to move the pincer 26 between its upper and lower positions. The upper or driven link 116 is connected at opposite ends thereof to the pincer body 102 and support bracket 114 through a pair of pivot pins 120. The lower or drive link 118, also connected to the pincer body 102 and support bracket 114 at positions spaced below the corresponding points of attachment of the upper link 116, further includes an actuating end portion 122 which is pivotally secured through a pinned and slotted interconnection 124 with the lower distal end of a piston rod 126 of a drive cylinder 128 used to raise and lower the associated pincer. This piston rod 126 projects downward from a piston 130 located in the piston cylinder 128. The cylinder 128 is pivotally mounted at a top end thereof to an uppermost portion 132 of the support bracket 114. The lower end 134 of the support bracket 114 is formed with a base portion that is screwed or otherwise firmly attached to the stationary machine base of lasting machine 10.

The drive piston 130 is disposed within a chamber 136 formed in the cylinder body 128 and is normally maintained in its lower position (depicted in FIG. 5) under the action of pressurized air entering the upper end of the chamber through an inlet 138. In this position, pincer jaws 100*a*,100*b* are both open and raised to receive stock. Once the upper 18 stock has been properly fed into the pincer jaws 100*a*,100*b* which are then clamped shut, and once insole support 28 has been elevated to raise the insole bottom 16 to a controlled position at or slightly above the wiping plane 32 (see FIG. 4), pressurized air is then fed through a lower inlet 140 formed in the lower end of the drive cylinder body 128, lifting the piston 130 and thereby the piston rod 126. This lifting movement in turn elevates the actuating portion 122 of the lower link 118 which causes the upper and lower links to pivot counter-clockwise, lowering the clamped pincer jaws 100*a*,100*b* to thereby stretch the upper 18 against the counterpressure of insole support 28. After upper 18 has been fully wiped, the piston rod 126 is extended to return the pincer jaws 100*a*,100*b* to their raised position by pressurized air entering the chamber 136 through the upper inlet 138.

In accordance with a unique feature of this invention, the upper and lower links 116,118 may be appropriately dimensioned to enable the clamped jaws 100*a*,100*b* to travel along a desired and predetermined travel path as the pincer 26 is lowered to stretch the upper 18. For example, in FIG. 6A, the upper and lower links 116,118 are suitably dimensioned during machine set-up so that the clamped pincer jaws 100*a*,100*b* travel inwardly from the edge of the insole 16, i.e., inwardly from a vertical plane 142 extending through the edge of the insole bottom, to establish an inward pulling movement against the upper margin portion 20. This travel path underneath the insole is identified by reference numeral 144.

Figure 6B:
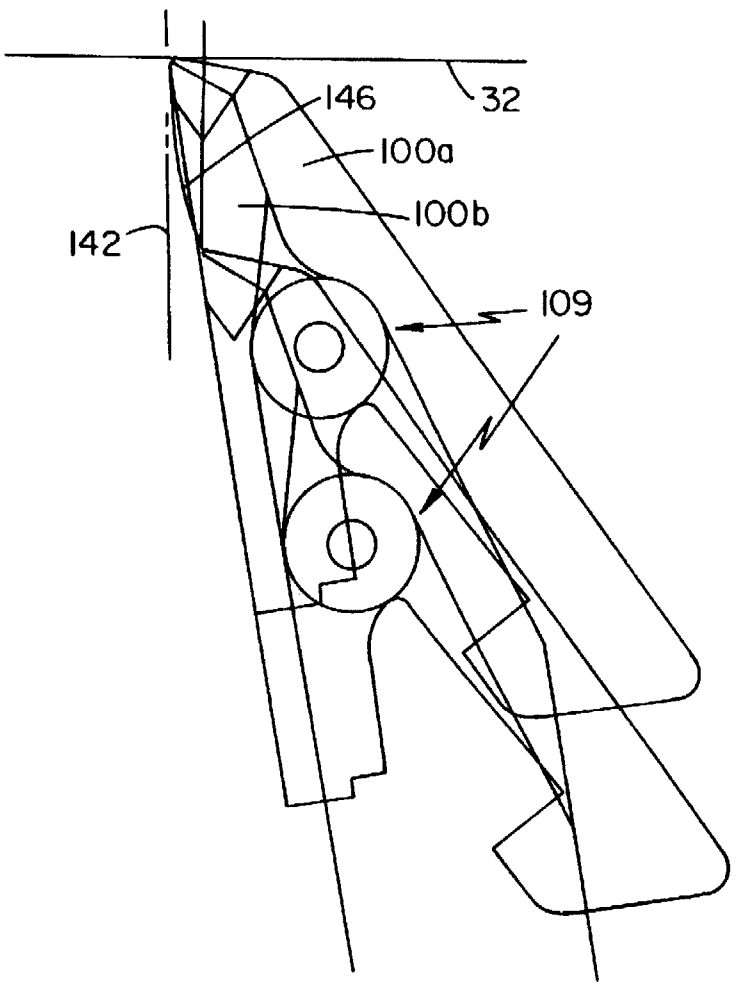
FIGS. 6A and 6B are enlarged sectional views of pincer clamping jaws and two types of traveling movement achieved thereby to stretch the upper.
Figure 6A:
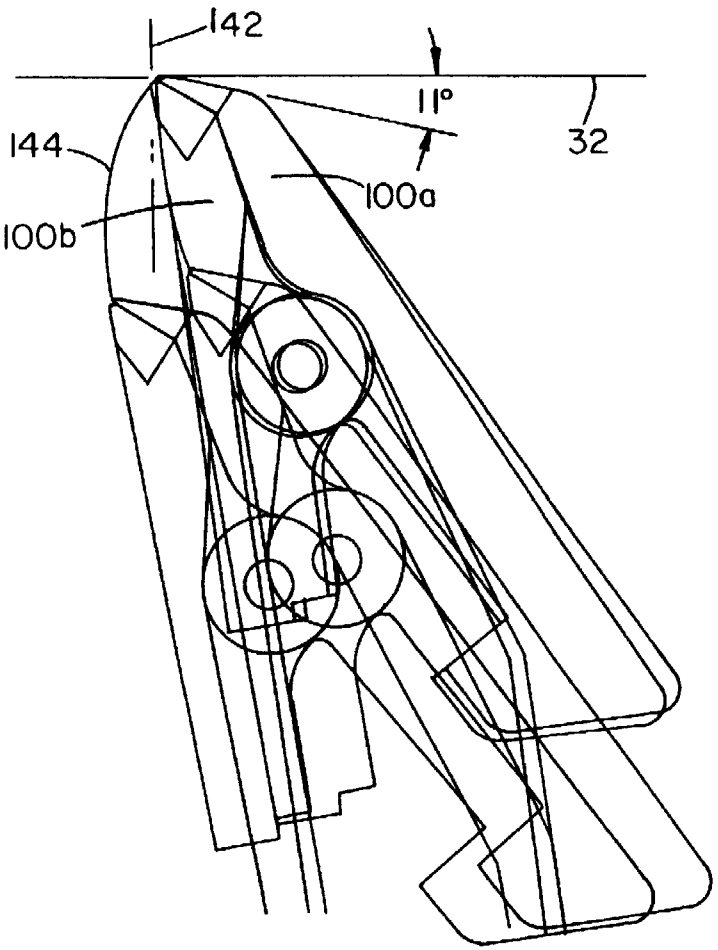

In FIG. 6B, the upper and lower links 116,118 are suitably dimensioned during set-up so that the clamped pincer jaws 100*a*,100*b* travel downwardly and either remain in generally vertical plane 142 or travel outwardly from the insole edge along path 146.

The feature of controlling vertical movement of pincers 26 through the aforementioned double link mechanism 116,118 advantageously allows for regulation of the manner in which the toe and ball portions of the upper margin portion 20 are stretched by suitably varying the link size during machine set-up. It will now be further appreciated that the double link mechanisms of selected ones of the pincer assemblies 26 (e.g., those pincer assemblies pulling in the ball or shank regions of the upper 18) may be selected to impart an inward pulling movement (e.g., FIG. 6A) during upper stretching while others of the pincer assemblies 26 (e.g., those pulling in the toe regions in the upper) may have link mechanisms selected to impart a straight line movement to the upper so that the upper is stretched in a vertical plane 142 extending through the insole bottom edge, or remains outward from the edge along path 146. This feature can be incorporated into other machines, such as toe lasting machines.

Each pincer assembly 26 further includes a height adjustment mechanism 148 to controllably adjust the raised, starting point height of the pincer jaws 100*a*,100*b* during machine set-up. The height adjustment mechanism 148 features a stop member 150 adapted to travel along a threaded screw 152 to which it is mounted, upon rotation of a knurled screw head 154 located at the upper end of the screw. The actuating portion 122 of the second link 118 includes a downwardly extending distal end 156 which is engageable with the stop member 150 in the extended position of the piston rod 126 (i.e., raised position of the pincer jaws) before the piston rod reaches its end of stroke position. The slotted interconnection 124 between the second link 118 and piston rod 126 enables the stop portion 156 of the second link to bottom against the pre-set stop member 150 as the piston rod extends.

TOE CLAMPING BAND

Once the upper 18 has been fully stretched against the counterpressure of the raised insole support 28, and before the toe wipers 46 travel from their profile position (FIG. 10A) into the fully wiped position (FIGS. 7 and 10B), toe clamping band 50 is first cylinder actuated to exert toe clamping force against the upper before the pincer jaws 100*a*,100*b* are unclamped. Toe clamping band 50 is known in the art, such as disclosed in U.S. Pat. No. 4,490,868 to Michael Becka, assigned to International Shoe Machine Corporation, Nashua, N.H. the assignee of the present invention, or preferably as disclosed in applicant's copending application Ser. No. 08/190,963, filed Feb. 3, 1994, entitled "Composite Band for Use in a Footwear Forming Machine", also assigned to the assignee of the present invention. FIG. 1 of the '963 application together with its corresponding disclosure, and the '868 patent are both incorporated by reference herein. Briefly, however, the toe clamping band 50 comprises a flexible, preferably resinous material shoe engaging strip 160 having a curved portion to wrap around the toe of the shoe during lasting. The strip 160 is preferably connected via quick disconnect mechanisms 162 to the cylindrical piston rod 164 of an associated piston assembly 166 pivotally mounted to the stationary machine frame 168. In the closed or clamping position depicted in FIG. 2, the piston rods 164 are extended so that the flexible band 50 is urged into tightly wrapped contact with the upper 18 by conforming to the shape of the footwear in the toe region.

TOE AND BALL WIPER ASSEMBLY

Toe and ball wiper assembly 48 is comprised of a pair of toe and ball wipers 46 which are cylinder actuated and cam controlled to fully wipe the toe and ball regions of upper margin portion 20 as mentioned briefly above. It is the top surfaces 46*b* of wipers 46 that define wiping plane 32 and provide a toe height datum relative to which the raised starting positions of the pincer assemblies 26 and insole support 28 are adjusted.

Figure 7:
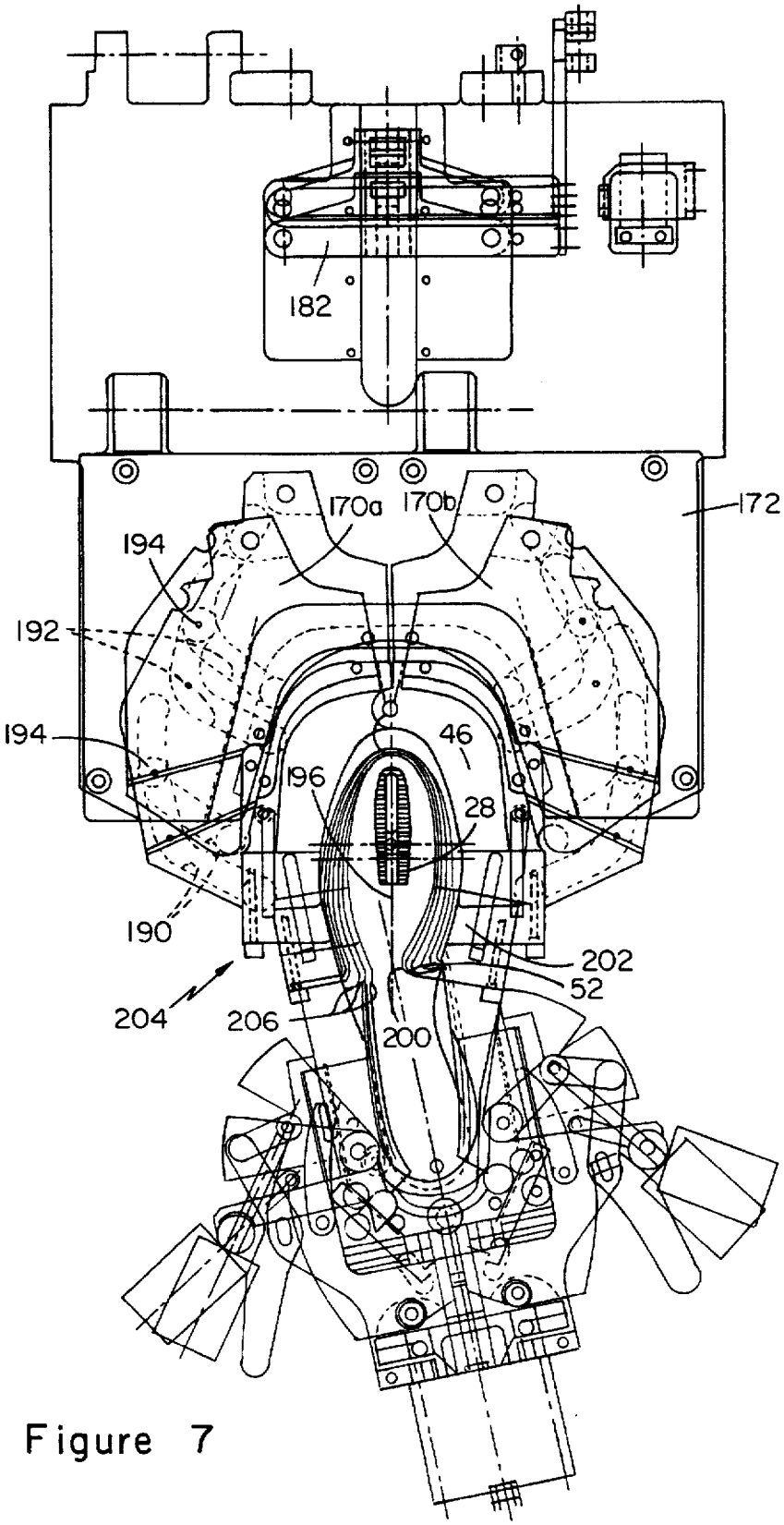
FIG. 7 is a scaled top plan view depicting the relative positions of the heel and shank as well as the toe wipers through sequential stages of wiping movement.
Figure 8:
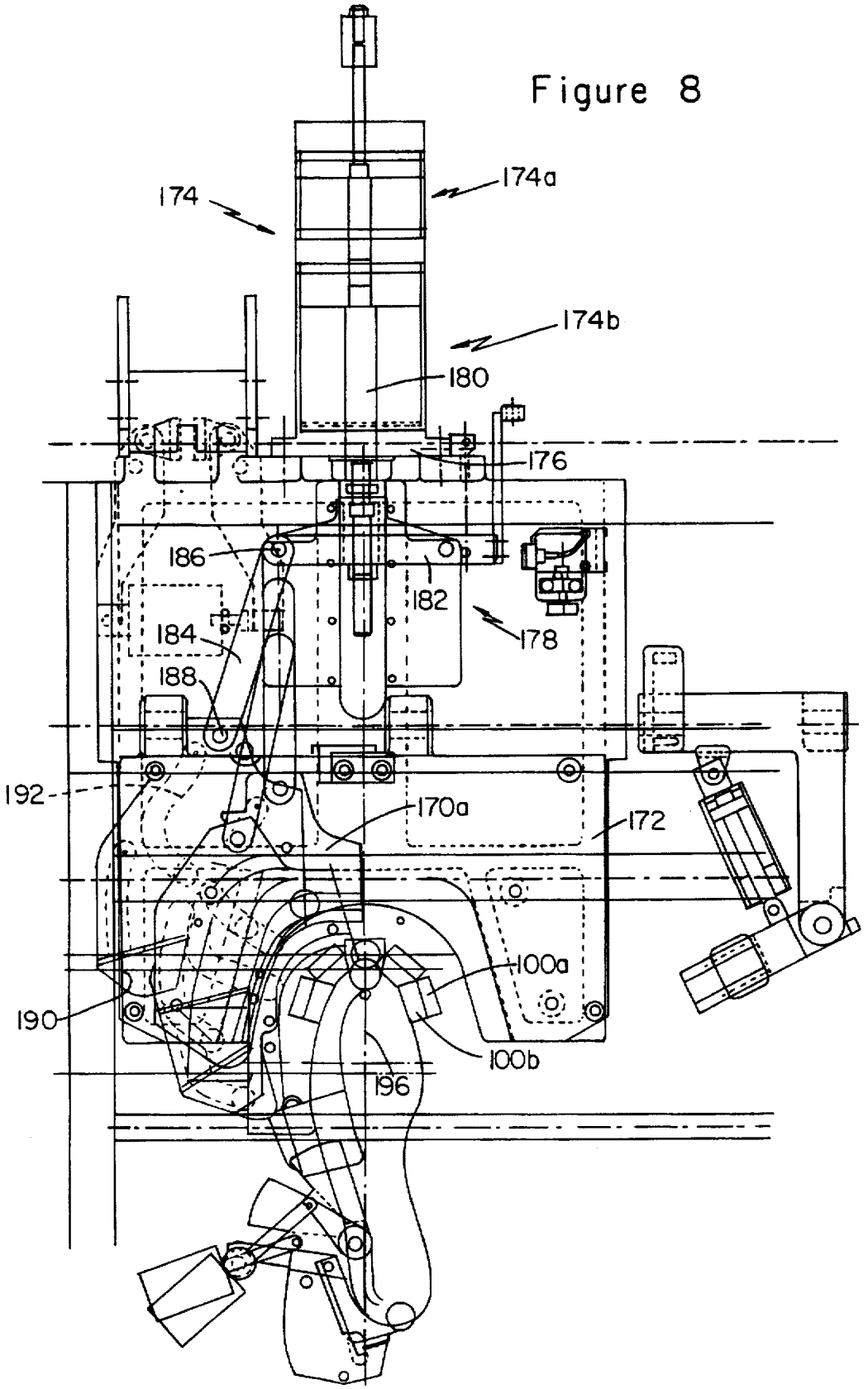
FIG. 8 is a scaled top view somewhat similar to FIG. 7 to depict other aspects of the toe wiping mechanism.
Figure 9C:
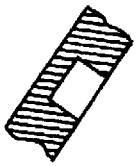
FIG. 9C is a sectional view taken along the line 9C—9C of FIG. 9A.
Figure 9A:
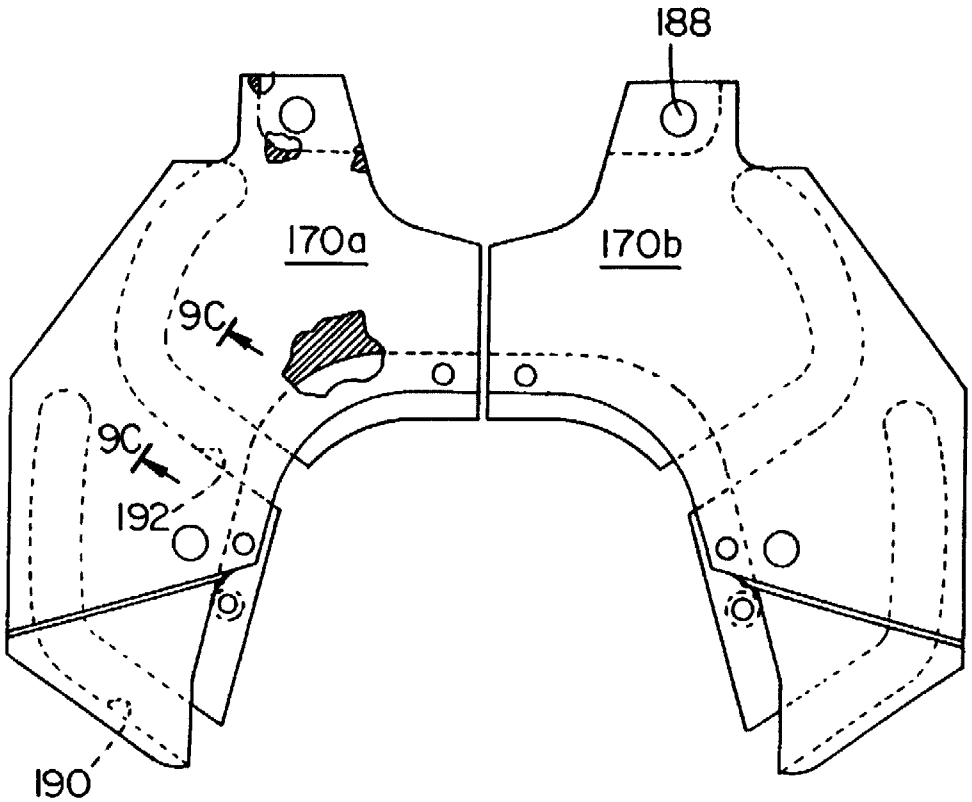
FIG. 9A is a scaled top plan view of the toe wiper cams of the invention.
Figure 9B:
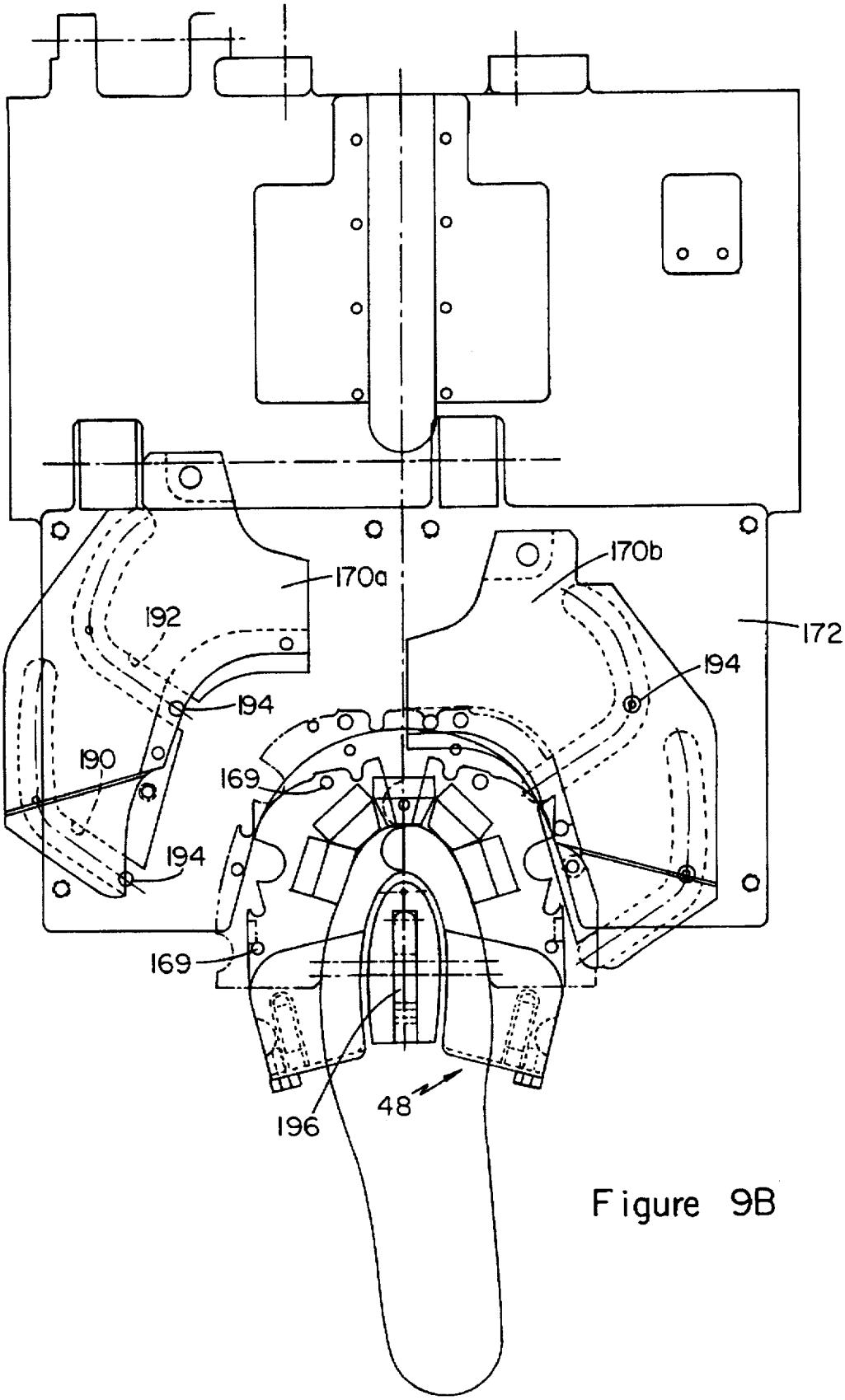
FIG. 9B is a top plan view depicting the relative locations of the pincer assemblies and the toe wipers.

With reference to FIGS. 7–10, wipers 46 are respectively mounted with quick disconnect pins 169 to a pair of wiper cams 170*a* and 170*b*, each slidably mounted to a stationary cam track plate 172 extending parallel to wiper plane 32. As best depicted in FIGS. 1 and 8, a two-stage air cylinder 174, stationarily mounted to a machine frame 176 is interconnected to an actuating assembly 178 which is constrained to move in the plane of the wiper cams 170*a*,170*b* as a result of the forward extension and rearward retraction of the piston rod 180 extending forwardly of the rear mounted cylinder 174. More specifically, actuating assembly 178 includes the front end of the piston rod 180 connected to a drive yoke 182 having a pair of left and right arms to which the rear ends of a pair of identical left and right links 184 (only left one shown in FIG. 8) are pinned at 186 for pivotal movement in the plane of the toe wiper cams. The front ends of the drive links 184 are in turn respectively pinned at 188 to rearwardly extending portions of the wiper cam 170*a* or 170*b*. Each wiper cam 170*a*,170*b* includes a pair of front and rear cam tracks 190 and 192 milled in the bottom surface of the wiper cam and which receives a fixed cam follower bearing 194 projecting upwardly from the top surface of the cam track plate 172. Therefore, as the pair of wiper cams 170*a*,170*b* are driven forwardly under the action of the drive cylinder 174, the relative positions of the wipers 46, respectively mounted to the front edges of the associated wiper cam 170*a* or 170*b*, will be controllably positioned in a desired relationship with one another and the toe and ball portions of the insole bottom edge as the stationary cam track bearing 194 move along the respective cam track slot 190,192 under the action of the advancing wiper cams.

FIGS. 10A and 10B are respective illustrations of the toe and ball wipers 46 in the 'profile' position and the 'contour' position. By appropriate signals to the control solenoid (FIG.

35) operating the two-stage drive cylinder 174, pressurized air is supplied to the first stage profile cylinder 174a to partially advance the wiper cams 170a,170b and thereby wipers 46 under the advancing action of the drive yoke 182 and drive link arrangement 184. The wiping edges 46a are advanced along the longitudinal axis 196 of the toe area up to the edge of the insole bottom 16 and then stop as the profile cylinder 174a reaches its end of stroke position. This enables the toe clamping band 50 to clamp against the toe portions of upper 18 as discussed above. The pincer assemblies 26 are then controlled to release the upper 18. By further appropriate signals, a control solenoid valve (FIG. 35) now supplies pressurized air to the second stage wiping cylinder 174b so that the toe and ball wipers 46 are driven forwardly by the wiper cams 170a,170b from the profile position of FIG. 10A into the fully wiped contour position of FIG. 10B.

FIG. 7 depicts the toe and ball wiping edges 46a in a series of sequential views as the wipers 46 move from the profile position to the contour position. The innermost extent of wiping is identified with reference numeral 200. It will be understood by one of ordinary skill in the art that these relative positions are controlled by the size and shape of the cam tracks 190,192.

Each of the toe and ball wipers 46, with particular reference to FIGS. 10A and 10B, are comprised of a main wiper formed with wiping edge 46a having a cross-sectional profile such as depicted in FIG. 10C. Optionally, a pair of wiper spoons 202 may be respectively attached to forward portions of the main wipers 46, particularly when larger shoe sizes (e.g., sizes 8 and greater) are being lasted. Each spoon 202 may be connected to its associated main wiper 46 through a dovetail slide interconnection (not shown in detail) permitting forward and rearward movement of the spoon generally along the toe axis 196. A manual screw adjustment, generally designated with reference numeral 204, is used to regulate the forwardmost position of each spoon 202 so as to adjust the length of wipe particularly on larger size shoes.

To enable the wipers 46 (or spoons 202 when used) to fully wipe the ball portion of upper 18 after the toe portions have been wiped, the rear half of each wiper cam slot is considerably curved so that the primary wiping movement as the wipers travel forwardly into the contour position is essentially a rotational or pivotal movement so that the wiper edges primary move perpendicular to the insole bottom edge. These final movement stages are depicted with reference lines 206 in FIG. 7, terminating at position 200.

OVERHEAD HOLD-DOWN TOE SUPPORT

Figure 11A:
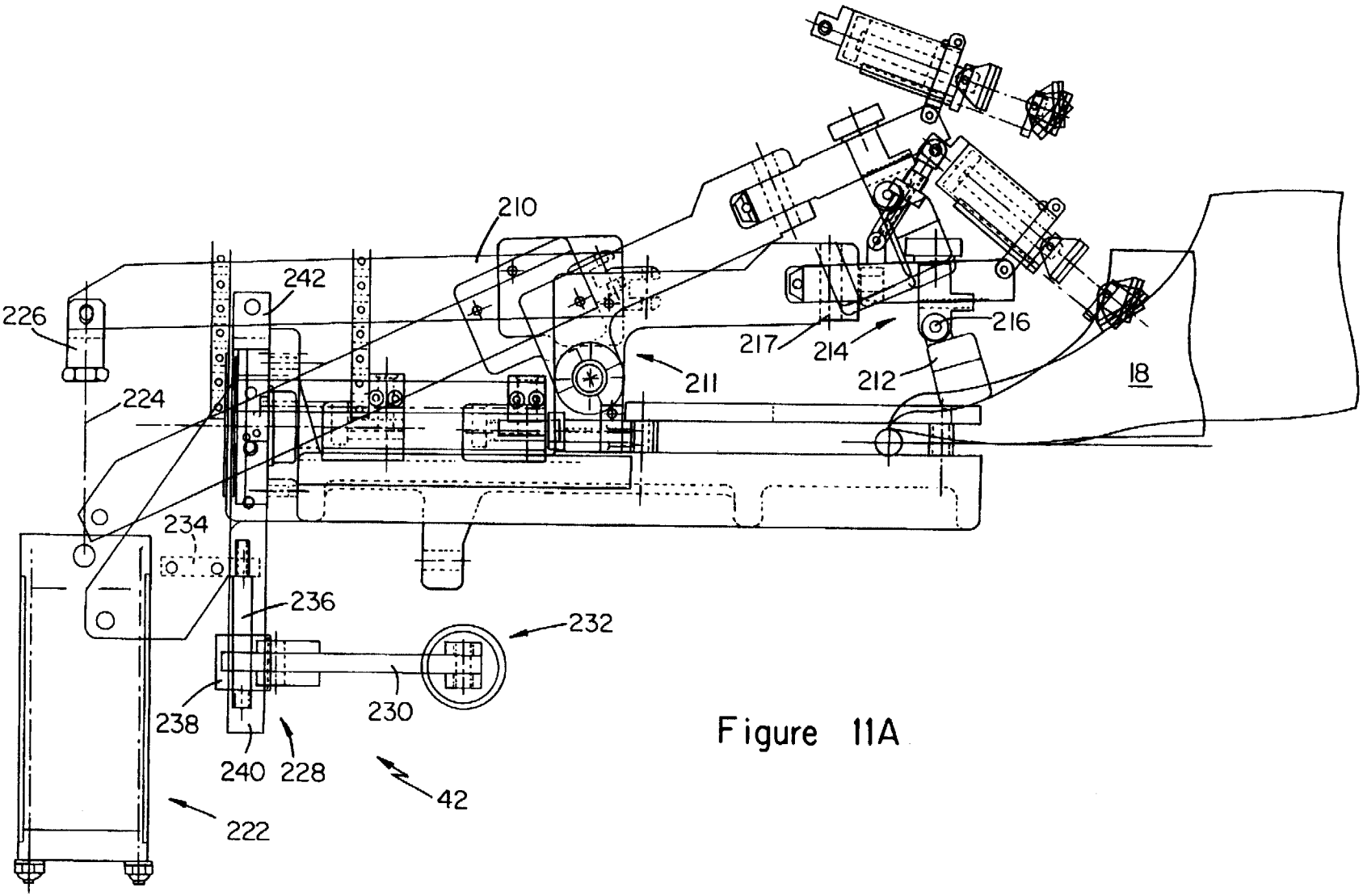
FIG. 11A is a scaled partly elevational and partly sectional view of an overhead toe hold-down assembly in clamped and unclamped positions.

FIG. 11A is an illustration of overhead hold-down assembly 40 in unclamped and clamped positions for exerting a downward clamping force against a top surface of upper 18. Overhead hold-down assembly 40 comprises a hold-down lever 210 that is pivotally interconnected at an intermediate portion 211 thereof to the machine frame for movement in a vertical plane. A hold-down clamp member 212 is connected to the forward end of hold-down lever 210 through a mounting assembly 214 permitting the hold-down member to pivot about a horizontal axis 216 so as to make proper contact with the top portion of upper 18 during machine set-up to last a particular size shoe. The hold-down clamp mounting assembly 214 is pivotally mounted at a rear end thereof to the front end of hold-down lever 210 along an axis 217 extending perpendicular to the longitudinal axis of the hold-down lever.

Figure 11B:
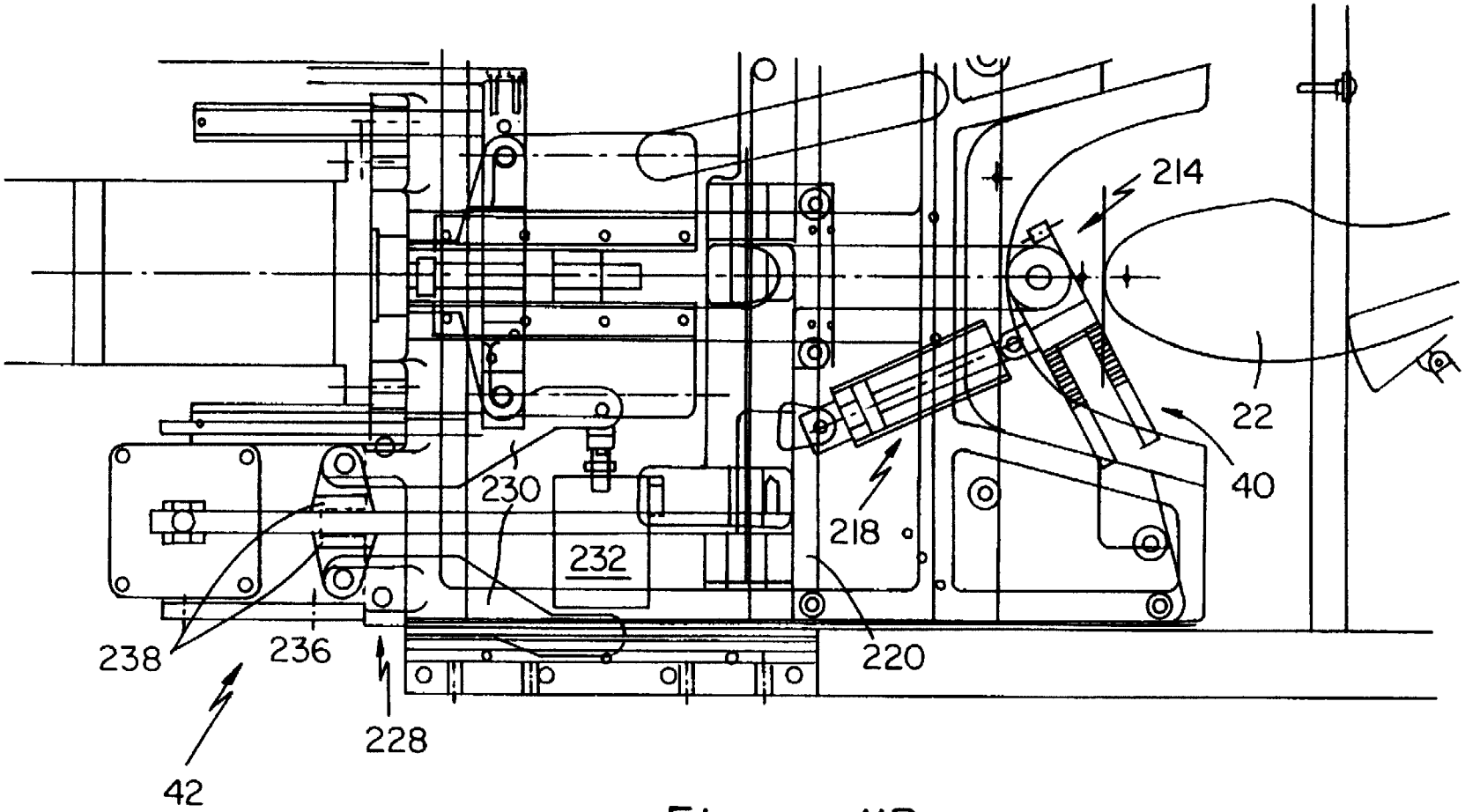
FIG. 11B is a scaled top plan view, partly in section, depicting the overhead toe hold-down assembly of FIG. 11A.

A positioning cylinder 218, interconnected at one end to the fixed machine frame 220 and at a forward end to an intermediate portion of the mounting assembly 214, is operable to pivot the hold-down member 212 into and out of longitudinal alignment with the hold-down lever 210. When the positioning cylinder 218 is retracted as best depicted in FIG. 11B, the hold-down member 212 is retracted to the left into a rest position (see also FIGS. 1 and 2). This enables the machine operator to have an unobstructed view of the pincer array when the upper 18 is being initially loaded between the open pincer jaws 100a,100b. Thereafter, by appropriate signals from the programmable controller 72, a solenoid supplies pressurized air to the positioning cylinder 218 to swing the hold-down 212 into alignment with the hold-down lever 210 (see also FIG. 3).

Further appropriate signals are then supplied by the programmable controller 72 to a hold-down operating cylinder 222 mounted to the rear of the machine frame to extend the piston rod 224 thereof upwardly. The upper end of piston rod 224 is pivotally connected to the rear end of hold-down lever 210, thereby raising the rearward end and lowering the forward end about pivot 211 to direct the hold-down 212 into clamping contact with the upper 18.

The hold-down lever mount 211 supports the intermediate portion of lever 210 to enable the lever 210 and cylinder 222 is trunnion mounted so that the rear end of the lever, pivotally connected to the piston rod 224 through a clevis 226, always travels along the piston rod axis. Once clamping contact is made, the unique braking mechanism 42 is actuated to lock the hold-down lever 210 in the lower, clamped position to ensure that the insole bottom 16 is correctly leveled in relation to the toe wiping plane 32 and thus provide a proper toe height datum which is necessary to ensure proper heel wiping. Still with reference to FIGS. 11A and 11B, braking mechanism 42 comprises a braking clamp assembly 228 including a pair of brake arms 230 to which opposite ends of a piston and cylinder arrangement 232 are mounted to extend between front ends thereof. Intermediate portions of each brake arm 230 are respectively interconnected to a stationary bracket 234 mounted to the machine frame by means of a pair of suspension rods 236 projecting downward from the bracket. Each suspension rod 236 defines a vertical pivot axis about which the brake arm 230 pivots. A pair of brake pads 228 are respectively mounted to the rear ends of the brake arms 230 at a location rearwardly of the pivot 236. Between these brake pads 238 extends a lower end portion of a clamping bar 240, the upper end 242 of which is pivotally secured to a rear portion of the hold-down lever 210 between the main pivot 211 and the cylinder actuated rear end 226.

Once the hold-down 212 has been lowered into clamping position against the top portion of upper 18, an appropriate signal from the programmable controller 72 extends the brake cylinder 232 causing the braking pads 238 to pivot into clamping contact with the lower end of the clamping bar 240 extending therebetween. This effectively locks the hold-down 212 at a constant height in contact with the shoe. Advantageously, this enables insole support 28, having been previously dropped to enable the toe wipers 46 to apply full lasting pressure against upper 18, to return back to the proper wiping plane height.

INSOLE SUPPORT

Figures 4, 4A:
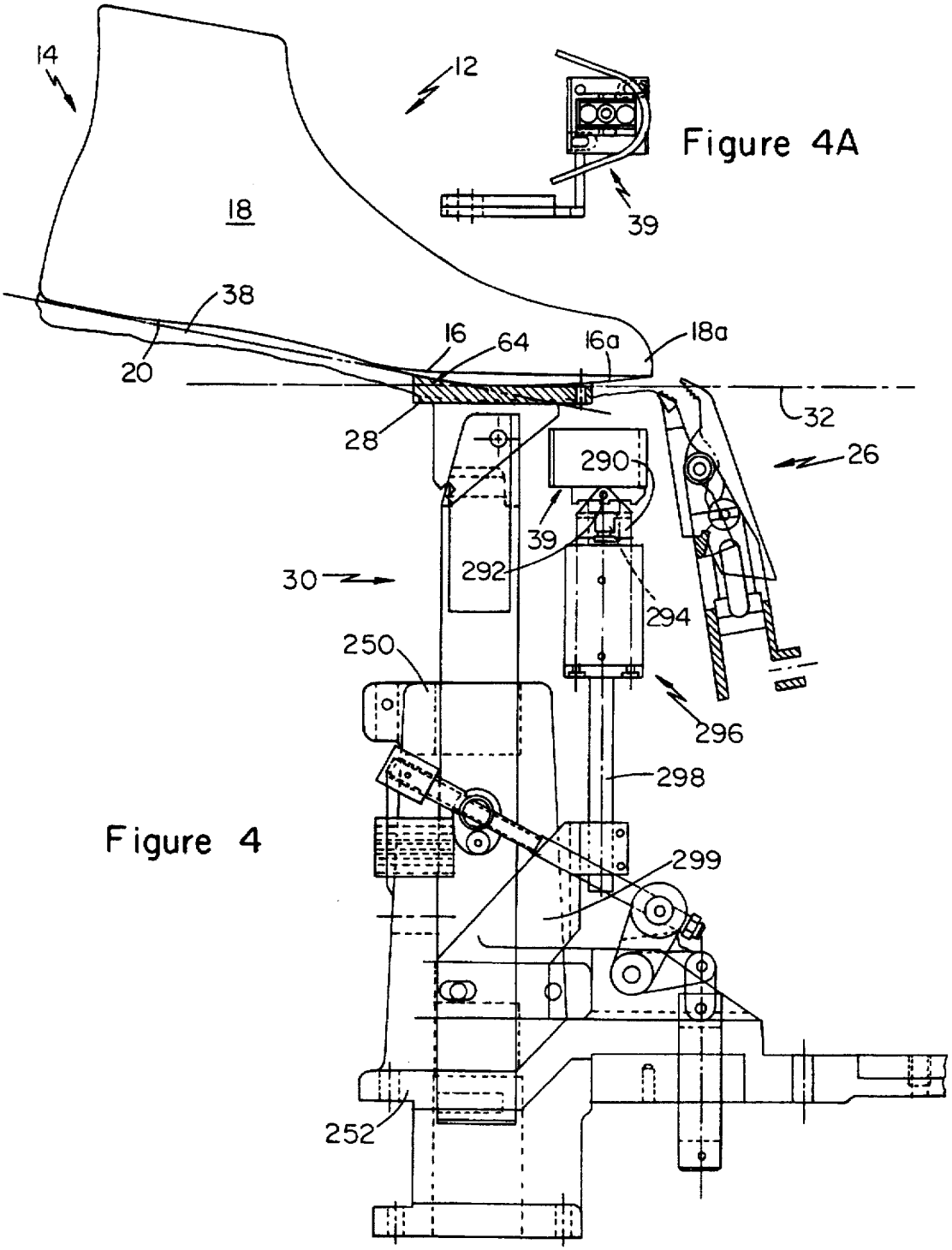
FIG. 4 is a scaled elevational view of an insole support and toe post assembly therefor.
Figure 12:
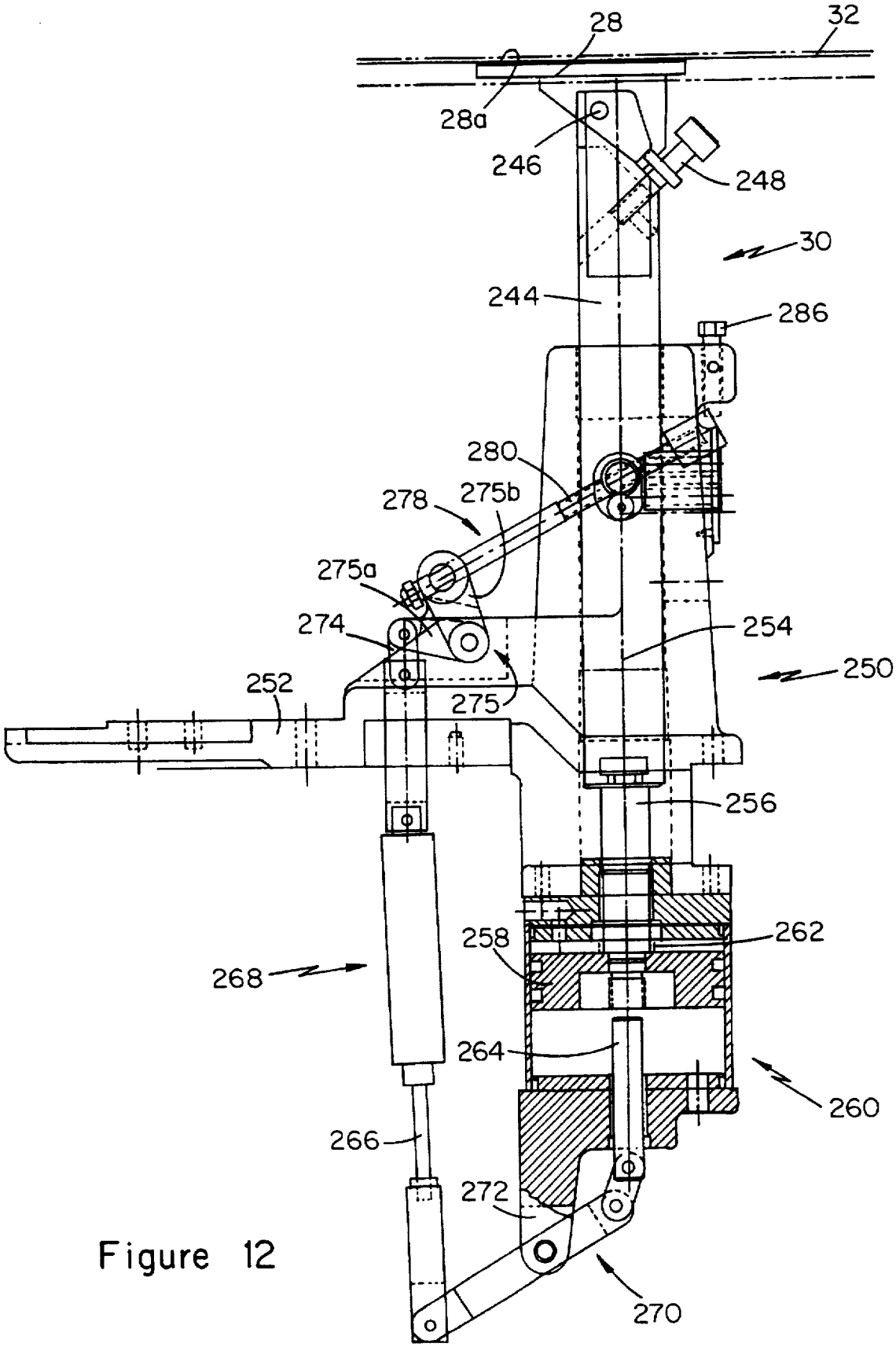
FIG. 12 is a scaled, sectional and elevational view of the toe post assembly part of which is depicted in FIG. 4.
Figure 13:
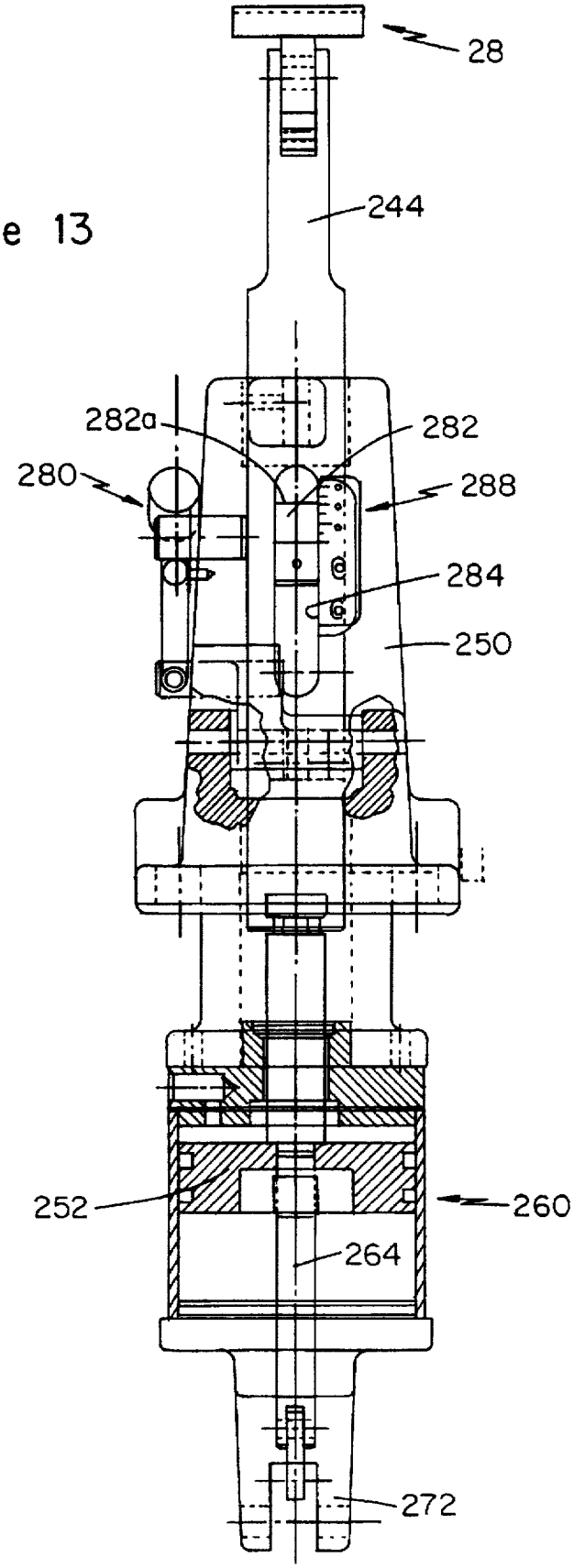
FIG. 13 is a front elevational view of the toe post assembly of FIG. 12.

With reference to FIGS. 4, 12 and 13, insole support 28 is mounted to the upper end of toe post assembly 30 which raises and lowers the insole support under the control of controller 72 into one of several positions in relation to toe wiping plane 32. Insole support 28 is mounted to the top of a jackpost or toe post 244 for pivotal adjusting movement about a pivot axis 246 extending generally perpendicular to the toe axis 196 in parallel relationship to the wiping plane 32 so that the top surface 28*a* of the insole support may be adjustably tilted in forward and rearward directions relative to the wiping plane. An adjustment screw 248 mounted to insole support 28 is threadedly engaged to the jackpost 244 to facilitate insole plane adjustment by manual rotation of the screw.

The jackpost 244 extends downwardly into a support pedestal 250 that may be stationarily mounted to the machine frame with a mounting bracket 252. The jackpost 244 is slidably supported within the pedestal 250 for raising and lowering movement along an axis 254 extending perpendicular to the wiping plane 32. The lower end of the jackpost 244 is connected to the upper end of a cylinder rod 256, the lower end of which is fixed to the main piston 258 of a toe post drive cylinder 260.

Although not shown in detail, the toe post drive piston 258 is normally urged into its bottom position under the bias of a compression spring 262 so that a lower end of the piston rod 256 abuts against the top end of a presentation height positioning rod 264 slidably disposed in the bottom wall of the cylinder 260. This positioning rod 264 is in turn interconnected to a downwardly extending piston rod 266 of a third stage drop cylinder 268 (FIG. 12) through a linkage mechanism 270 pivotally mounted to a fulcrum 272 extending downwardly from the main cylinder 260. Linkage mechanism 270 transmits reverse translational movement from the third stage drop cylinder rod 266 to the presentation height positioning rod 264 in the manner described below.

The upper end of the third stage drop cylinder 268 is mounted to the pedestal support 250 via pivotal connection through a short connecting link 274 attached to the lower crank arm 275*a* of a bell crank 275 pivotally secured to the support. The bell crank upper arm 275*b* is pivotally connected to the lower end of an internally threaded rod (drive nut) 278, the upper end of which is in threaded engagement with the threaded portion of an adjustment screw 280 that is manually rotated to raise or lower the upper end of the third stage drop cylinder 268 via pivotal adjusting movement of the bell crank 275.

With the foregoing construction, insole support 28 is controlled for movement between three different positional heights. The first height is the presentation position wherein the insole support 28 is slightly below wiping plane 32 by a predetermined amount (e.g., about 4 mm) to allow the machine operator to feed upper 18 into the open jaws 100*a*, 100*b* of pincer assemblies 26 by providing light support for the insole bottom 16. When machine 10 is actuated, pressurized air is automatically supplied through a programmable controller actuated solenoid valve to extend the third stage drop cylinder rod 266 to its maximum lowermost position (FIG. 12) which in turn elevates the presentation height positioning rod 264 into the cylinder bottom through the linkage mechanism 270. Since the main piston 258 is under spring bias which is overcome by the rod 266, the main piston rod positively contacts the presentation height positioning rod to raise the top surface 28*a* of insole support 28 to the aforementioned presentation position. At this point, pressurized air is preferably not supplied to the main piston 258. As mentioned above, the presentation height may be adjusted by the action of pivoting the bell crank mechanism 275 through operation of the post height adjustment assembly 280.

The insole support 28 is raised from the presentation position to the stretch or wiper position by supplying pressurized air to raise the main piston 258 in the toe post cylinder 260. This position is depicted in FIGS. 4 and 12 wherein the main piston 258 is in the uppermost end of stroke position and has lifted off from the presentation height positioning rod 264. By appropriate signals from the programmable controller 72, the insole support 28 is raised to the wiper position after the pincer jaws 100*a*, 100*b* have been clamped shut against the toe and ball portions of the upper margin zone 20 and before the pincer assemblies 26 are lowered to stretch the upper 18 in the manner described above.

As the toe and ball wiper assemblies 46 travel to their fully wiped positions depicted in FIGS. 7 and 10B, appropriate signals from the programmable controller 72 to the appropriate solenoid control valve are utilized to lower insole support 28 from the stretch height position of FIG. 12 by retracting the third stage drop cylinder 268 to lower the presentation height positioning rod 264 to its retracted position out of the main cylinder chamber 260. As this occurs, pressurized air is both vented from the bottom side of the main piston 258 while being supplied to the top side to positively drive the main piston 258 downwardly to lower the insole support 28. The purpose of dropping insole support 28 is to enable the toe and ball wipers 46 to exert lasting pressure against the wiped insole margins without the insole support providing any bottom supporting function.

After lasting pressure has been applied to the wiped margins for an appropriate time interval determined by the programmable controller 72, air pressure against the top side of the main piston 258 is released and pressurized air is re-applied to the bottom side to elevate the jackpost 244 and thereby raise insole support 28 back to the wiper plane height position. At this point, the toe wipers 46 are still underneath the insole bottom 16 and have not yet retracted. Insole support 28 now takes up the load to enable wipers 46 to fully retract and slide out from beneath the insole bottom 16 without dragging the wiped margin portions out of engagement with the insole. The insole support 28 will remain at the wiper plane height until it is lowered again prior to movement of the shank wipers 58, discussed infra, into their fully wiped positions to avoid collision therewith.

A stop block 282 best depicted in FIG. 13 is attached to the toe post 244 and extends outwardly therefrom through a vertical slot 284 formed in the support pedestal 250. The stop block 282 moves vertically when the toe post 244 is raised or lowered for engagement with the lower end of a stop screw 286 mounted to the support pedestal 250 as depicted only in FIG. 12. By engaging the stop block 282, the stop screw 286 limits the upper movement of the toe post 244 to enable the operator to pre-set the insole support 28 to a desired point in relation to the wiper plane 32 for controlling the stretch height. A reference scale 288 (FIG. 13) is provided adjacent the top surface 282*a* of the stop block 282 to provide a visual indication of the extent to which the stretch height of the insole support 28 is at, above or below the wiping plane 32.

With reference to FIG. 4, the auxiliary insole support 39 is mounted to extend upward from the support pedestal 250 to contact the insole bottom 16 in a toe region between insole support 28 and the forwardmost edge of the insole bottom. The auxiliary insole support 39 is of inverted cross-sectional U-shape when seen by the operator standing in front of the machine 10 and is connected to the upper end of a piston rod 294 with a clevis 290 permitting pivotal adjusting movement of the auxiliary support 39 about a pivot axis 292 extending parallel to the insole support pivot axis 246. The auxiliary support piston rod 294 extends upwardly from an auxiliary support height adjustment cylinder 296 that is mounted to the upper end of a stationary support rod 298, the lower end of which is received in a support bracket 299 connected to the support pedestal or machine frame 250.

By appropriate signals from the programmable controller 72, the height adjustment cylinder 296 is supplied with pressurized air to raise the auxiliary insole support 39 into the aforementioned contact with the insole bottom 16 before the clamped pincer assemblies 26 are lowered to fully stretch the upper 18. The feature of auxiliary insole support 39 prevents the tip of the insole bottom 16 from dropping below the wiper plane 32 which tends to be disadvantageously caused by the upper 18 dragging the insole tip down as the upper is being pulled by the pincer assemblies 26. After the pincer assemblies 26 have lowered to fully stretch the upper 18, the auxiliary insole support 39 is also lowered by retracting piston rod 294 before the toe wipers 46 travel into wiping contact with the upper marginal portions 20.

HEEL AND SHANK WIPER ASSEMBLY

The heel wiper assembly 34 is comprised of a number of sub-assemblies which are cylinder actuated through appropriate solenoid valves operated by the programmable controller 72 to last the heel and shank portions of upper margin portion 20. These sub-assemblies include the novel three-part heel clamping pad assembly 36, and the unique arrangement of heel and shank wipers 54,58, all mounted to the top of a heel post 300 which is raised and lowered by a cylinder 302 along an axis 304 extending generally perpendicular to the heel wiping plane 38.

Figure 14:
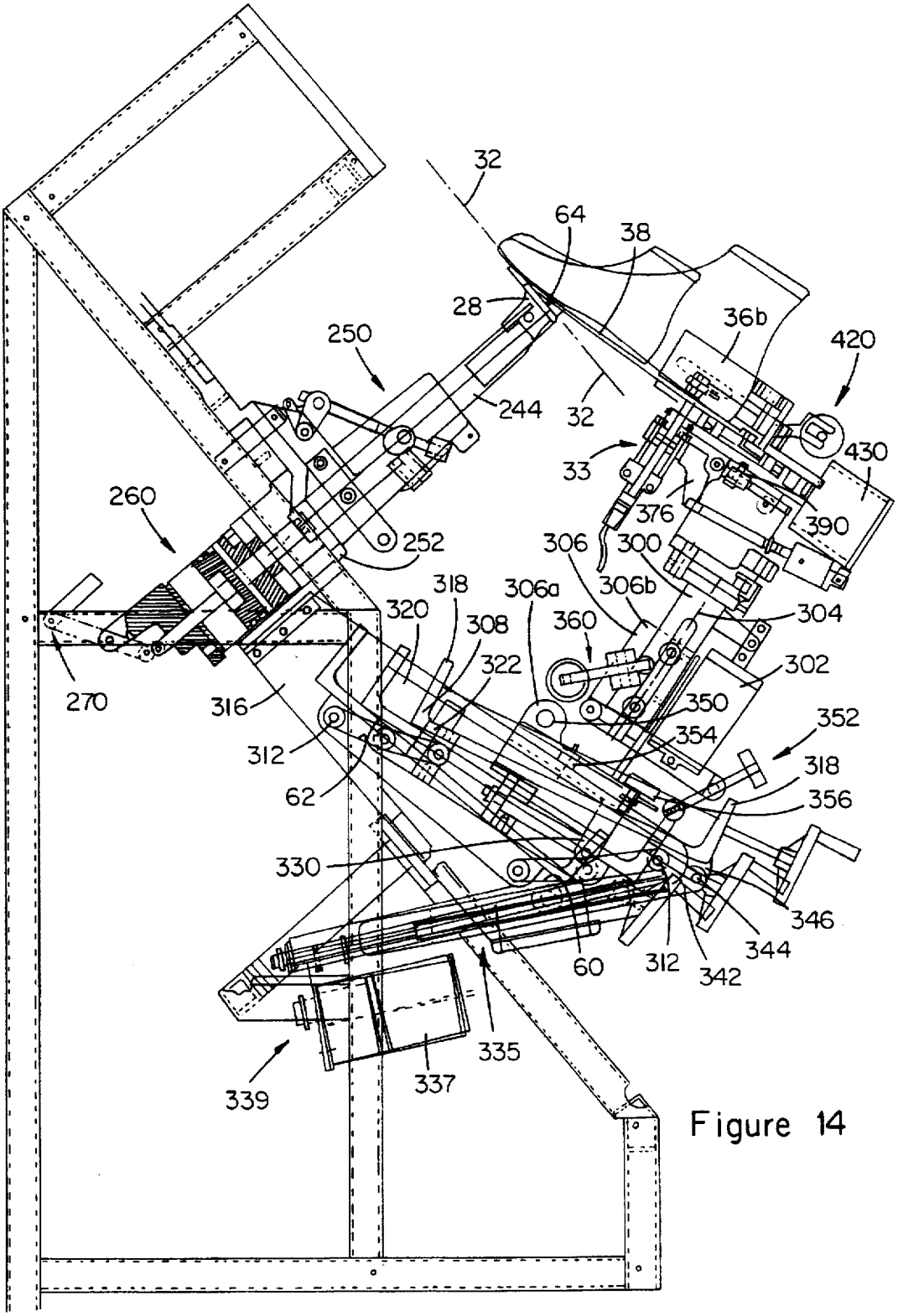
FIG. 14 is a left side elevational view of the machine, partly in section, to depict the relative locations of the toe and heel wiper assemblies.
Figures 18, 18A:
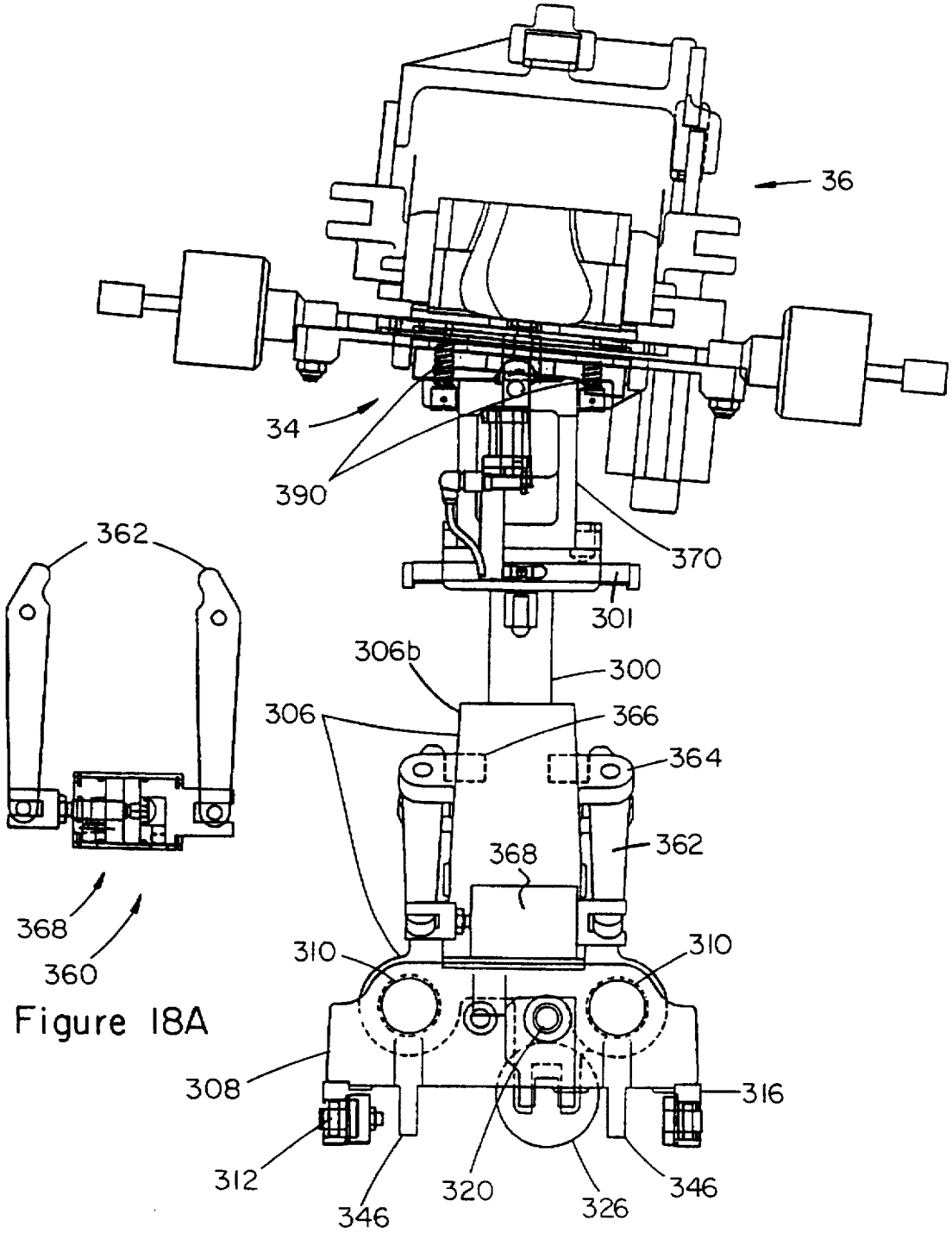
FIG. 18 is a front elevational view, partly in section, of the heel wiper assembly
FIG. 18A is a top plan view, partly in section, of a heel post brake mechanism.
Figure 19:
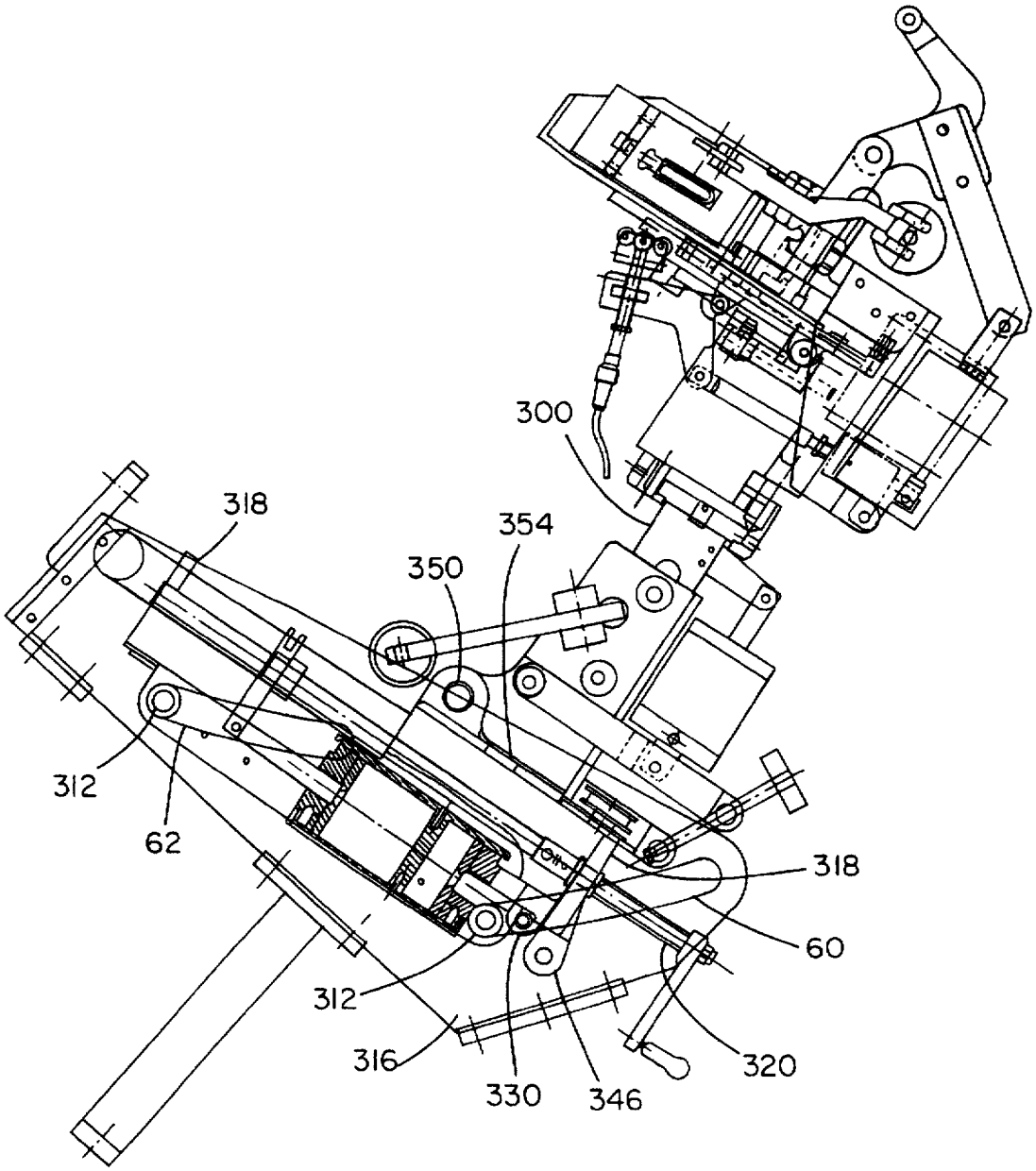
FIG. 19 is a scaled elevational view, partly in section, of the heel wiper assembly including cam track adjustment of the heel wiping plane.

With particular reference to FIGS. 14–19 the heel post 300 is supported within a lower heel post housing 306 that is slidably mounted to a heel carriage 308 through a pair of slide rods 310. The lower opposite ends of the heel carriage 308 respectively support a pair of cam follower rollers 312 projecting from both sides of each end. The pair of cam follower rollers 312 at each of the front and rear ends are respectively received in the pair of front and rear cam track slots 60 and 62 formed in a pair of stationary machine side frames 316 as best depicted in FIGS. 14 and 19. It will therefore be understood that the entire heel wiper assembly 34 including the heel post 300 and heel post housing 306 is carried on, and supported by, the heel post carriage 308 which is uniquely movably mounted to the machine side frames 316 through the cam follower rollers 312 as discussed more fully below.

Figure 15:
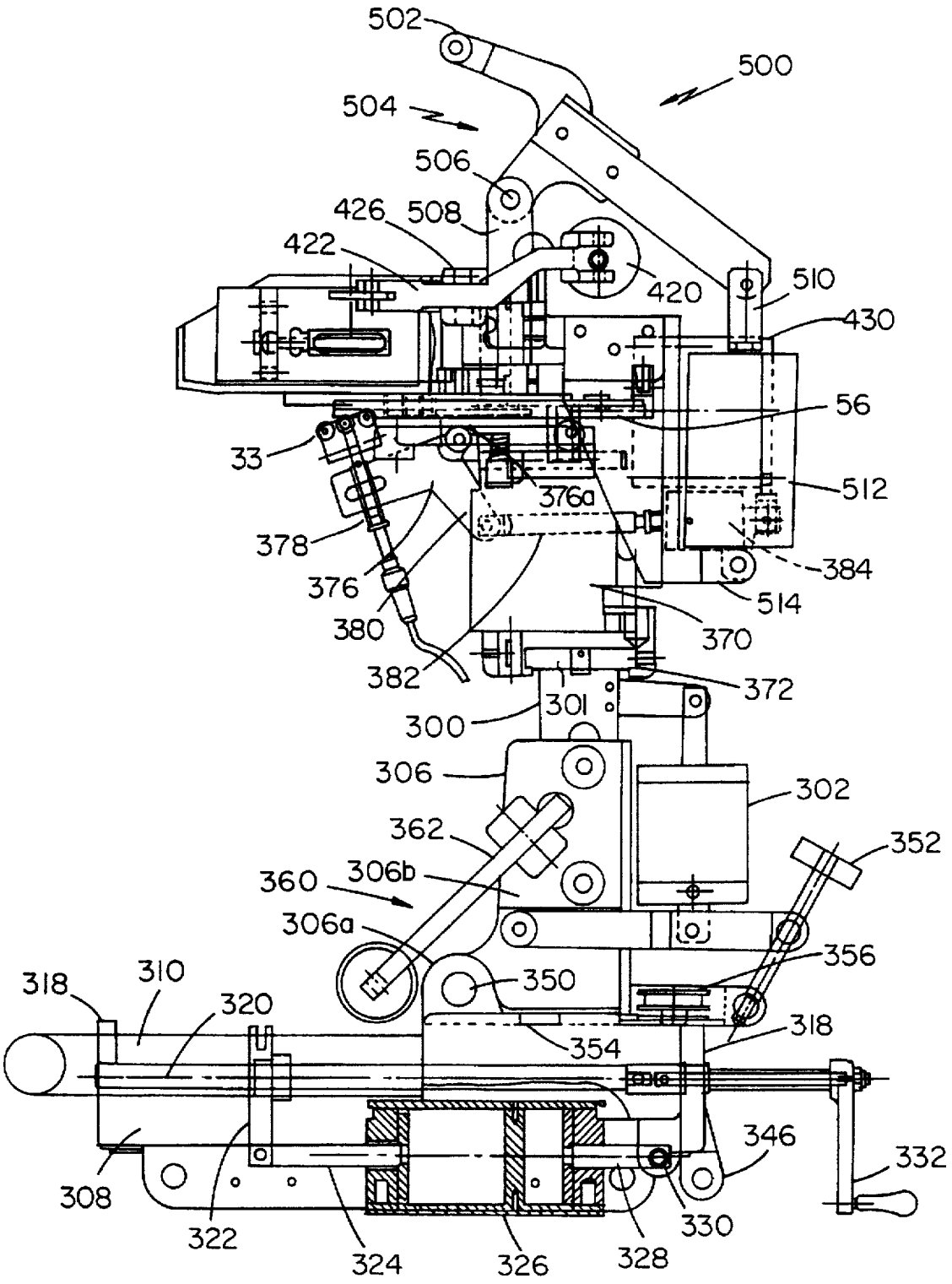
FIG. 15 is a scaled elevational sectional view of the heel wiper assembly in a retracted position.

The slide rods 310 extend through and are supported by bearings located in the upstanding end walls 318 at opposite front and rear ends of the heel carriage 308. These end walls 318 also support a threaded drive screw 320 that extends parallel to and between the slide rods 310 as best depicted in FIGS. 15 and 18. A positioning plate 322 is threadedly attached to the drive screw 320 and is formed with a clevis at its lower end connected to a rearwardly extending piston rod 324 of a heel assembly positioning cylinder 326. The positioning cylinder 326 further includes a forwardly extending piston rod 328 which is in turn pinned to a pair of mounting ears 330 that extend downwardly from the heel post housing 306. The forwardly and rearwardly extending piston rods 328,324 of the positioning cylinder 326 are in coaxial alignment with each other and extend parallel to the adjustment drive screw 320.

A hand crank 332 may be attached to the front end of the adjustment drive screw 320 to rotate same which in turn causes the positioning plate 322 to advance along the screw in forward and rearward directions. It will be understood that the adjustment drive screw 320 may also be machine driven. As the positioning plate 322 advances as a result of screw rotation, the positioning cylinder 326 is pulled by the advancing plate 322 in the direction of advancement (i.e., in forward or rearward directions). This in turn causes the heel post housing 306 to also advance in the same direction as a result of its interconnection with the forwardly extending cylinder rod 328. In this manner, the heel and shank wiper assemblies 34 and the three-part clamping pad 36 can be adjusted, in forward and rearward directions, during machine set-up to accommodate the lasting of a particular range of shoe size.

As mentioned above, the heel carriage 308 is mounted to the left and right machine side frames 316 through two pairs of front and rear cam follower rollers 312 with the rear pair being respectively received in a first pair of correspondingly located cam slots or tracks 62 formed in the machine side frame and the front pair being received in a second pair of correspondingly located cam slot tracks 60 located forwardly of the rear pair (see FIGS. 14 and 19). In accordance with a unique feature of this invention, each pair of cam slot tracks 60,62 is defined by a radius of curvature having a common center 64 located on the axis extending through the approximate point at which the toe wiping plane 32 intersects the heel wiping plane 38 as best depicted in FIG. 14. This axis 64 generally extends through the ball region of a particular shoe being lasted in the approximate vicinity of the top surface 28*a* of insole support 28 at its wiping height. The front and rear cam tracks 60,62 therefore respectively subtend an arcuate interval extending along one of two concentric circles having a common imaginary center lying on axis 64 extending perpendicular to a vertical plane.

Therefore, rotation of the adjustment screw 320 serves to advance the heel post housing 306 along the slide rod assembly 310 mounted to the heel carriage 308 to adjust the forward and rearward positioning of the heel and shank wiper assembly relative to the toe pad/insole support 28 to thereby accommodate a particular size shoe during set-up. The independent movement of the overall heel carriage 308 controlled by the cam followers 312 advancing through its associated cam track 60,62 serves to rotate or pivot the heel wiping plane 38 about axis 64 to advantageously enable the heel and shank wipers discussed infra to move in a plane that closely approximates the plane of the heel portion of the insole bottom 16 to which corresponding heel portions of the upper margin portion 20 are to be lasted. This improvement essentially allows the heel and shank wiper assembly 34 of machine 10 to be adjusted to last a wide variety of shoes, nominally ranging in sizes of one through fourteen, by sufficiently approximating the heel angle of the shoe as a result of the aforementioned unique rotational adjustment.

Figure 17B:
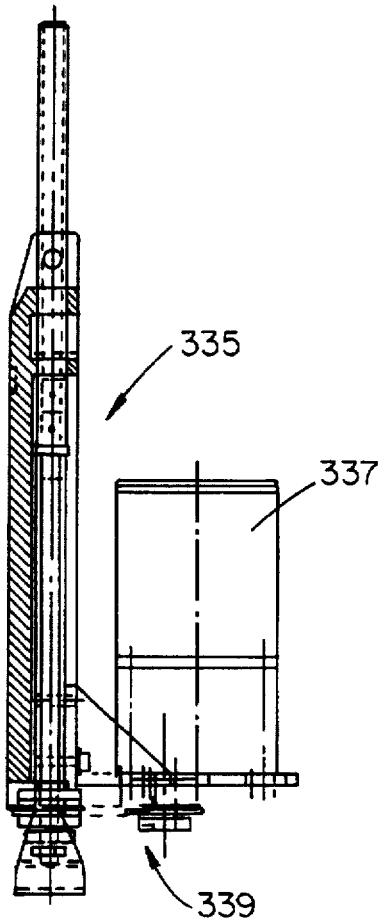
FIGS. 17 and 17B are top and side elevational views, respectively, of a motorized actuating unit for moving the heel carriage in heel wiper plane adjusting movement.
Figure 17:
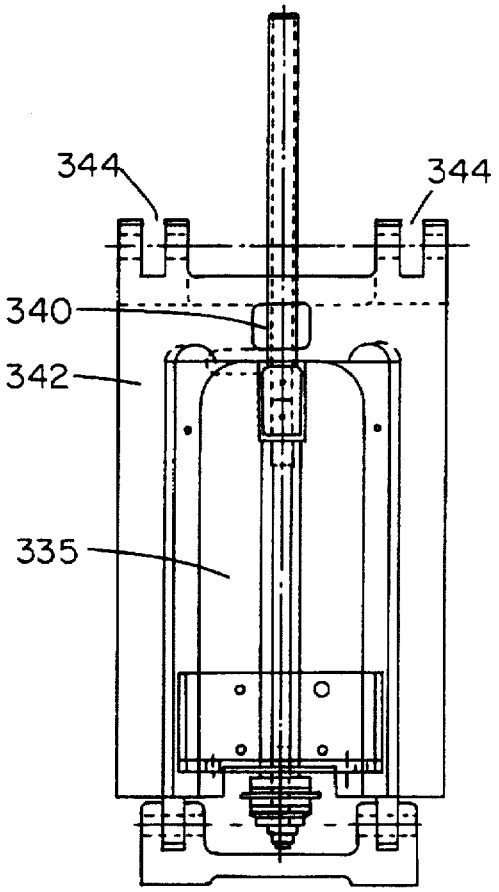

Still with reference to FIG. 14, the heel carriage 308 is advanced along the cam tracks 60,62 through a threaded drive screw assembly, generally designated with reference numeral 335, which is preferably rotated with an electric motor 337 through a chain and sprocket arrangement 339. The carriage adjustment screw 335 is threadedly engaged to a drive nut 340 connected to a carriage positioning slide 342 to impart translational front and rear movement thereto. The carriage positioning slide 342 is formed with a pair of clevises 344 at the front end thereof (FIGS. 17A and 17B) which are respectively pinned to a pair of mounting ears 346 projecting downwardly from the front end of the heel carriage 308 for pivotal connection therewith. In this manner, with particular reference to FIG. 14, the advancing carriage positioning slide 342 moves the carriage 308 along the cam tracks 60,62. Three representative adjustment positions of the heel carriage 308 achieved with the carriage positioning slide 342 adjustment of the invention are depicted in FIG. 14.

In the preferred embodiment, the heel post housing 306 may be of two-part construction wherein the lower housing portion 306*a* functions as a slide in sliding contact with the carriage slide rods 310, while the upstanding upper housing portion 306*b* contains the heel post 300. The upper and lower parts 306*a*, 306*b* of the heel post housing 306 are pivotally connected to each other at a rear pivot 350. A threaded adjustment screw mechanism 352 is utilized to adjust the position of cylinder 302 after the sensor 33 has been raised into contact with the heel to provide a final trim adjustment of the heel wiper assembly height, if needed.

The upper part 306*b* of the heel post housing 306 generally bears downwardly against a brake member 354 extending through the lower part 306*a* of the housing which provides a braking force that fixes the heel post housing at one location on the carriage slide rods. This brake is located forwardly of the rear pivot 350. To release this brake 354, a vertically movable cylinder 356, preferably located forwardly of the brake, is normally applied with pressurized air in order to exert a slight lifting force against the upper heel post housing 306*b* to counterbalance and thereby remove braking pressure to permit sliding adjustment of the heel post housing along the slide rods 310. This lifting pressure is terminated during periods when the heel is being wiped so that the brake 354 can effectively lock the heel post housing 306 and thereby the heel post 300. This prevents undesirable retracting movement of the heel and shank wipers 54,48 as the assemblies tend to retract from the heel under the action of wiping pressure.

With reference to FIGS. 15, 18 and 18A, a heel post brake assembly, generally designated with reference numeral 360, is utilized to lock the heel post 300 to the heel post housing 306 once the heel proximity sensor 33, described infra, has located the heel bottom of the shoe and, in this manner, position the three-part heel clamping pad 36 and the heel and shank wipers at the proper elevational height relative to the heel. The heel post brake 360 functions in a manner similar to the overhead hold-down brake 42 described above and generally includes a pair of brake link arms 362 that are pivotally connected at intermediate portions thereof to a respective pair of mounting ears 364 (see FIG. 18) formed on the upper part 306*b* of the heel post housing 306. The upper ends of these brake arms 362 are equipped with brake pads 366, respectively, and the lower ends of the brake arms are interconnected to each other through a brake cylinder 368. By extending the brake cylinder once an appropriate signal has been received by the programmable controller 72 indicative of heel sensing, the upper front ends of the brake arms 362 pivot towards each other to clamp the brake pads 366 against the heel post 300, thereby locking the post in fixed elevational position.

Figures 15A, 15B, 15C:
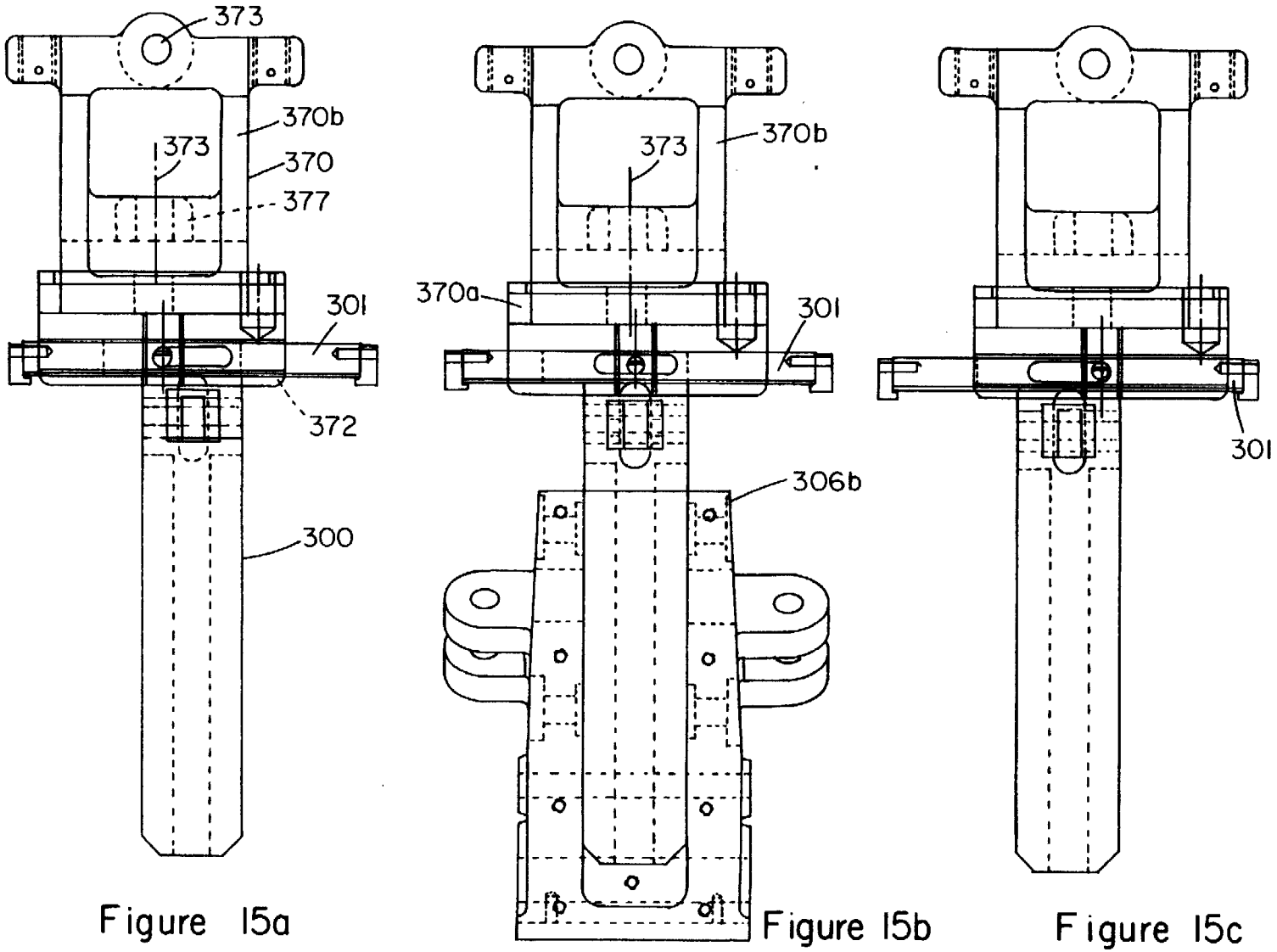
FIG. 15*a*–15*c* are partly elevational and sectional views of a heel wiper assembly mounting base mounted to the heel post, in left, center and right adjusted positions, respectively.

The upper end of the heel post 300 supports a top mounting plate 301 to which a heel and shank wiper mounting base 370 provided with transversely extending tracks 372 in a lower end thereof is slidably mounted by interfitting with an upper track in the top mounting plate as best depicted in FIG. 15. This slide track arrangement 372 permits movement of the mounting base 370 and thereby the heel and shank wiper assemblies mounted thereto in the left and right directions relative to the heel axis 66. This adjustment feature allows for the lasting of left or right shoes by either station, adding to the versatility of the machine. In addition, this adjustment features allows for left and right offset which will vary from shoe style to style and size to size within a style, for yet further adjustment versatility. With references to FIGS. 15*a*–15*c*, mounting base 370 is depicted in left, center, and right adjustment positions, respectively, relative to the longitudinal axis of heel post 300.

Figures 15D, 15E, 15F, 15G:
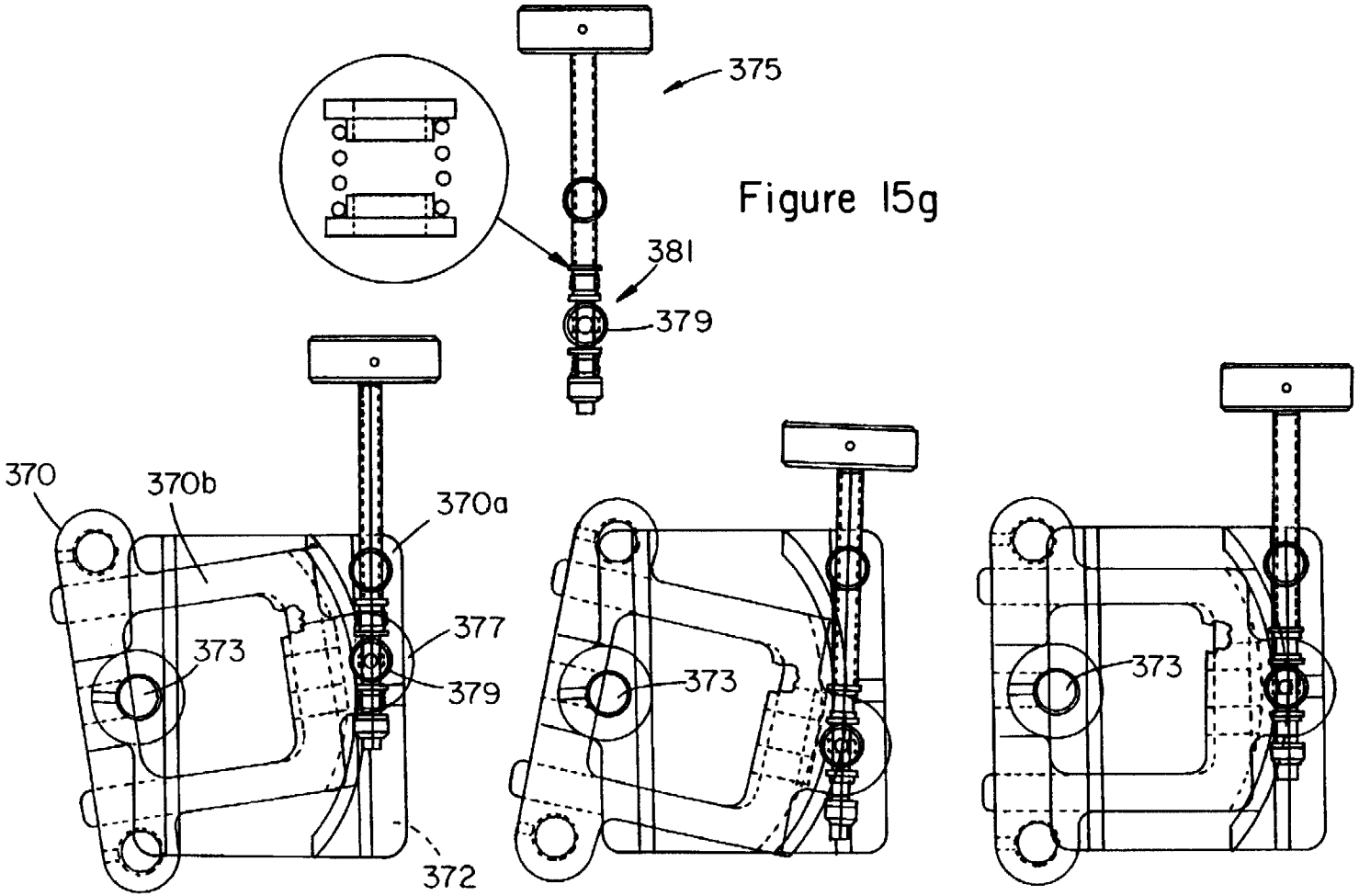
FIG. 15*d*–15*f* are top plan views depicting yaw adjustment between upper and lower units of the mounting base assembly.
FIG. 15*g* is an assembly drawing of the yaw adjustment screw assembly for adjusting the yaw of the upper mounting base unit relative to the lower unit.

With reference now to FIGS. 15*d*–15*g*, it can be seen that mounting base 370 is preferably of two-part construction: a lower mounting base unit 370*a* equipped with tracks 372 and an upper mounting base unit 370*b* supporting the heel wiper assembly in the unique manner described below. In FIG. 15*d*, it can be seen that the upper base unit 370*b* is pivotally mounted to the lower base unit 370*a* along a pivot axis 373 extending perpendicular to the heel wiper plane and parallel to the heel post axis to allow for yawing adjustment as variously depicted in FIGS. 15*d*–15*f*. This yawing adjustment is achieved with a yaw adjustment screw assembly 375 that is attached to the lower base unit 370*a* and pivotally secured to a clevis 377 projecting forwardly from a bottom portion of upper base unit 370*b*.

The threaded screw portion of adjustment screw assembly 375 includes a spring and centralizing bushing pack assembly generally designated with reference numeral 381 in FIG. 15*g*, at a distal end thereof that resiliently transmits the movement of the adjusting screw to clevis 377 through movement 379 to thereby achieve yaw adjusting movement of upper base unit 370*a* and thereby the heel assembly. The yaw adjustment screw assembly 375 and the spring and centralizing bushing pack assembly 381 thereof impart to the heel wiping assembly a level of yaw adjustment compliancy that will advantageously accommodate slight variations in last shape, etc., to enable machine 10 to reliably last a range of shoe sizes before operator adjustments are required.

Figure 15I:
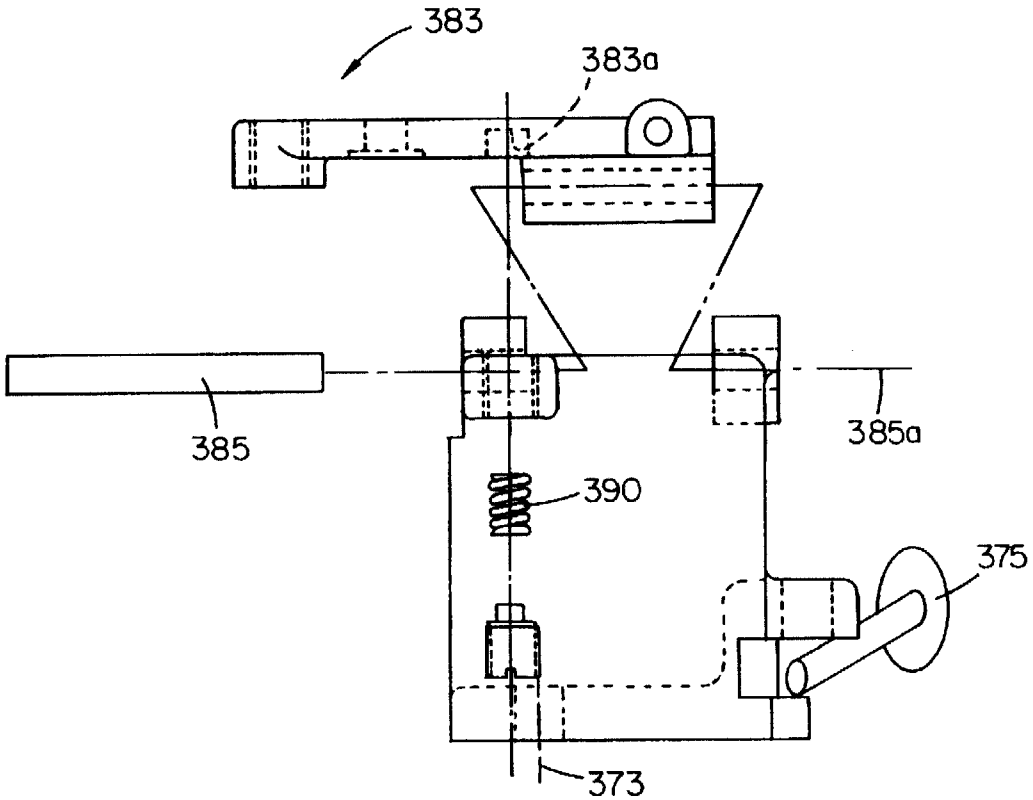
FIG. 15*i* is an exploded side view of the arrangement depicted in FIG. 15*h;*
Figure 15H:
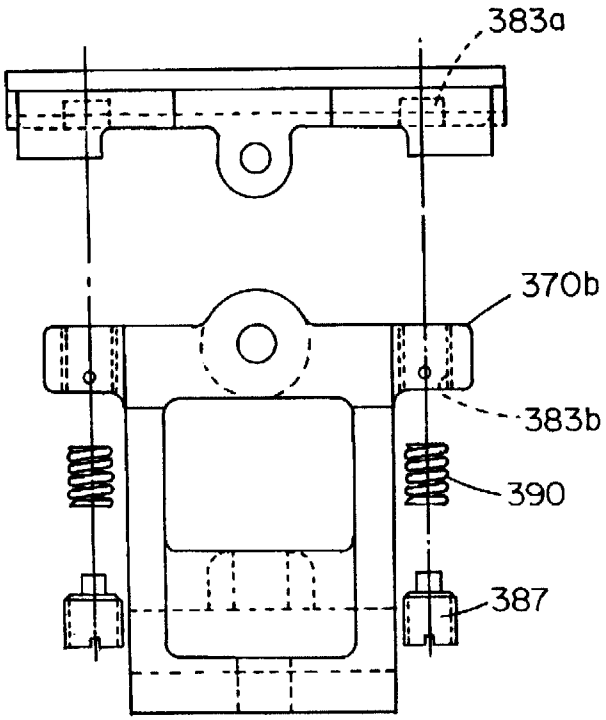
FIG. 15*h* is an exploded sectional view depicting the mounting of a roll adjustment mounting base plate to the mounting base.
Figure 15J:
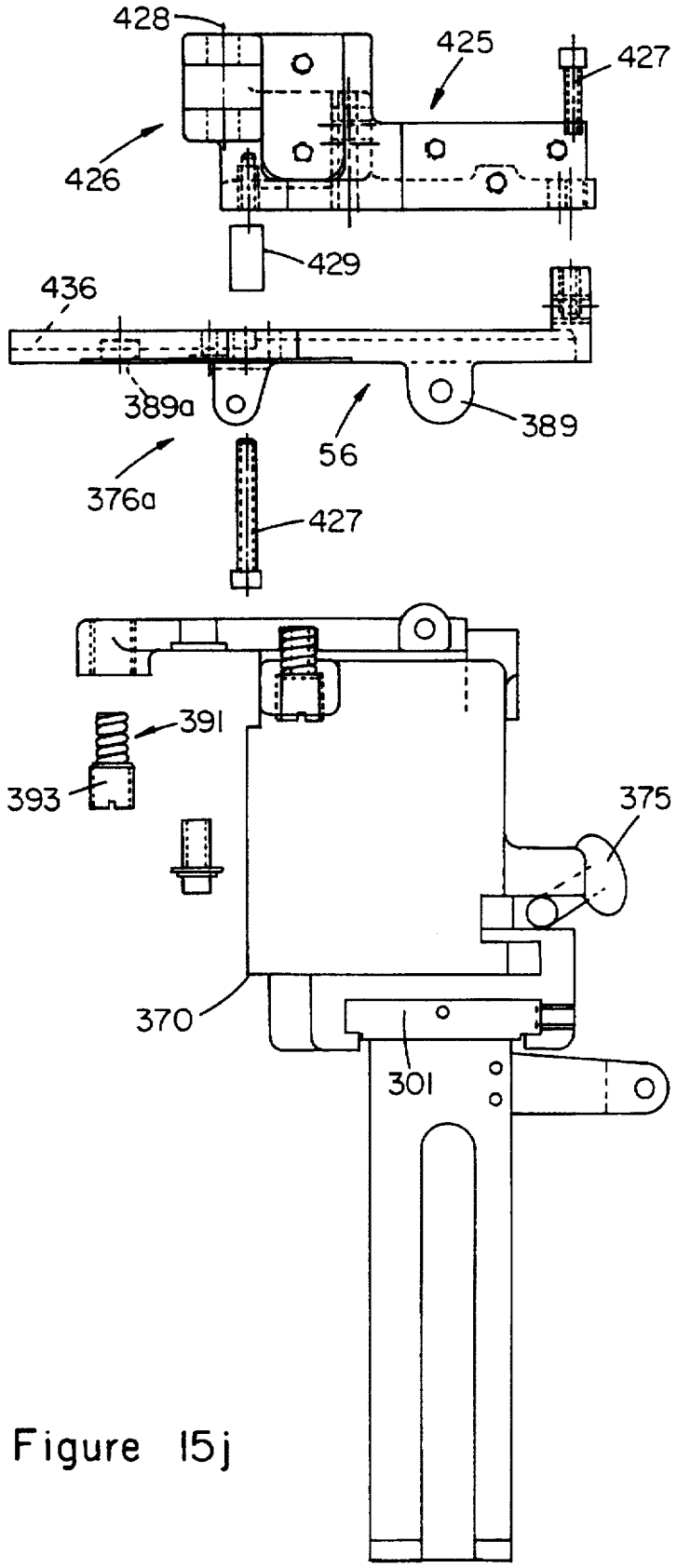
FIG. 15*j* is an exploded elevational view, partly in section depicting the mounting of the heel wiper cam track plate to the mounting base unit.

As will be seen more fully below, the heel and shank wipers 54 and 58 are mounted to a cam track and support plate 56 that is in turn mounted to a roll adjustment mounting base plate 383 as best depicted in FIGS. 15*h*–15*j*. More specifically, the roll adjustment mounting base plate 383 is pivotally connected to the top end of upper mounting base unit 370*b* with a pivot pin 385 extending in the direction of a second yaw axis 385*a* (see FIG. 15*i*) projecting in the forward and rearward direction parallel to the heel wiper plane. An intermediate portion of mounting base plate 383 is formed with a pair of left and right downward facing blind bores 383*a* adapted to receive the upper ends of a pair of compression springs 390 respectively extending upwardly through a pair of throughbores formed in left and right mounting ear portions of the upper base 370*b* with the lower ends of these compression springs captivated in these throughbores by means of a spring compression adjusting nut 387. As best depicted in FIGS. 15*h* and 18, these springs 390 define a floating arrangement to enable the heel wiping plane 38 of the heel and shank wiper assemblies 34, as well as the heel clamping pad assembly 36, to tilt about the yaw axis 373 and thereby the heel axis 66 to provide a self leveling, yawing action and accommodate the actual position and orientation of the last 14 as defined by the pincer assemblies 26 and insole support 28.

With reference to FIG. 15*j*, the cam track plate 56 is mounted atop the roll adjustment mounting base 383 through a forwardly located pivot 389 extending in left and right directions perpendicular to the yaw pivot axis 373. The rearwardly projecting portion of cam track plate 56 is formed with a downward facing blind bore 389*a* adapted to receive the upper end of a compression spring 391 the lower end of which is secured and supported by the rearward projecting end of the base plate 383 with a spring adjusting nut 393. With this unique arrangement, the heel clamping pad as well as the heel and shank wiper assemblies mounted to cam track plate 56 are now capable of a rocking movement about pivot axis 389 which will generally occur as a result of reaction forces generated by bedding pressure on the toe wipers from the overhead toe hold-down. Therefore, this unique pivot feature allows the last 14 to rock with the heel clamping pad assembly maintaining good heel clamping contact and proper alignment of the heel wiping plane with the actual heel portion of the insole bottom so that the toe and heel wiping stations do not fight with each other.

Various of the features of the mounting base 370 as depicted in FIGS. 15*a*–15*j* are selectively omitted from the other drawing illustrations to avoid unnecessary detail and clutter within the drawings.

The cam track plate 56 also pivotally supports the heel sensor mounting bracket 376 at 376*a* (see, FIGS. 15 and 15*j*) to which the heel sensor 33 is attached to a rearwardly extending arm portion 378 thereof. A forwardly and downwardly extending arm portion 380 of this bracket 376 which is therefore of bell crank-like construction, is connected to a rearwardly projecting end of a piston rod 382 (operated by a cylinder 384) for pivoting the sensor support bracket to raise and lower the sensor.

In the raised position (FIGS. 14 and 16), the heel height sensor 33 is approximately level with the bottom surfaces of the heel clamping pads 36*a*–36*c* for proper elevational positioning of the latter relative to the insole heel bottom to ensure a good wipe.

Prior to heel clamping with pad assembly 36, the heel pad as well as the heel wiper assemblies are initially moved rearwardly in the direction of the heel into a presentation position (approximately 25 mm from the back of the last 14) under the retracting movement of the rear piston rod 324 (see FIG. 16) of the heel post housing adjustment cylinder 326, causing the heel post housing 306 and thereby the heel pads 36*a*–36*c* to slide in the desired direction. At this point (see also FIG. 21), the heel height sensor 33 swings up from its FIG. 15 position into the position shown in FIG. 16 so that it is coplanar with the bottom of the heel pads as aforesaid. The heel post 300 is then raised under the action of the heel post lifting cylinder 302 to raise the heel height sensor 33 as well as the heel clamping pads 36*a*–36*c* and heel and shank wiper assemblies 53,58 toward the heel bottom.

Figure 22:
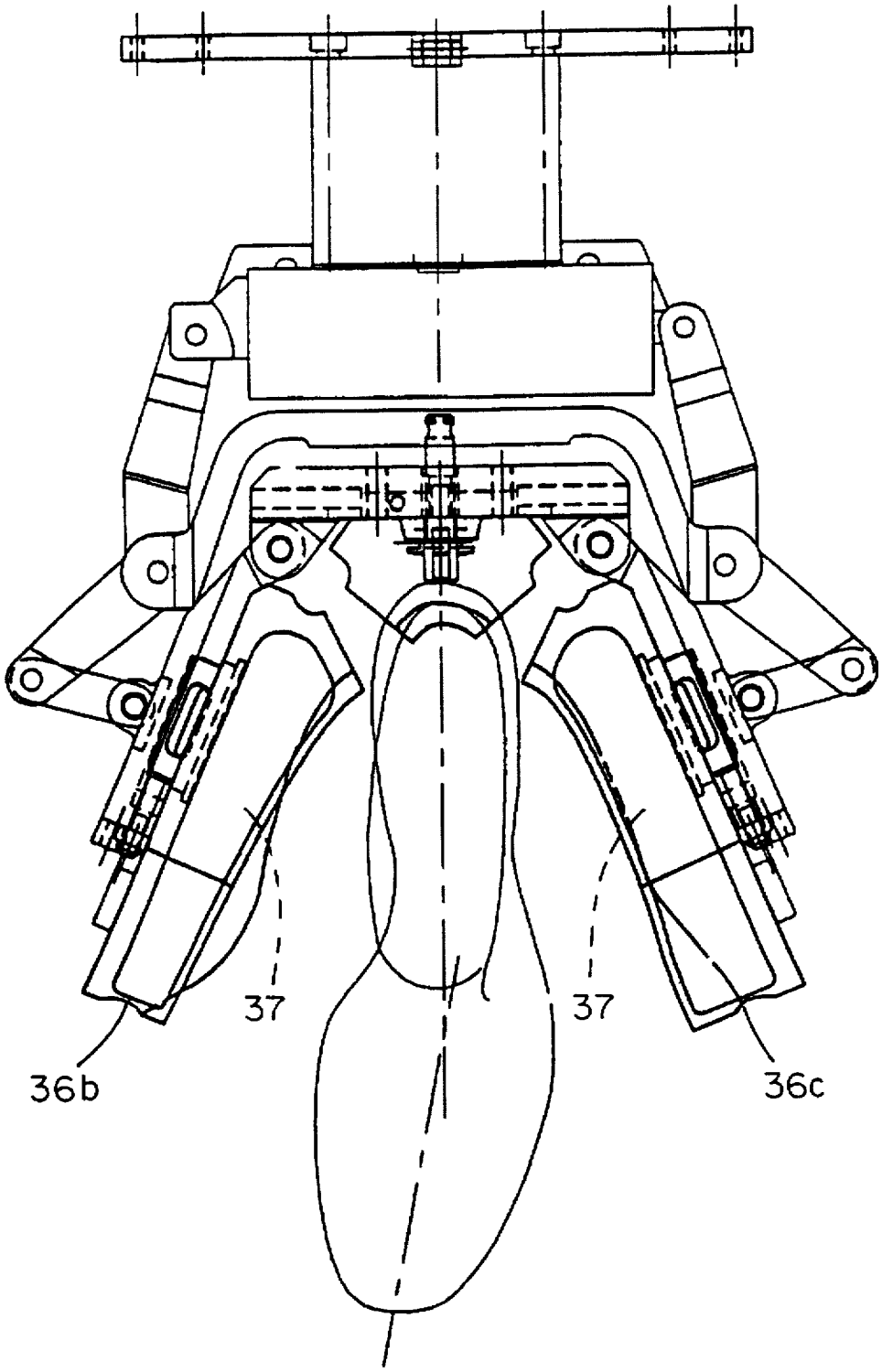
FIG. 22 is similar to FIG. 20 with the center heel pad clamped to the heel portion of the footwear assembly.
Figure 23:
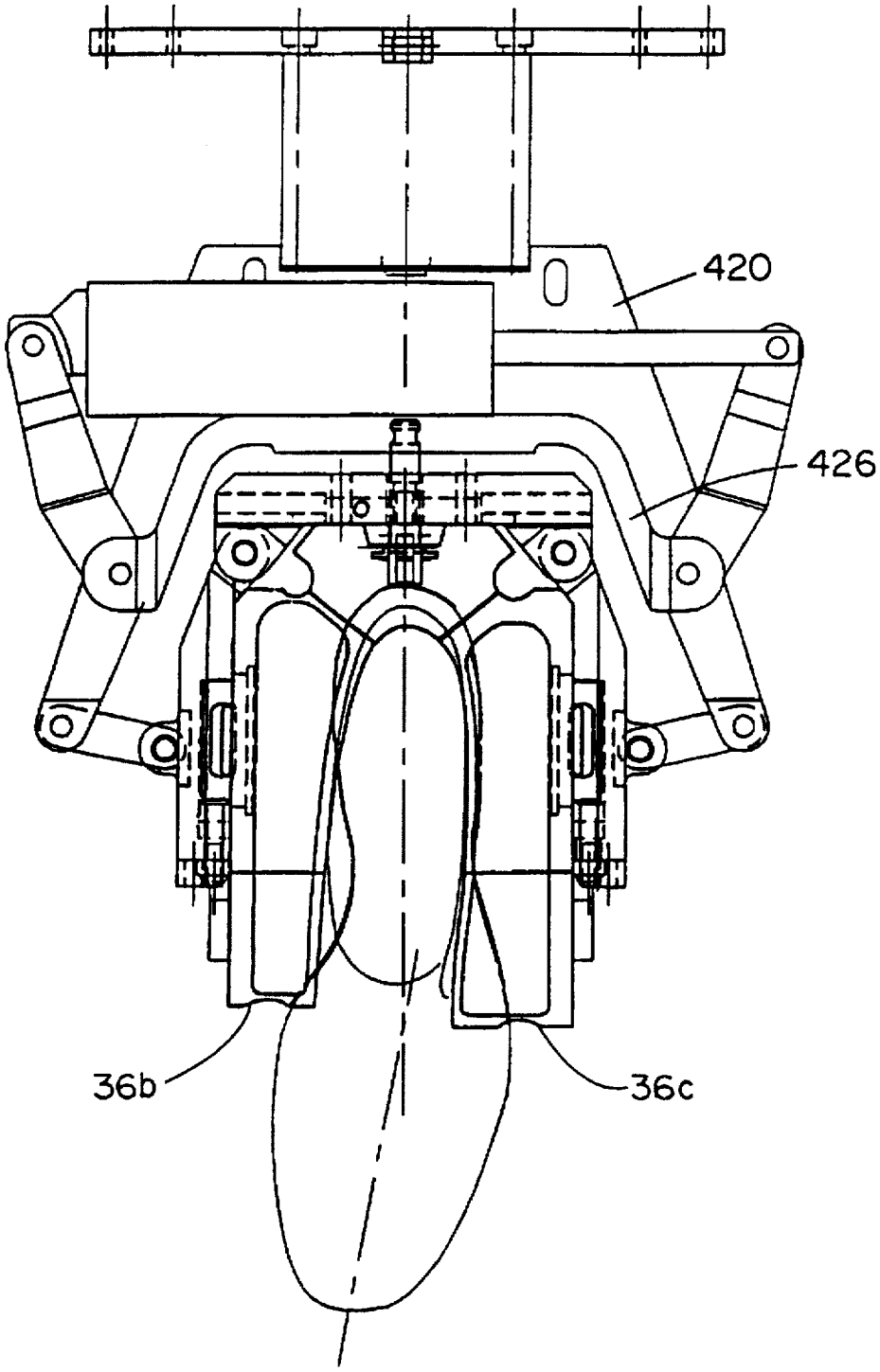
FIG. 23 is similar to FIGS. 20–22 with the center and side heel clamping pads in clamped position.

As the heel height sensor 33 contacts or senses the heel portion of the insole bottom 16, an appropriate signal is communicated to the programmable controller 72 which then operates the heel post brake 360 through appropriate solenoid control to lock the heel post 300 at the correct heel wiping plane 38 and prevent further upward movement thereof. The heel post housing 306 is now advanced by retraction of the front piston rod 328, caused by pressurized air entering inlet 395 (FIG. 16) in the heel post housing adjustment cylinder 326 so that the center heel pad 36*a* contacts the back of the last 14 in clamping engagement (FIG. 22). The side pads 36*a* and 36*c* of the heel pad assembly are now clamped against sides of the last (FIG. 23). Because the aforementioned heel pad mounting arrangement is pivoting and spring loaded, and since the last 14 cannot move, the heel pad assembly advantageously self centers and tilts, if necessary, to accommodate the current position of the last. It will be understood that this spring-loaded, self-centering mounting arrangement depicted in FIG. 18 will also self adjust the cam track plate 56 (through springs 390) controlling the heel wiping plane of the heel and shank wipers so that heel and shank wiping advantageously occurs relative to the actual current position of the last 14 as determined hereinabove.

Figure 16:
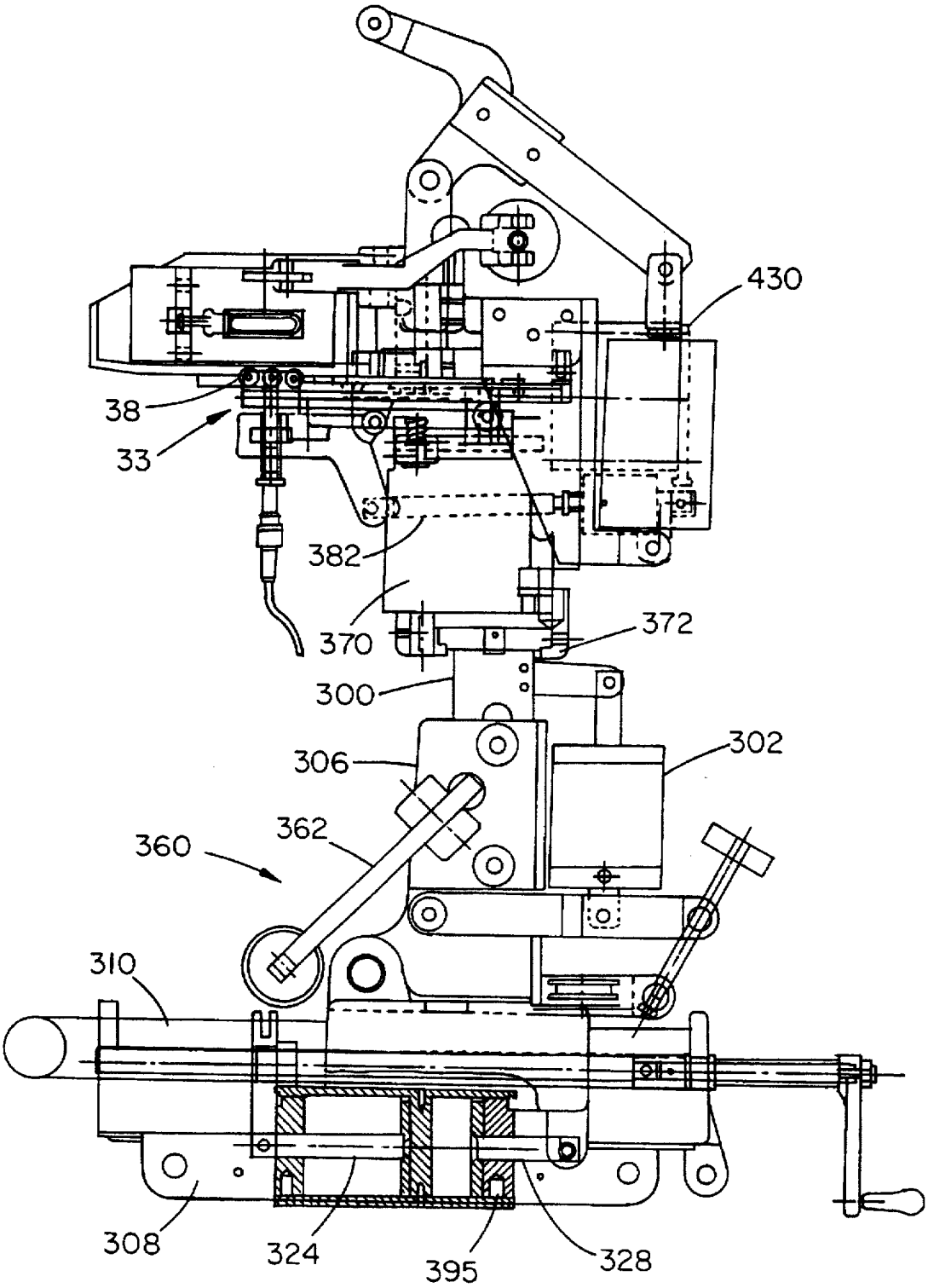
FIG. 16 is a view similar to FIG. 15 with the heel wiper assembly in a presentation position.
Figure 20:
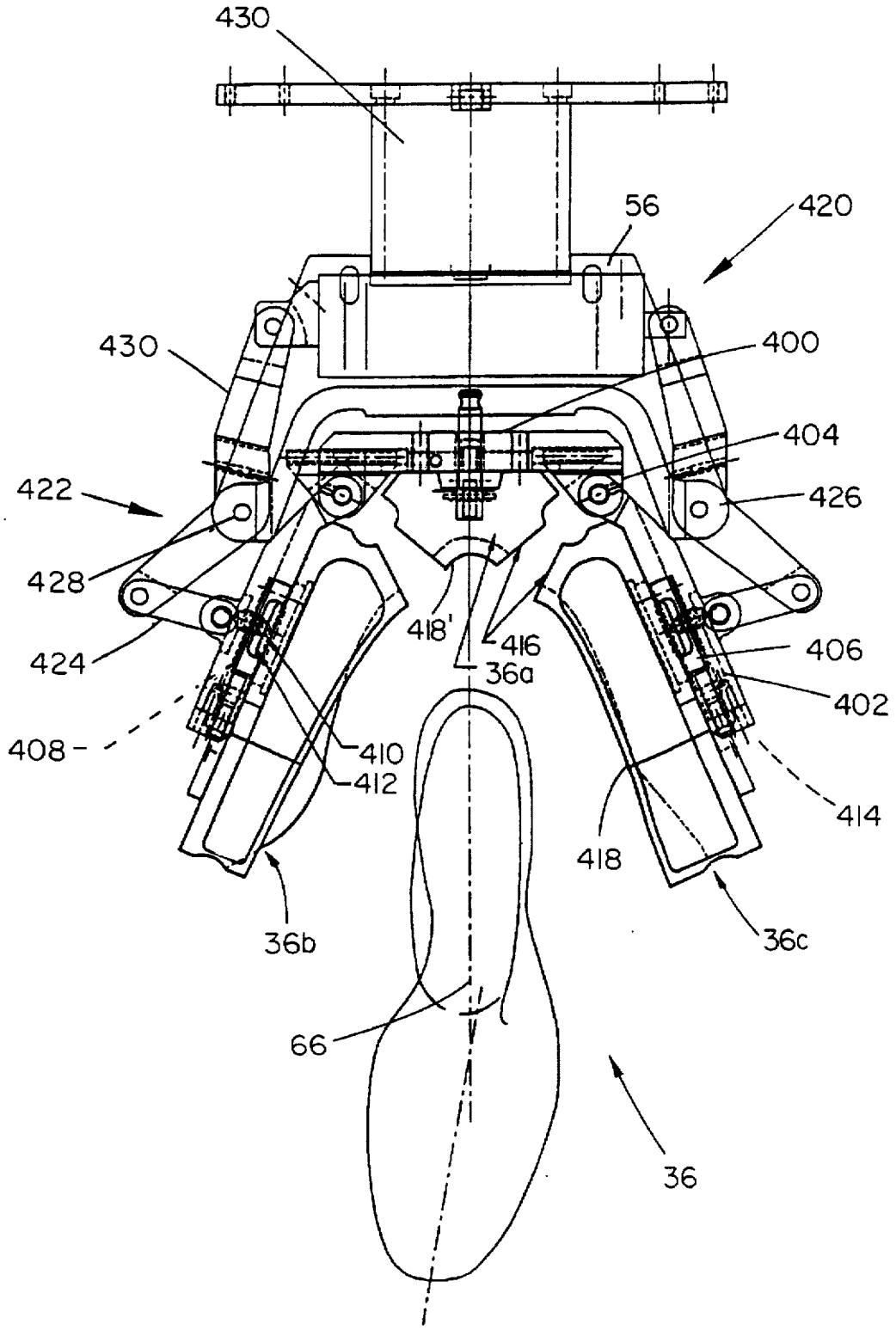
FIG. 20 is a scaled top plan sectional view of the heel clamping pad assembly in retracted and unclamped positions.
Figure 21:
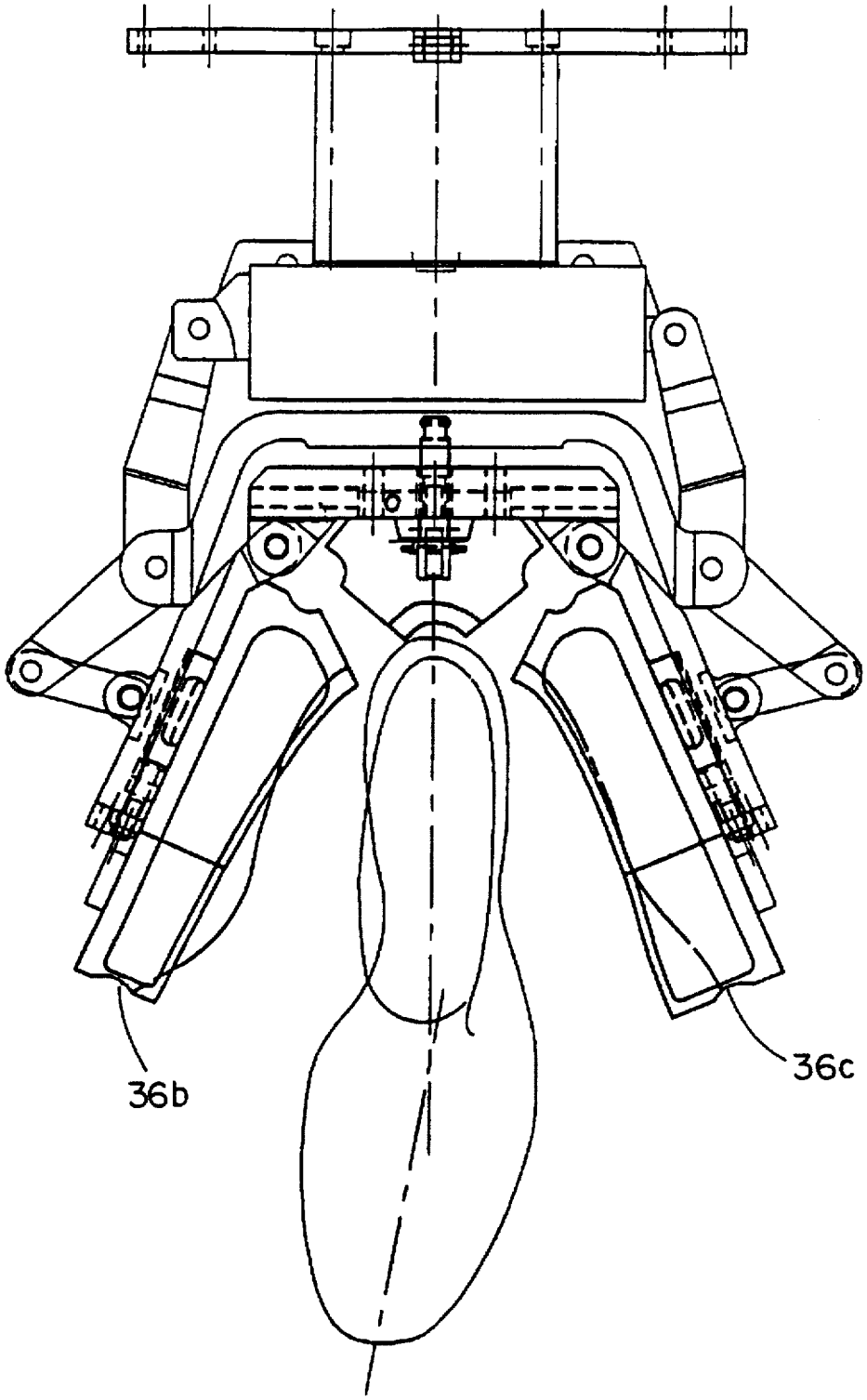
FIG. 21 is similar to FIG. 20 with the heel clamping pad assembly in the presentation position.

FIGS. 20–23 are sequential view illustrations depicting the heel clamping pad assembly 36 through fully clamped engagement with the back and sides of upper 18. In FIG. 20, the heel clamping pad assembly 36 is retracted into the FIG. 15 position. In FIG. 21, heel clamping assembly 36 has been moved forward into its aforementioned presentation position (FIG. 16). In FIG. 22, the center heel pad 36*a* has now clamped against the back of the last. In FIG. 23, the side heel pads 36*b*,36*c* are clamped to the sides of the heel last to complete the heel clamping process. If necessary, self-centering adjustment now occurs (see FIG. 18) to ensure proper positioning of the heel pads on the last 14.

The unique three-part heel clamping pad assembly 36, with particular reference to FIG. 20, is comprised of a center mounting arm 400 to which the center pad 36*a* is fixedly mounted, and a pair of identical side mounting arms 402 respectively pivotally secured to a pair of pivot mounts 404 attached to opposite ends of the center mount. Each side pad 36*b*,36*c* is attached to one of the side pivot arms 402 through a lug 406 attached to the back of the side pad and which is received in an inward facing slot 408 in the pivot arm and slidably retained in the slot with a detent pin 410 providing interconnection by passing through a slide 412 formed in the lug. A spring-loaded plunger 414 mounted in the distal end of each side pivot arm 402 exerts spring pressure against the lug 406 so as to normally urge the associated side clamping pad 36*b*,36*c* towards the center pad 36*a*. Since the abutting surfaces 416 of the side pads 36*b*,36*c* with the center pad 36*a* will enable the inward facing clamping surfaces 418, 418' of the side and center pads to become continuous (FIG. 23) with each other under this advantageous spring loading, it will be appreciated that the center and side pads exert firm clamping pressure against the heel back and sides of the upper 18 without creating a pinching or binding condition that would otherwise disadvantageously wrinkle or mark the upper.

The side pads 36*b*,36*c* are preferably formed from a urethane material filled with a closed cell urethane foam or an inflatable air cavity, or both, which enables the inward facing clamping surface 418 to have a compliant nature that will conform to the shape of the last 14. Furthermore, the feature of securing the side pads 36*b*,36*c* to the side pivot arms 402 with quick release detent pins 410 advantageously enables the pads to be quickly interchanged with like designed pads that are better dimensioned for a particular shoe size.

The feature of forming the heel clamping pad assembly 36 as a three-piece pad having the unique design features described hereinabove allows the side pads 36*b*,36*c* to be pivotally moved away from the shoe (FIG. 1) to provide the operator with an unobstructed view of the lasting area without moving the clamping pad assembly forwardly away from the lasting station in straight line movement by a significantly large distance. Stated differently, the pivotal nature of the three-part assembly 36 allows for compactness without interfering with the operator's ability to load a shoe into the machine 10.

As noted above, the side clamping pads 36*b*,36*c* are pivoted into and out of clamping contact with the shoe through a piston and cylinder 420 located forwardly of the center pad support 400, i.e., behind the center pad 36*a* in a direction extending away from the heel. With reference to FIGS. 20 and 23, the clamping pad actuating cylinder 420 extends and retracts along an axis perpendicular to the heel axis 66 and is interconnected to a respective one of the pivot arms 402 through a linkage mechanism comprised of a bell crank 422 and a short connecting link 424. Each bell crank 422 is pivotally secured to a support bracket 425 (FIG. 15*j*) containing a pair of left and right pivots 426 defining a pivot axis 428 extending perpendicular to the wiping plane 38. Bracket 425 is attached to cam track plate 56 in elevated position above the upper surface thereof with screws 427 and spacer 429 so that the heel and shank wiper are movably disposed below the bracket on the cam track plate. Forward projecting crank arm portions 430 of each bell crank 422 are respectively secured to the cylinder and piston rod 420 in a manner which allows the side clamping pads 36*b*,36*c* to laterally adjust their position to fully clamp the sides of the last 14.

Figure 24:
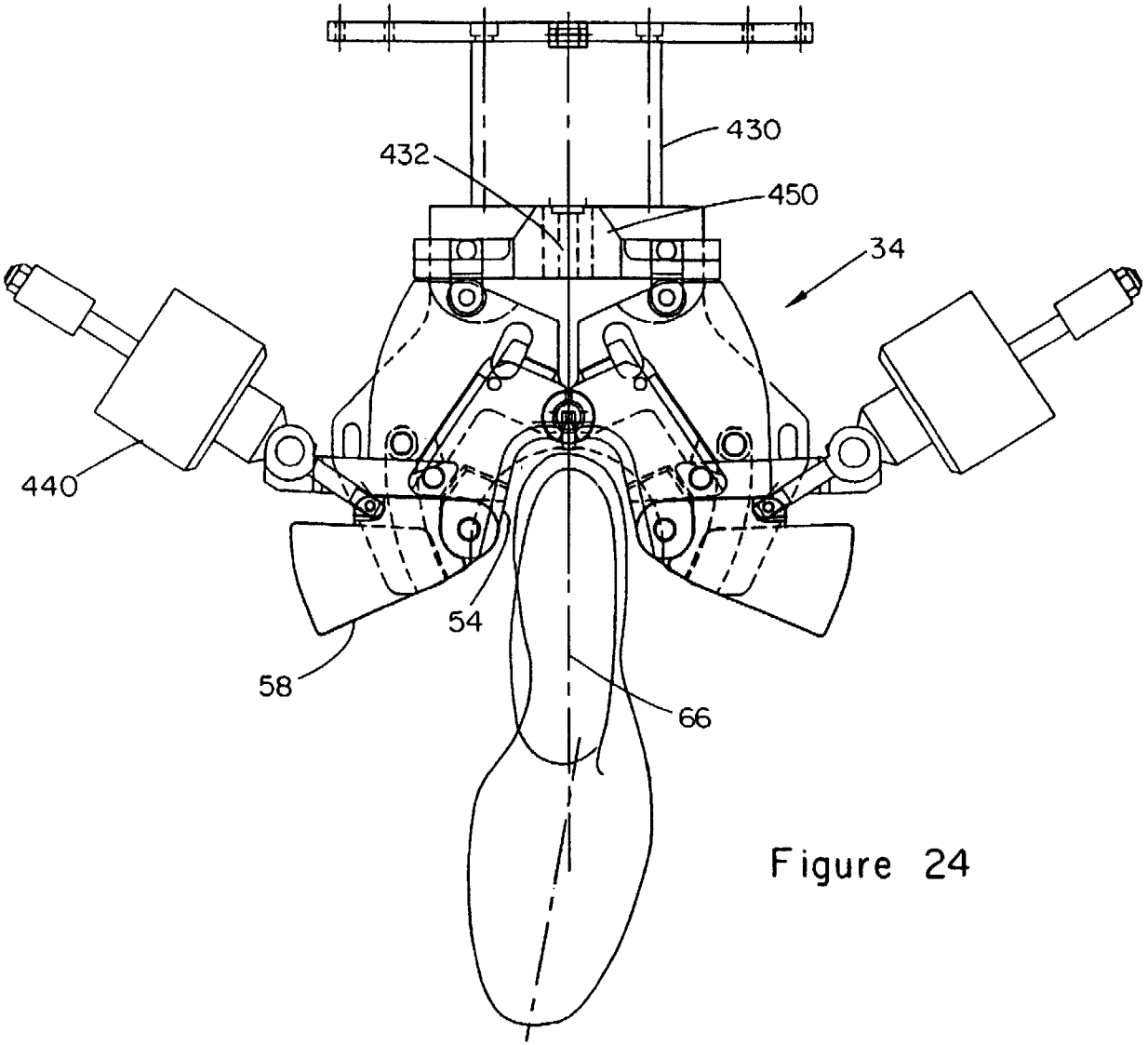
FIG. 24 is a scaled top plan view, partly in section, of the heel wipers in presentation position.
Figure 25:
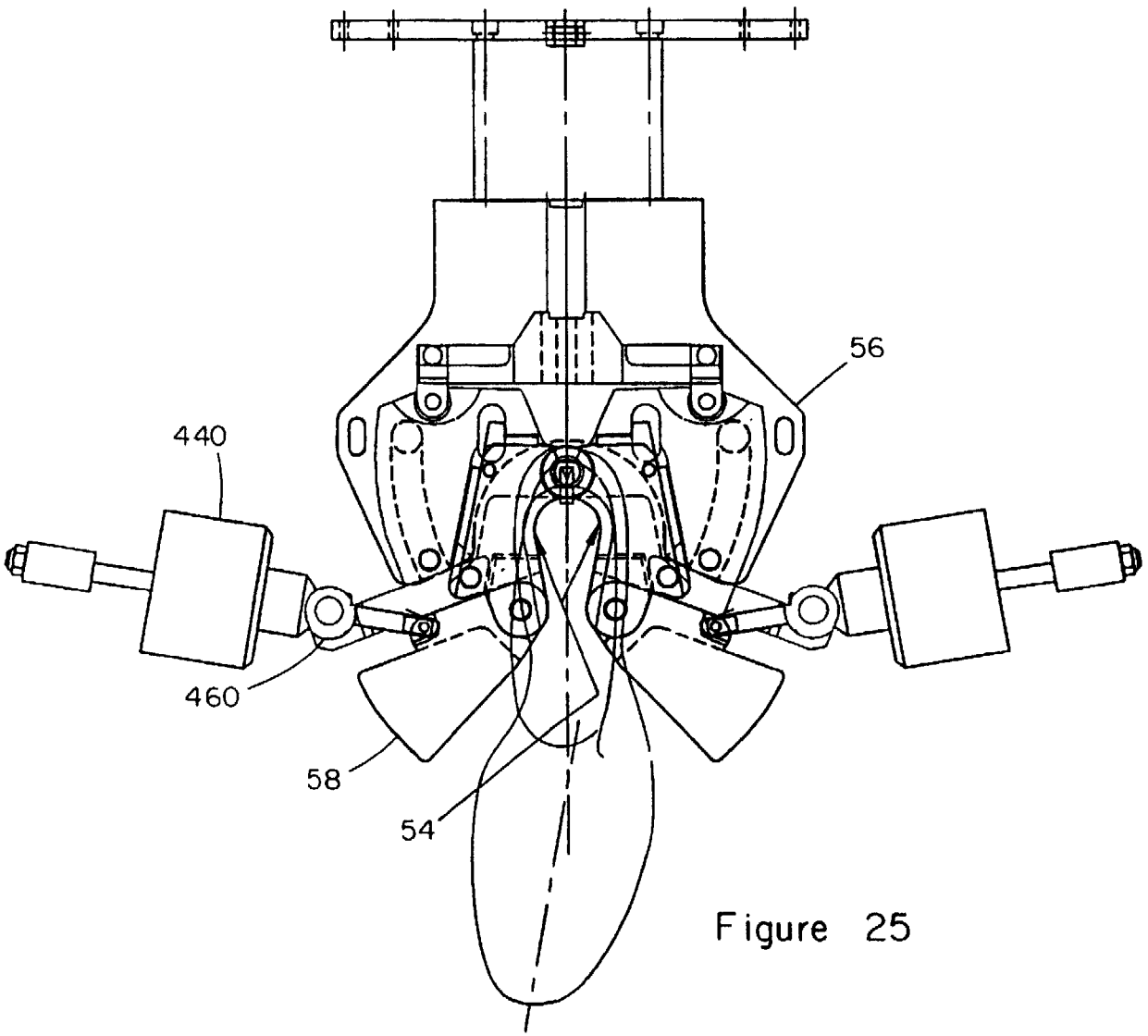
FIG. 25 is similar to FIG. 24 with the heel wipers in fully wiped positions and the shank wipers in unwiped positions.
Figure 26:
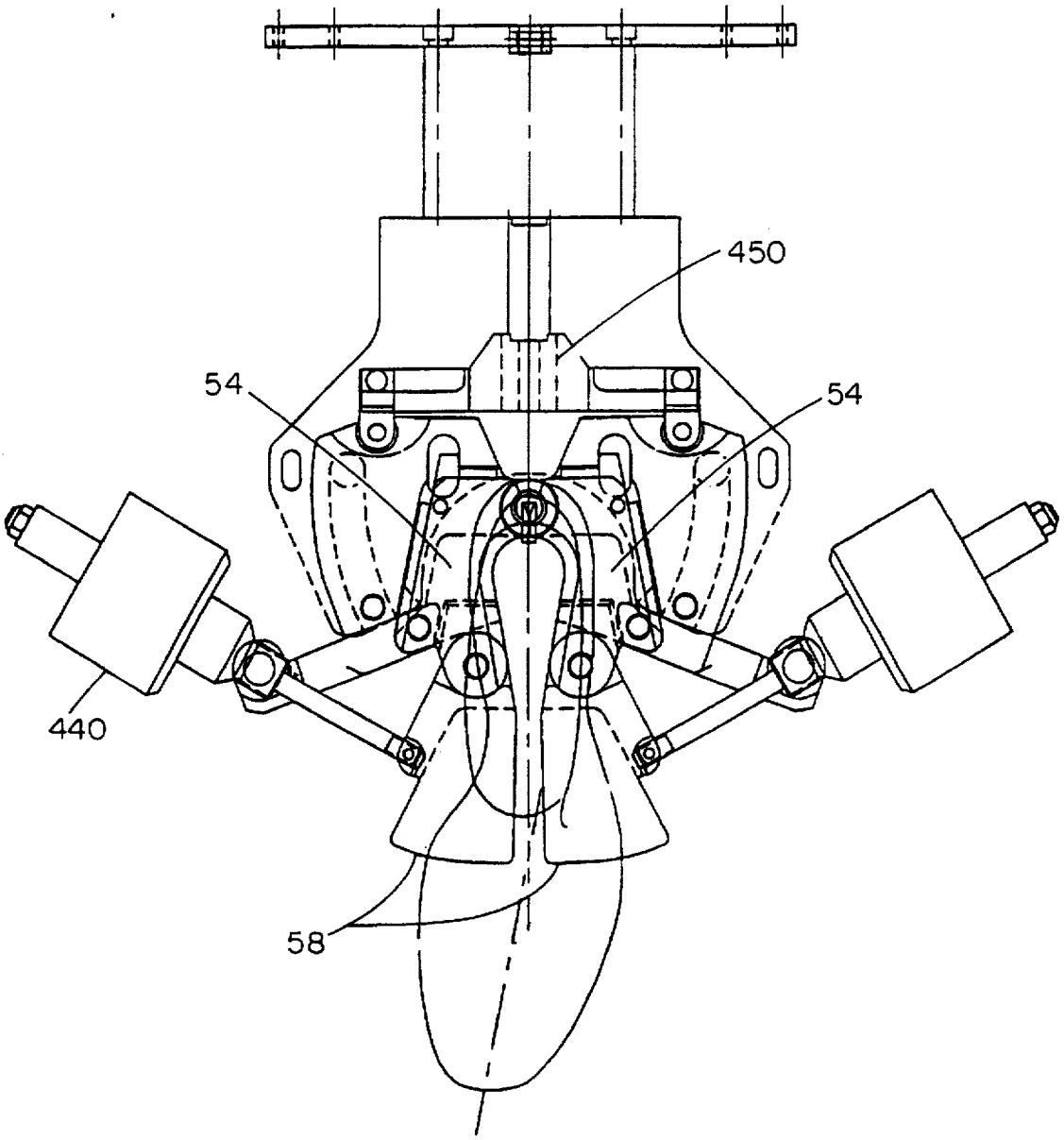
FIG. 26 is similar to FIGS. 24 and 25 with the heel and shank wipers both in fully wiped positions.

FIGS. 24–26 are sequential view illustrations depicting the manner in which the heel and shank wipers are advanced into wiping contact with the respective heel and shank portions of upper margin portion 20. In FIG. 24, the heel has been clamped with heel clamping pad assembly 36 and the heel wipers 54 are now ready to advance under the action of the heel wiper actuating cylinder 430 (see also FIG. 15) having a piston rod 432 which extends to drive the heel wiper retainers 434 (which are pivotally connected to each other at inboard regions thereof with a pivot pin 435, see FIG. 29) rearwardly towards the heel under the camming action of cam track slots 436 formed in the stationary cam track plate 56 (FIG. 31) mounted beneath the wipers.

In FIG. 25, the heel wipers 54 have advanced along the heel wiping plane 38 to wipe the heel. The shank wipers 58 remain in the open position. The toe post 244 is lowered to its third stage drop position and the shank wipers 58 are now closed by the shank wiper actuating cylinders 440 without colliding with insole support 28 in its third stage drop position.

In FIG. 26, the shank wipers 58 are in their fully wiped position to finish wiping the upper 18. The heel clamping pad assembly 36 is now allowed to relax by removal of pressurized air from the clamping pad actuating cylinder 420. Heel bedding pressure can now be applied and, thereafter, all of the aforementioned mechanisms can now be sequentially returned to their respective inoperative positions in the reverse order of actuation.

Heel bedding pressure is achieved with the use of a heel hold-down mechanism 500 depicted, for example, in FIG. 15. The heel hold-down mechanism 500 includes a hold-down member or roll 502 mounted to a cylinder operated crank arrangement generally designated with reference numeral 504. An intermediate portion of crank mechanism 504 is pivotally supported at a fulcrum 506 extending upward from the cam track mounting plate 56 and which may be attached thereto through a bracket arm 508. The forward end of crank mechanism 504 is pivotally connected through a clevis 510 to a cylinder operated piston rod wherein the lower end of the associated cylinder 512 is pivotally attached to the mounting base 370 with a bracket 514. An appropriate signal from the programmable controller 72 extends the piston rod from the solenoid actuated cylinder 512 to pivot the hold-down 502 into clamping engagement with a top portion of the upper 18 (not shown in detail) in a position proximate to or overlying the heel portion of the insole. This applies a positive downward force that counteracts the upward reaction forces of the heel and shank wipers 54,58 during wiping and allows heel bedding pressure to be applied as aforesaid.

It is preferred to mount the heel hold-down mechanism 500 to the heel wiper assembly to isolate the forces generated during heel wiping from the toe wiper assembly. However, as alternately depicted in FIG. 1, for example, the heel hold-down may be mounted to the toe hold-down support and appropriately cylinder actuated to contact the upper 18 at a point overlying the heel portion of the insole.

Figure 27:
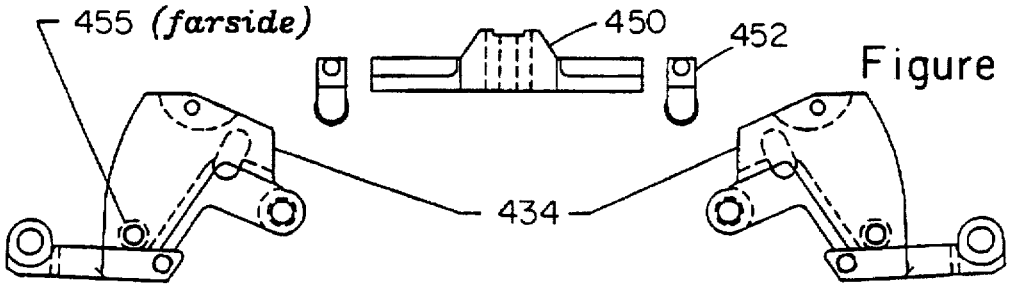
FIG. 27 is a scaled and exploded top plan view of various components of the heel wiping mechanism.
Figure 28:
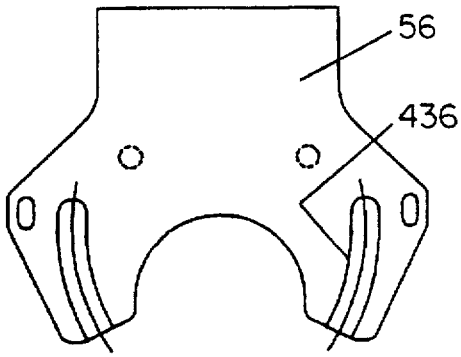
FIG. 28 is a scaled top plan view of the heel wiper cam track plate.

FIGS. 27–33 are top plan view illustrations of the component parts forming the heel wiper and shank wiper sub-assemblies. The heel wiper actuating cylinder 430 is mounted to the cam track plate 56 and the cylinder rod 432 thereof is connected to the actuating member 450 depicted in FIG. 27 for driving movement in a plane extending parallel to the heel wiping plane 38. The piston rod 432 preferably travels in substantially coaxial alignment with the heel axis 66. The pair of wiper retainers 434, individually depicted in FIG. 27, are pivotally interconnected to opposite ends of the actuating member 450 with a pair of pivot mounts 452. A cam follower bearing 455 projects downwardly from each of the heel wiper retainers 434 and is received in a respective one of the cam track slots 436.

Figure 29:
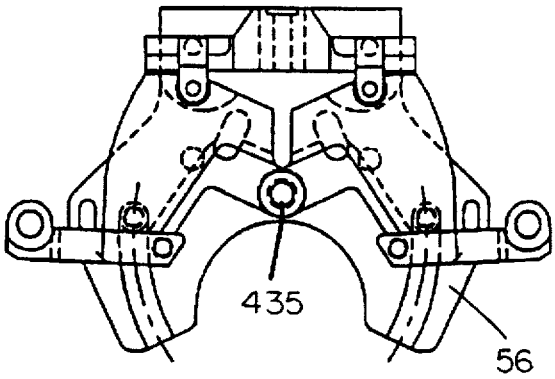
FIG. 29 is a top plan view depicting the components of FIGS. 27 and 28 in assembled relation in the unwiped position.
Figure 30:
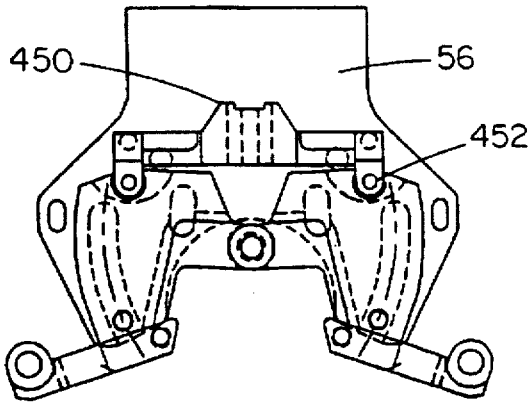
FIG. 30 is similar to FIG. 29 depicting the components in the heel wiped position.

The aforementioned sub-assembly is depicted in a fully retracted position in FIG. 29 and in a fully extended position (see also FIGS. 25 and 32) in FIG. 30 wherein the heel wipers 54 are fully extended by the advancing actuating member 450.

FIG. 31A is an exploded top plan view of the wiper retainer 434, heel wiper 54, and shank wiper 58. FIG. 31 depicts the heel wiper 54 and shank wiper 58 connected to the cam controlled wiper retainer 434 in the assembled, retracted position. FIG. 32 illustrates the heel and shank wiper assembly with the heel wipers in the extended position and the shank wipers retracted, while FIG. 33 depicts both the heel and shank wipers in their fully extended positions. It is to be noted that the shank wiper cylinder 440 is pivotally connected to the wiper retainer 434 through a pivot mount 460 with the inwardly extending shank wiper piston rod 462 pivotally connected to the shank wiper 58 at an outboard region thereof. Further note that the forward end of the shank wiper 58 (i.e., in the direction away from the heel) is pivotally connected to the rear end of the associated heel wiper 54. The top surfaces of the heel and shank wipers define the heel wiping plane 38.

In accordance with another unique feature of this invention, the shank wiper piston rod 462 is also formed with an outwardly extending piston rod portion 463 (see, e.g., FIGS. 32 and 33) to which a threadedly movable adjustment mounting 465 is attached to regulate the inwardmost movement of piston 462 and thereby the extent of wiping achieved with the shank wipers 58 to accommodate different shoe sizes and shapes.

Figure 31B:
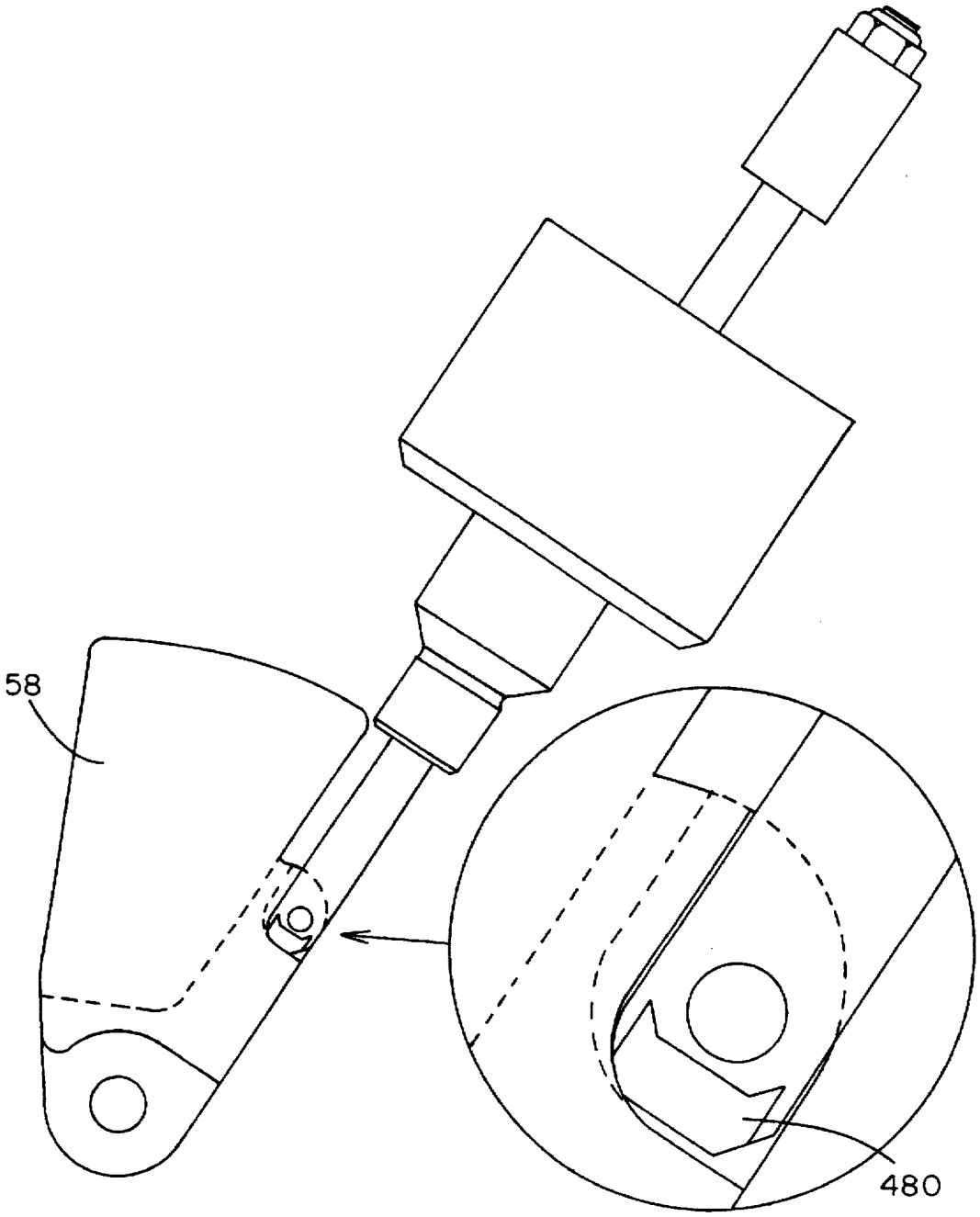
FIG. 31B is a bottom view, partly in section, depicting a quick disconnect feature of the shank wipers.
Figure 31C:
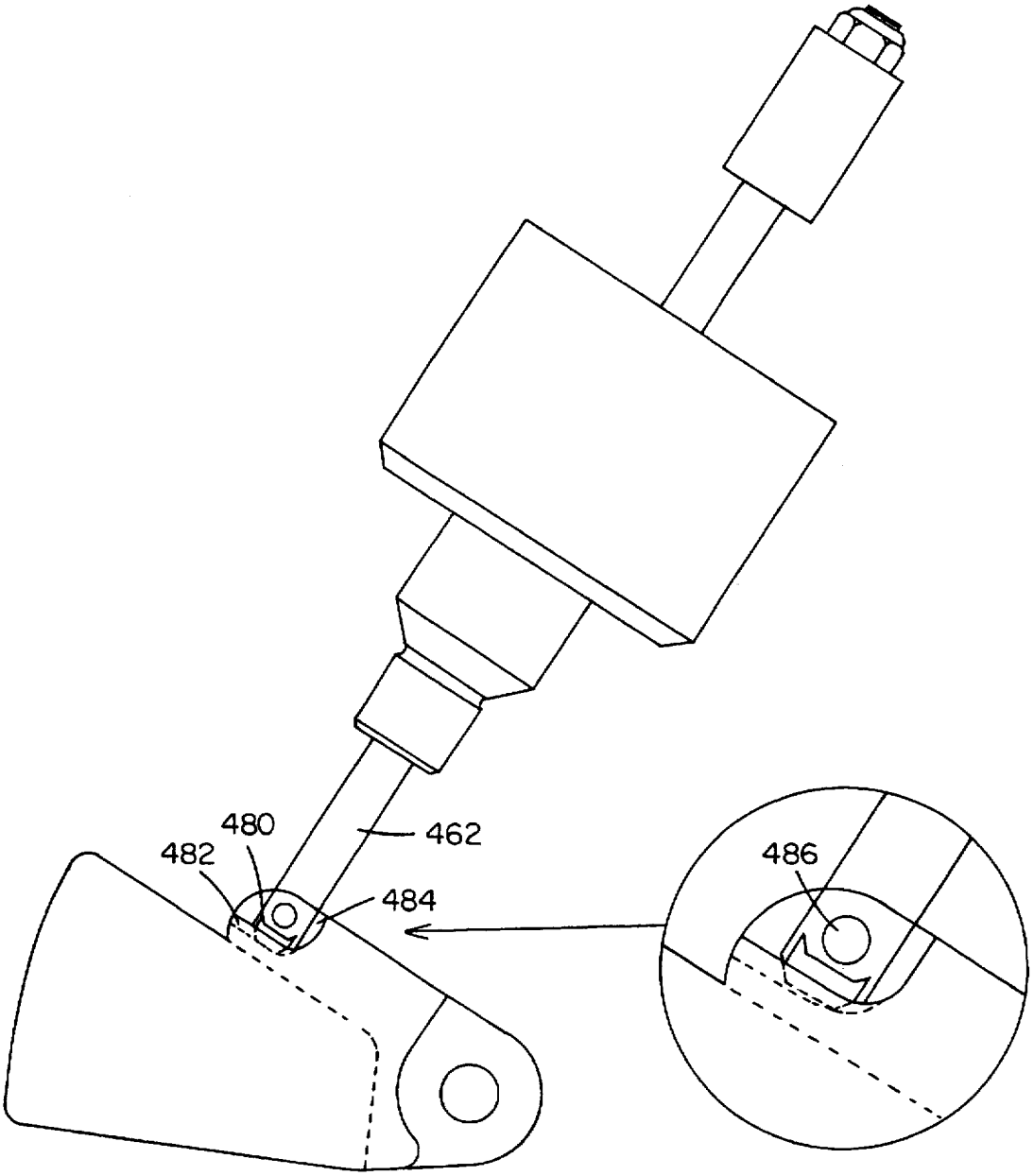
FIG. 31C is a view similar to FIG. 31B depicting the quick disconnect in a connected position.

With reference to FIGS. 31B and 31C, it can be seen that the inwardmost end of shank wiper piston rod 462 is formed with a lip 480 adapted to be engaged beneath a ledge 482 formed within a mounting slot 484 within an outboard mounting portion of the shank wiper. In the FIG. 31C position, the shank wiper ledge 482 is fully engaging the rod lip 480 and the cylinder rod 462 is pinned within recess 484 with a pin 486 welded to the shank wiper. In the FIG. 31B position, the shank wiper 58 is rotated into an extreme outboard position whereupon the lip 480 disengages from the ledge 482 to enable the shank wiper to be easily removed from the piston rod 462 upon removal of the pin. This mechanism functions as a quick disconnect without the need for screw type fasteners.

It is often desirable to impart an inward pulling movement to the ball or shank regions of the upper margin portion 20 during upper stretching with the pincer assemblies 26 to more efficiently and tightly wrap the upper 18 around the last 14 prior to wiping. To achieve this foregoing object, in accordance with an improvement feature of the preferred embodiment and as best depicted in FIGS. 36–45, the array of pincer assemblies 26 is mounted to a pair of pincer plate assemblies, generally designated by reference numeral 600, which is capable of adjustment during machine setup to accommodate particular shoe sizes and styles. The assemblies 600 are actuator controlled during the actual lasting process to pivot the pincer array 26 inwardly beneath the insole 16 in the X-Y plane to obtain a tighter wrap around the last 14 especially in the ball area of the shoe prior to wiping.

Figure 36:
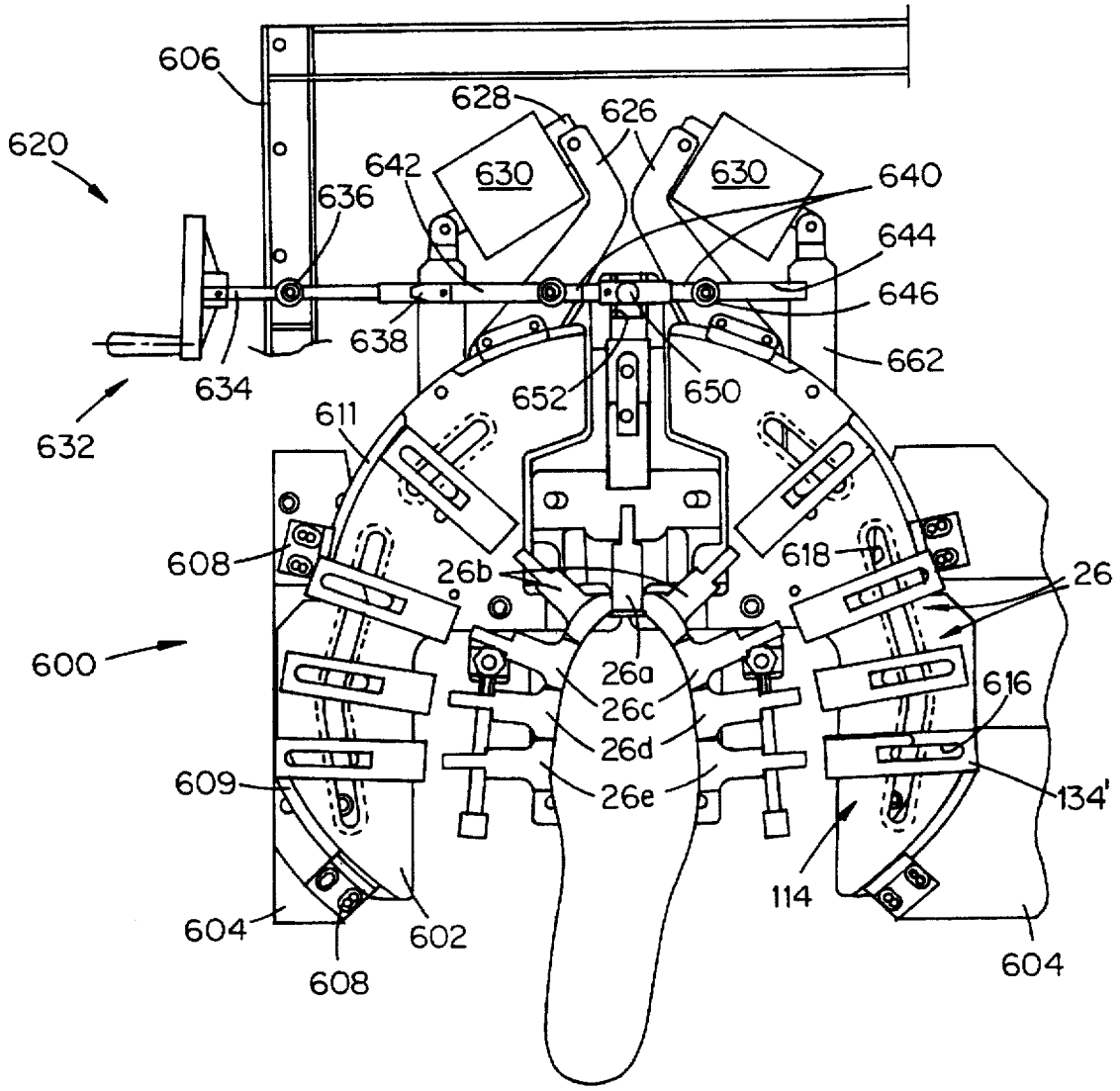
FIG. 36 is a top plan view of an improvement feature to the preferred embodiment for in-process movement of the pincer array to further stretch the upper around the last before wiping.
Figure 37:
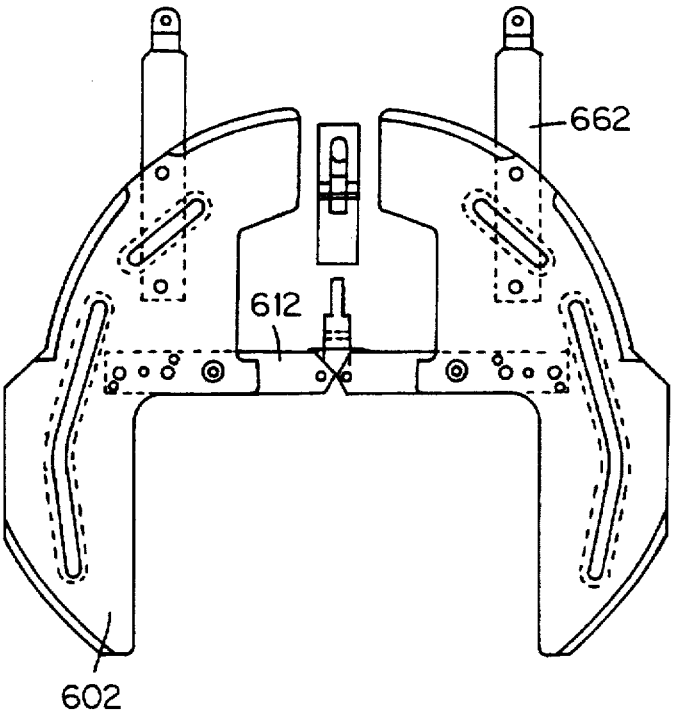
FIG. 37 is a top plan view of pivotally mounted pincer plate assemblies used in the improvement of FIG. 36.
Figure 40:
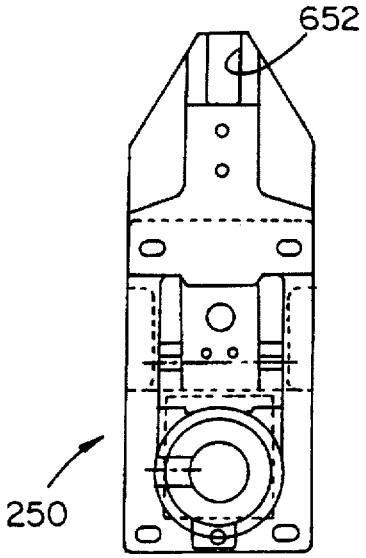
FIG. 40 is a top plan view of the toe post assembly to depict the relative location of the pincer plate movement system of the invention in relation to the toe post assembly.
Figure 38:
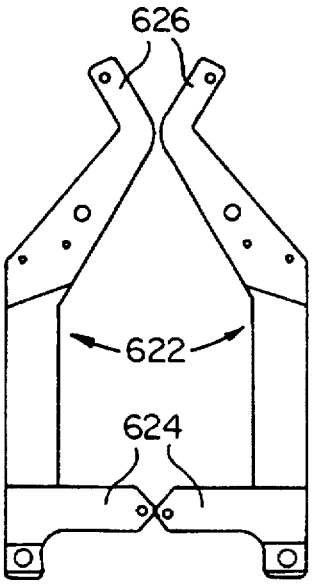
FIG. 38 is a top plan view of pincer plate manual adjustment links.
Figure 44:
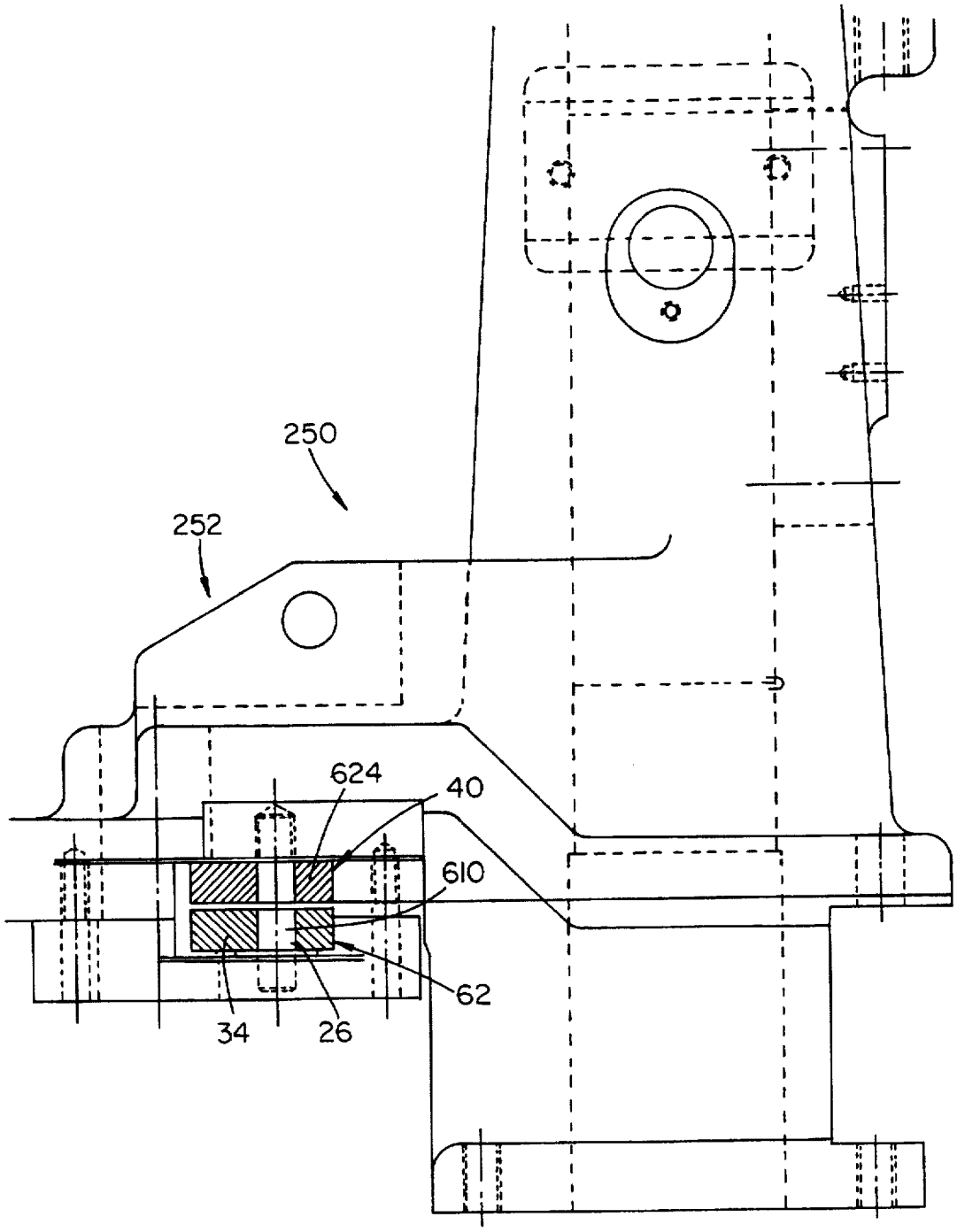
FIG. 44 is an elevational view, partly in schematic and sectional form, to depict the pivotal mounting of the pincer plates to the toe post housing.

With reference to FIGS. 36 and 37, each pincer plate assembly 600 is comprised of a pincer mounting plate 602 mounted respectively to a stationary support plate 604 fixed to the machine frame 606. Each pincer mounting plate 602 is located for pivotal movement within the X-Y plane (i.e., parallel to the wiping plane 32) by means of two retainer brackets 608 which are bolted to the support plate 604 to slidably engage the outer peripheral arcuate edge 609 and 611 of each mounting plate during the aforesaid pivotal movement. A pivot bar 612 is rigidly bolted to an associated one of the pincer mounting plates 602 and projects inwardly in the x-axis direction for pivotal attachment to a distal end thereof to the toe post housing 250 with a pivot pin 610 extending along the z-axis as best depicted in FIGS. 37, 40 and 44 (compare also the FIG. 44 improvement with FIG. 4). In this manner, the pair of pivot pins 610 pivotally mount the respective pincer plates 602 to the toe post assembly 250 in a casting portion 252 thereof, enabling each pincer plate to pivot within the X-Y plane about the pivot axes extending along the z-axis with the retainers 608 preventing pincer plate movement in the z-axis.

The pincer assemblies **26*a*–26*e* constituting the pincer array may be identical in construction to the pincer assemblies 26 depicted in FIGS. 4–6 and may be mounted to the associated pincer plate 602 utilizing the support bracket 114 and above-described linkage and drive cylinder arrangements described hereinabove (it will be understood that other pincer support bracket and drive configurations may be used for this improvement), with the exception that the lower end 134 of the support bracket 114 is modified to include an elongate slot 616 (the lower ends thereby being designated with reference numeral 134') adapted to receive a bolt (not shown in detail) having a lower end extending in the Z direction through an adjustment slot 618 formed in each pincer mounting plate 602. This slotted arrangement 616,618 permits gross manual adjustment of each pincer assembly 26*a*–26*e* during machine setup to locate the pincers in proper position with fine manual adjustment being provided through a manual adjustment mechanism 620** described more fully below.

Figure 39:
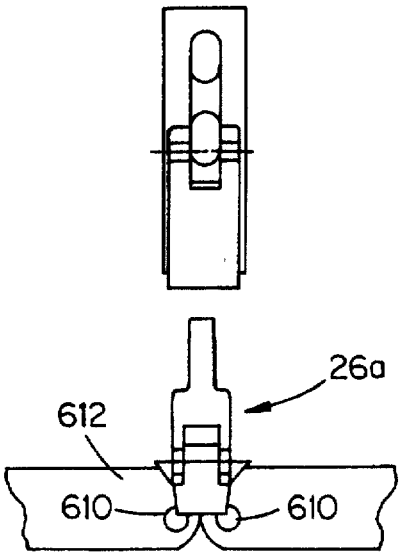
FIG. 39 is a top plan view, partly in schematic form, to depict the location of the pincer plate pivot axes relative to the toe pincer.

The pincer array may comprise a toe pincer **26*a*, two corner pincers 26*b*, two pairs of side pincers 26*c*,26*d* and two ball pincers 26*e* which are preferably adjustably mounted through adjustment slots 616,618 such that the pincer jaw tips approximate the shape of the largest insole of the style of shoe to be manufactured. In accordance with an important feature of the invention, the pivot axes of pivot pins 610 are respectively coincident with the corners of the toe pincer 26*a*, as best depicted in FIG. 39, so that as the pincer plates 602** and their associated bank of pincers rotate about the associated pivot axis, such rotation occurs with respect to the corners of the toe pincer.

The improvement further features a pair of pincer plate manual adjustment arms 622 (FIG. 38), which are moved with manual adjustment mechanism 620 in the unique manner described below to locate the pincer for lasting a particular shoe size. Each arm 622 is rigidly bolted to the associated pincer plate 602 and includes an inwardly extending pivot link 624 having a distal or inwardmost end attached to an associated one of the pivot pins 610 in juxtaposition to the pincer plate pivot bars 612 as best depicted in FIG. 44. The rearwardmost end 626 of each manual adjustment arm 622 is pivotally connected through a clevis 628 to one end of a pneumatic actuator 630 (preferably a double acting air cylinder).

The manual adjustment mechanism 620 cooperates with the pincer plate manual adjustment arms 622 in order to manually adjust the positions of the pincer array **26*a*–26*e* during machine setup to last a specific shoe size once the individual pincers have been adjusted via their slotted connections 616,618 to manufacture a particular shoe style. With reference to FIG. 36, the manual adjustment mechanism 620 comprises a hand wheel 632 connected to rotate a shaft 634 that is mounted to the machine frame 606 through a slide pivot 636. The shaft 634 is interconnected through a universal joint 638 to a positioning screw 640 having a left-handed threaded section 642 and a right-handed threaded section 644 in respective engagement with similarly threaded positioning nuts 646. The positioning screw arrangements 642,644 are maintained in alignment with the center line of the pincer array 26*a*, 26*e* through a center line locator 650 disposed in a manual adjust mechanism locating slot 652 formed on the toe post housing 250**.

To effect manual adjustment, hand wheel 620 is rotated which transmits rotation to the left and right-handed positioning screw sections 642,644 through shaft 634 and universal joint 638. Since the center line locator 650 is restrained along the x and z axes by the manual adjust mechanism locating slot 652, the positioning nuts 646 and thereby the associated manual adjustment arms 626 are constrained to either spread apart or move toward each other in the X direction. This movement causes the associated pincer plates 602 to rotate or pivot respectively about pins 610 to adjust the pincer array in a narrower or wider pattern.

Figure 41:
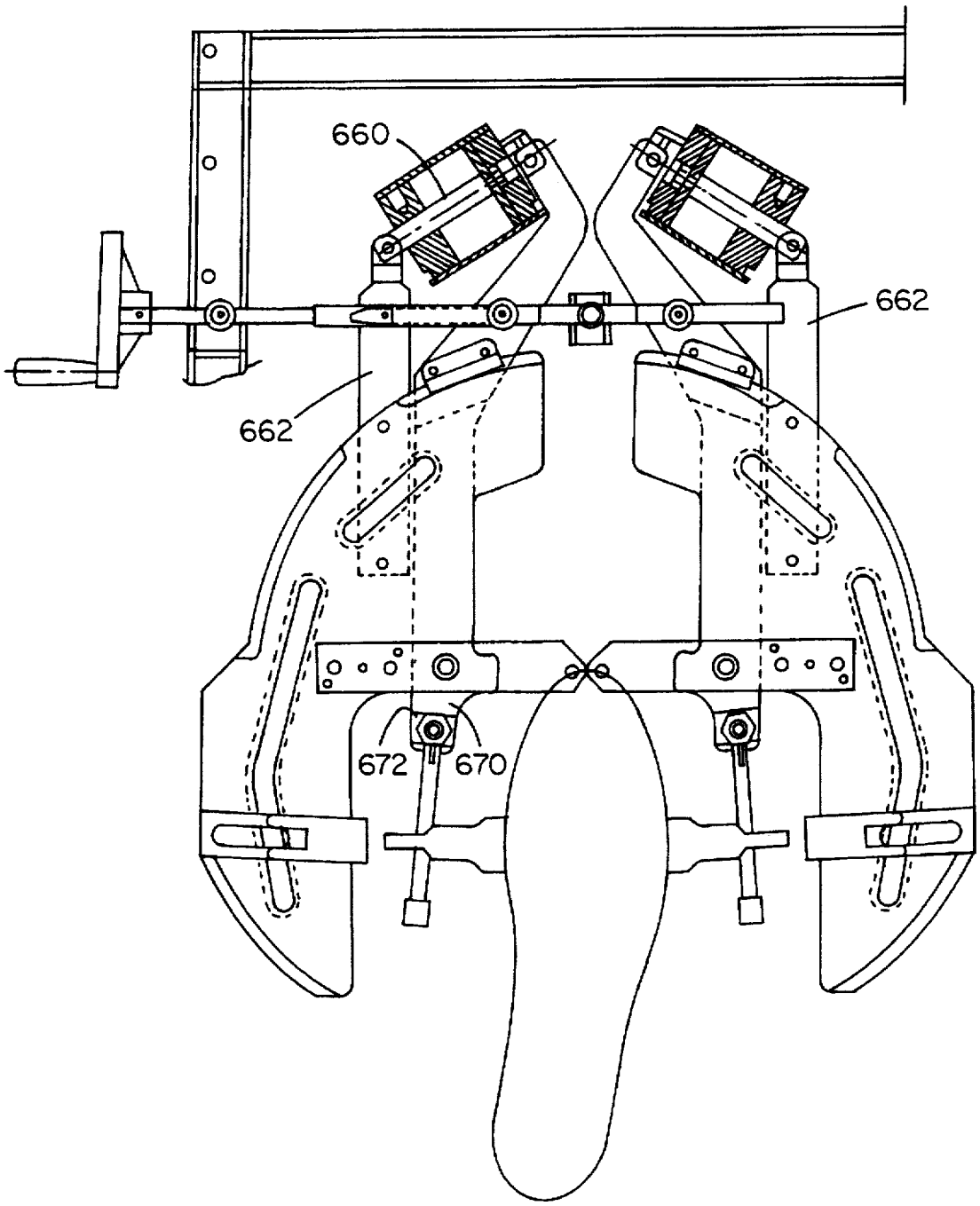
FIG. 41 is a top plan view of the improvement with numerous components omitted to illustrate the connections of the manual adjustment mechanism to the pincer plates, and further showing the pincers manually adjusted into a maximum width position.
Figure 42:
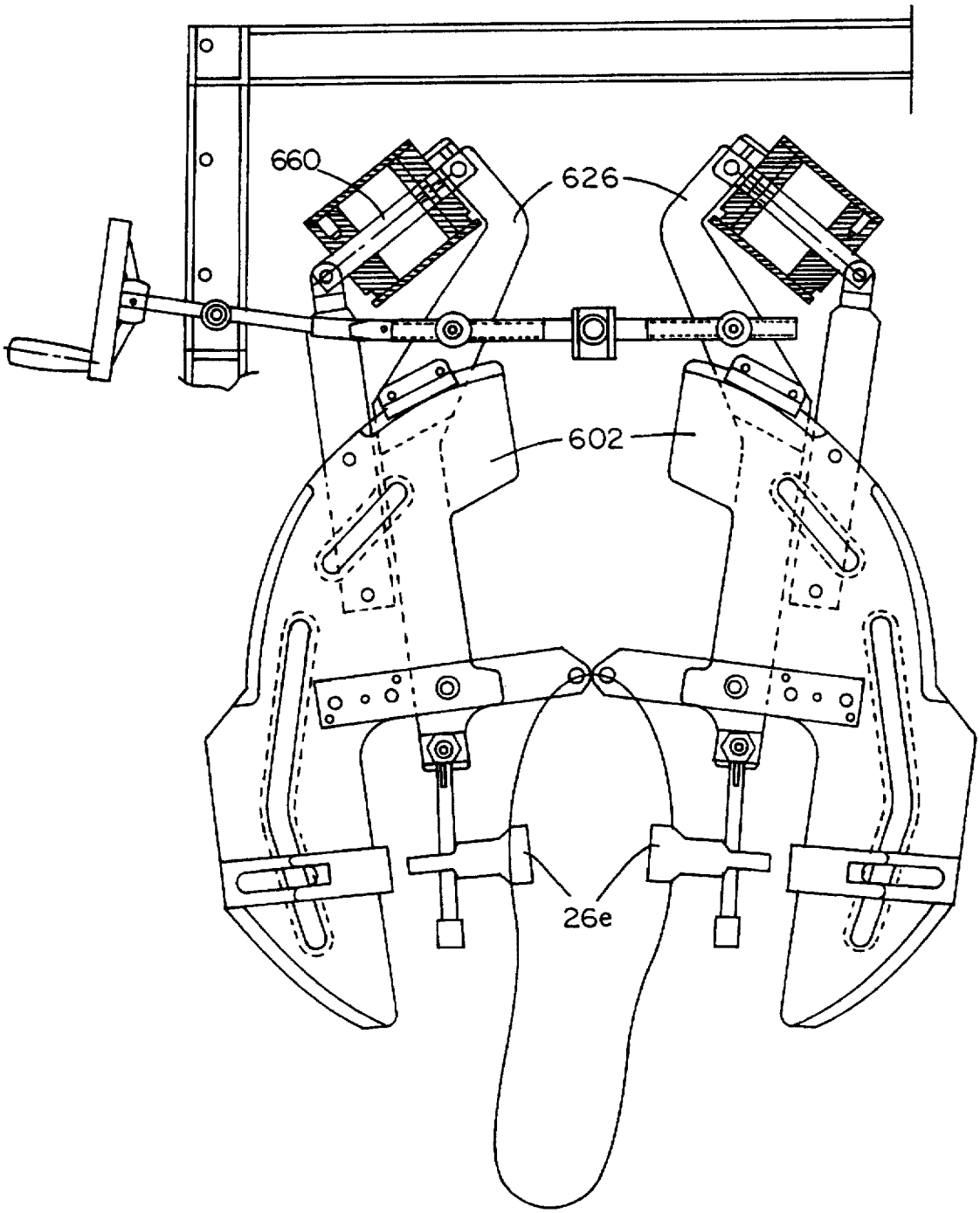
FIG. 42 is a view similar to FIG. 41, depicting the pincers adjusted into a minimum width position.

FIG. 42 is an illustration of the pincer plates 602 which are spread apart to locate the pincer array **26*a*–26*e* in a minimum width pattern. The manual adjustment arms 626 are located a maximum distance from each other so that the pincer banks are pivoted toward each other during machine setup. In FIG. 41, manual adjustment mechanism 620 sets the arms 626** to a minimum spaced position to set the pincer array to its maximum width position.

In order to rotate the banks of pincers **26*b*–26*e* inwardly below the insole 16 to obtain a more efficient wrap, the forward end of each actuator piston rod 660 is pivotally connected to the rear end of a positioning link 662 which extends in the Y direction and has a forward end bolted to an associated one of the pincer support plates 602. With this arrangement, extension of the actuator piston rods 660 from the FIG. 42 to the FIG. 43 position, causes each pincer support plate 602 to pivot about its respective pivot axis 610 as a result of movement of the positioning links 662. The rear end of each actuator 630 remains stationary in its present position achieved with manual adjustment mechanism 620 to enable the pincer array to move inwardly underneath the insole 16 and provide a tight wrap between the upper margin 20 with the last 14**, particularly in the ball regions thereof.

Figure 43:
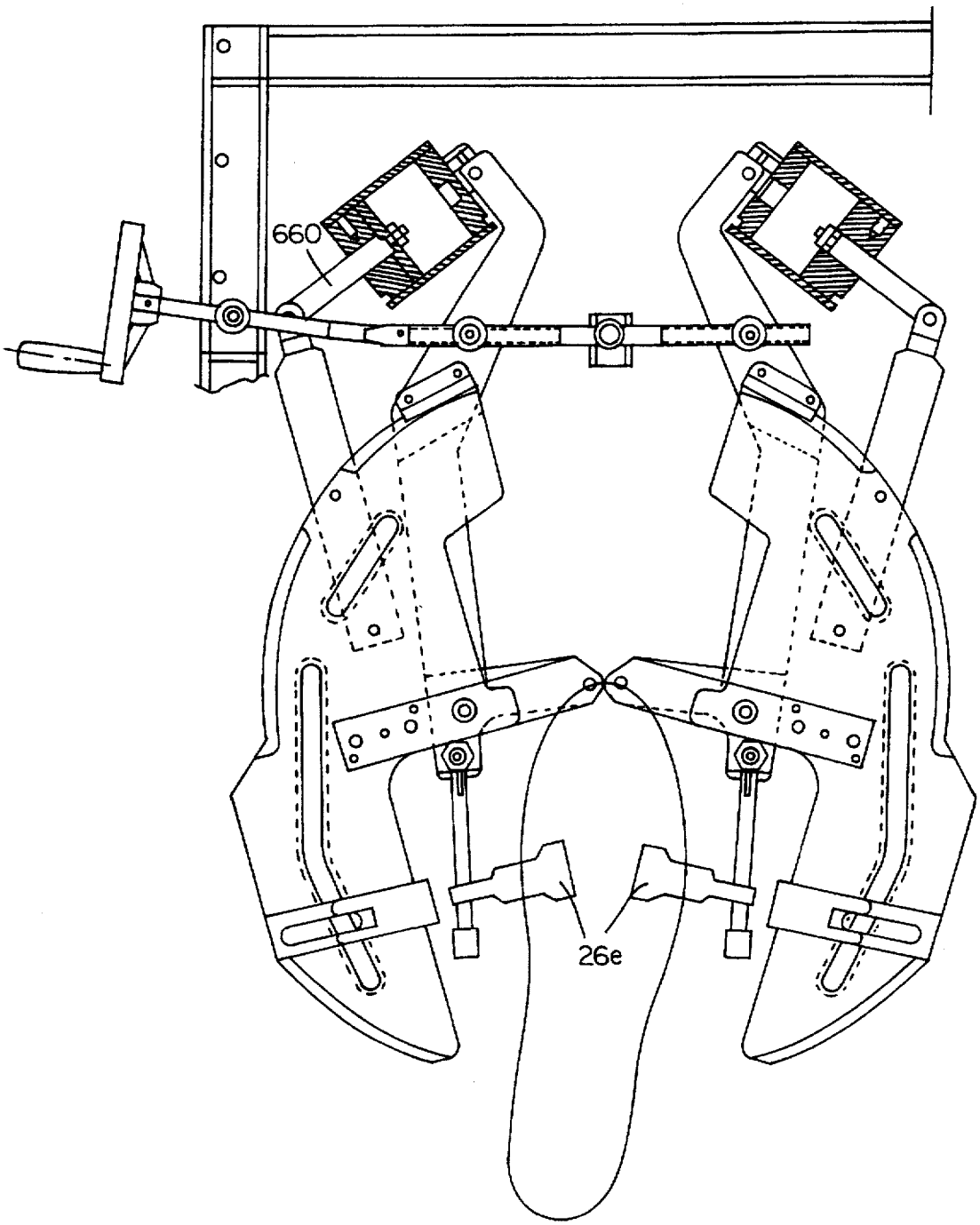
FIG. 43 is a view similar to FIG. 42, depicting the relative locations of the ball pincers beneath the insole to stretch the upper prior to wiping.

In accordance with a further feature of this invention, the inwardmost extent of pincer movement is controlled by means of a gap 670 formed between the tip of a pneumatic adjustment limit screw 672 and the associated pincer plate pivot bar 612. The amount of gap 670 is adjustable whereby turning of the limit screw 672 in the clockwise direction will reduce the gap to limit the extent of inward movement of the pincer arrays prior to wiping. The inwardmost extent of pincer movement is depicted in FIG. 43 wherein the pivot link has bottomed out against the tip of adjustment screw 672.

The foregoing improvement advantageously allows the margin portion 20 of the upper 18 to be drawn under the last 14, via rotation of the pincer support plates 602 in the manner described above, before the wipers wipe under the last. This feature pre-forms the upper somewhat and initiates a tight wrap around the last, particularly in the ball area of the shoe.

Other advantages occur as a result of the improvement to the preferred embodiment. For example, since the pincers **26*b*–26*e* are moved inwardly under the insole 16, the wipers are able to be moved into initial wiping contact with the upper margin 20 before release of and without colliding with the pincers. Additionally, with the invention, it is now possible to form the toe wipers 46 to be somewhat oversized in the ball wiping regions 46*a* (see FIG. 45) thereof so that the innermost wiping edges can rotate approximately 4° underneath the insole 16 when pivoted into the profile position to achieve wiping contact prior to pincer release (compare with the profile position of the wiping elements depicted in FIG. 10**A without the pincer plate improvement described, supra).

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. For example, the solenoid actuating cylinders operating the various mechanisms of the invention noted hereinabove may be substituted with electro-servo motors or other mechanisms capable of generating a reciprocating stroking movement as will occur to one of ordinary skill. In addition, the linkage arrangements disclosed hereinabove (e.g., the dual link mechanism of pincer assemblies 26) may be replaced with cam mechanisms for generating the desired movement or function to the extent same is feasible from a cost and engineering standpoint. Likewise, by way of example only, it is possible to replace the cam tracks 60,62 and cam follower arrangement with a linkage mechanism connected at upper ends thereof to the axis of rotation 62 and at lower ends to the heel carriage to enable adjustment of the heel wiping plane. Furthermore, it may be desirable to incorporate adhesive applicator assemblies within machine 10 instead of relying upon pre-cemented margins.

It is therefore intended that the protection granted hereon be limited only by the definition contained in the appended claims and equivalents thereof.

I claim:

1. A shoe lasting machine, operable on a footwear assembly including a last having an insole located at its bottom and an upper mounted thereon with an upper margin extending around the insole, comprising:

(a) a footwear assembly support, mounted to a machine frame, to support the footwear assembly;

(b) a toe wiper assembly including a plurality of toe wipers mounted to the machine frame for movement along a Y-axis in a toe wiping plane extending in an X-Y plane to press toe, side and ball portions of the upper margin against the insole bottom;

(c) an array of pincer assemblies positioned around the toe, side and ball portions of the footwear assembly, each pincer assembly including a pair of jaws adapted to receive part of the upper margin;

(d) means for lowering the clamped pincer assemblies along a Z-axis relative to the toe wiping plane to stretch the upper around the last; and (d) means for pivoting the clamped pincer assemblies during a lasting cycle about an axis parallel to the Z-axis to positions inwardly of and beneath an edge of the insole to tightly wrap the stretch upper margin around at least ball regions of the last.

2. The lasting machine of claim 1, wherein said pivoting means includes a pair of pincer mounting plates to which said pincer assemblies are mounted.

3. The lasting machine of claim 2, wherein said pincer assemblies include a toe pincer and wherein the pivot axis of each plate is coincident with a respective one of two corners of the toe pincer located substantially along a longitudinal axis of the insole bottom.

4. The lasting machine of claim 3, wherein said pincer assemblies each have an adjustable mounting for adjustable positioning during machine setup via movement relative to its associated plate for location of the pincers to accommodate a particular shoe style.

5. The lasting machine of claim 2, further comprising adjustment means for pivoting the plates during machine setup about the respective pivot axis to adjust the width pattern of the pincer assemblies to accommodate a particular shoe size.

6. The lasting machine of claim 5, wherein said pivoting means further includes actuator means respectively interconnecting the mounting plates to the machine frame, and control means for operating said actuator means to pivot the pincer assemblies into the aforesaid positions inward of and beneath the insole edge during the lasting cycle.

7. The lasting machine of claim 6, wherein said adjustment means includes a manual adjustment mechanism for adjusting the position of each actuator means prior to lasting to thereby positionally adjust the pincer assemblies to accommodate a particular shoe size via pivotal movement of said plates.

8. The lasting machine of claim 1, further comprising stop means for adjustably limiting the extent of inward movement of said pincers prior to wiping.

9. The lasting machine of claim 1, wherein said toe wipers include enlarged, inwardly extending wiper portions adapted to wipe in the ball regions of the upper margin and being positionally located to extend inwardly of the insole edge when said toe wipers are moved into a profile position.

10. The lasting machine of claim 1, further comprising a heel wiper assembly including a plurality of heel wipers mounted to the machine frame for movement in a heel wiping plane to press a heel portion of the upper margin against the insole bottom.

11. A shoe lasting machine, operable on a footwear assembly including a last having an insole located at its bottom and an upper mounted thereon with an upper portion extending around the insole, comprising:

(a) a footwear assembly support, mounted to a machine frame, to support the footwear assembly;

(b) a toe wiper assembly including a plurality of toe wipers mounted to the machine frame for movement along a Y-axis in a toe wiping plane extending in an X-Y plane to press toe, side and ball portions of the upper margin against the insole bottom;

(c) an array of pincer assemblies positioned around the toe, side and ball portions of the footwear assembly, each pincer assembly including a pair of jaws adapted to receive part of the upper margin;

(d) movement assemblies respectively connected to the clamped pincer assemblies to lower said pincer assemblies relative to the toe wiping plane to stretch the upper around the last; and (e) pivot assemblies to which the clamped pincer assemblies are connected, said pivot assemblies being pivotal to correspondingly pivot the clamped pincer assemblies during a lasting cycle about an axis parallel to the Z-axis to positions inwardly of and beneath an edge of the insole to tightly wrap the stretched upper margin around at least ball portions of the last.

12. A method of lasting a footwear assembly on a shoe lasting machine, comprising the steps of:

(a) positioning an insole on a bottom of a last with an upper mounted thereon and having an upper margin extending around the insole;

(b) supporting said footwear assembly on the lasting machine;

(c) wiping the upper margin onto cemented regions of the insole by applying toe wipers against the upper margin to press toe, side and ball portions of the upper margin against the insole;

(d) stretching the toe, side and ball portions of the upper margin with a plurality of pincer assemblies; and (e) pivoting the pincer assemblies during a lasting cycle about an axis perpendicular to the toe wiping plane to move the pincer assemblies to positions inwardly of and beneath an edge of the insole to tightly wrap the stretched upper margin around at least ball regions of the last.

* * * * *